US005628586A

United States Patent [19]

Arlt, III

[11] Patent Number: 5,628,586

[45] Date of Patent: May 13, 1997

[54] ELASTOMERIC RISER TENSIONER SYSTEM

[75] Inventor: Edward J. Arlt, III, Arlington, Tex.

[73] Assignee: Continental Emsco Company, Houston, Tex.

[21] Appl. No.: 494,187

[22] Filed: Jun. 23, 1995

[51] Int. Cl.[6] ..... E02D 23/00

[52] U.S. Cl. ..... 405/195.1; 166/351; 166/367; 405/223.1; 405/224

[58] Field of Search ..... 405/195.1, 224, 405/223.1, 203, 204; 166/351, 359, 367; 114/264, 265; 267/141.1, 153, 294, 295, 202

[56] References Cited

U.S. PATENT DOCUMENTS

| | | | |
|---|---|---|---|
| Re. 30,262 | 4/1980 | Schmidt | 267/152 |
| 2,068,279 | 1/1937 | Piron | 267/63 |
| 2,724,588 | 11/1955 | Sheets | 267/35 |
| 2,727,534 | 12/1955 | Briede | 137/615 |
| 2,781,052 | 2/1957 | Schaetzly | 137/276 |
| 2,836,413 | 5/1958 | Hirst | 267/21 |
| 2,953,161 | 9/1960 | Muller | 137/615 |
| 3,068,552 | 4/1962 | Ragsdale | 137/615 |
| 3,537,696 | 11/1970 | Webster, Jr. | 267/63 |
| 3,556,554 | 1/1971 | Saward | 280/124 |
| 3,788,073 | 1/1974 | Castela et al. | 60/413 |
| 3,788,074 | 1/1974 | Castela et al. | 60/413 |
| 3,958,840 | 5/1976 | Hickox et al. | 308/2 A |
| 4,043,545 | 8/1977 | Dial et al. | 405/212 X |
| 4,105,266 | 8/1978 | Finney | 308/237 R |
| 4,324,194 | 4/1982 | Elliston | 405/195.1 |
| 4,379,657 | 4/1983 | Widiner et al. | 405/195 |
| 4,449,854 | 5/1984 | Nayler | 405/195 |
| 4,489,962 | 12/1984 | Caumont et al. | 285/263 |
| 4,617,998 | 10/1986 | Langner | 166/345 |
| 4,640,487 | 2/1987 | Salter | 248/571 |
| 4,662,786 | 5/1987 | Cherbonnier | 405/195 |
| 4,759,662 | 7/1988 | Peppel | 405/195 |
| 4,883,387 | 11/1989 | Myers et al. | 405/195 |
| 4,883,388 | 11/1989 | Cherbonnier | 405/195 |
| 4,886,397 | 12/1989 | Cherbonnier | 405/195 |
| 4,892,444 | 1/1990 | Moore | 405/195 |
| 4,968,010 | 11/1990 | Odobasic | 267/162 |
| 5,160,219 | 11/1992 | Arlt | 405/195.1 |
| 5,299,790 | 4/1994 | Whightsil, Sr. | 267/292 |
| 5,482,406 | 1/1996 | Arlt, III | 405/195.1 |

FOREIGN PATENT DOCUMENTS

| | | | |
|---|---|---|---|
| 0045651A2 | 2/1982 | European Pat. Off. | E21B 19/00 |
| 975122 | 8/1961 | Germany . | |
| 130490 | 1/1951 | Sweden . | |
| 2113799 | 8/1983 | United Kingdom | F16F 1/36 |
| 2160619 | 12/1985 | United Kingdom | F16D 3/56 |
| 2204898 | 11/1988 | United Kingdom | E21B 19/00 |
| 2250763 | 6/1992 | United Kingdom | E21B 17/01 |
| WO88/00273 | 1/1988 | WIPO | E21B 19/00 |

OTHER PUBLICATIONS

Top Mounted Drill String Compensators, Maritime Hydraulics, p. 5.

*Primary Examiner*—Dennis L. Taylor
*Attorney, Agent, or Firm*—Arnold, White & Durkee

[57] ABSTRACT

A riser tensioner system for applying a substantially constant tensioning force to a riser and allowing a floating platform to move within a given range along a longitudinal axis of the riser. The system includes a plurality of tensioner assemblies each of which are coupled to the riser and to the platform. Each of the tensioner assemblies includes an upper member, a lower member, a connecting member coupled to the upper and lower members, and intermediate members coupled to the upper and lower members at a point intermediate the ends of the upper and lower members. At least one of the upper member, the lower member, and the intermediate members are adapted to provide a constant tensioning force. The arrangement of the upper member, lower member, connecting member, and intermediate members further provide a linkage whose centerline in angularly spaced from the longitudinal axis of the riser by a substantially constant amount throughout the range of motion of the linkage.

92 Claims, 33 Drawing Sheets

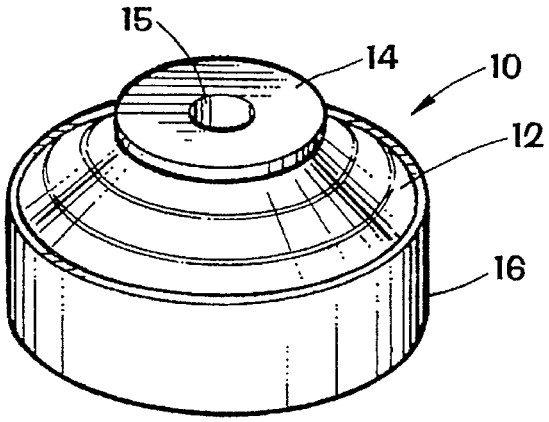
FIG. 1
FIG. 2
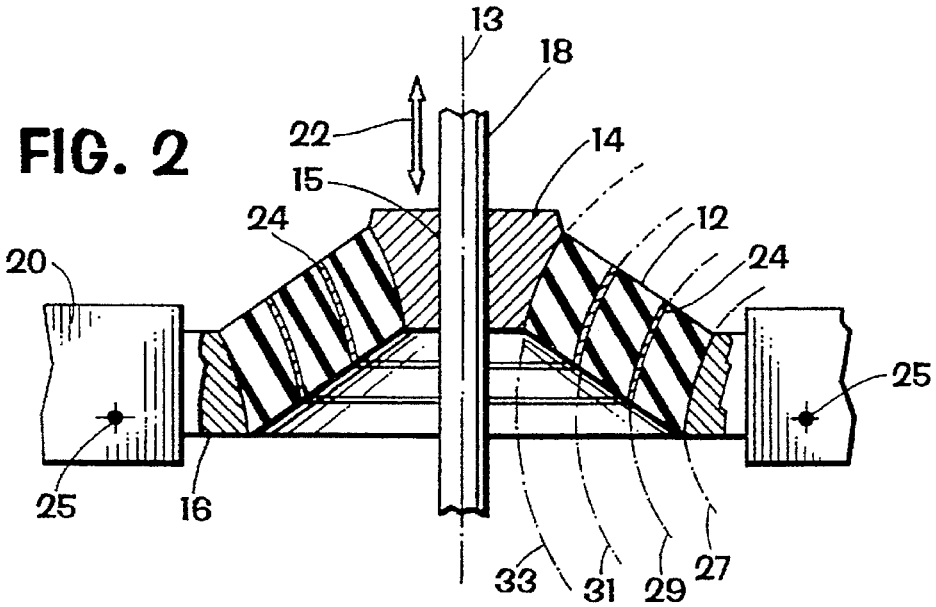
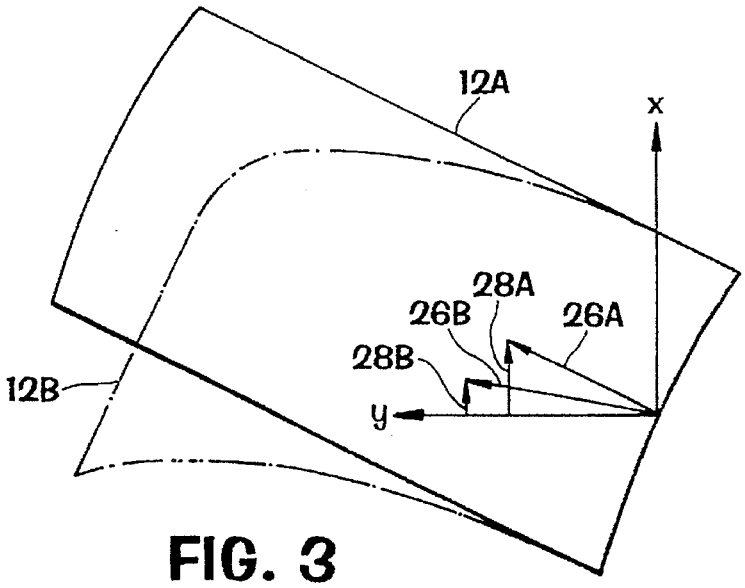
FIG. 3

FIG. 9
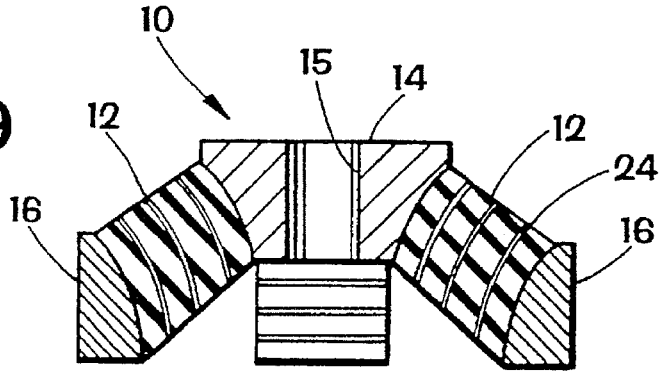
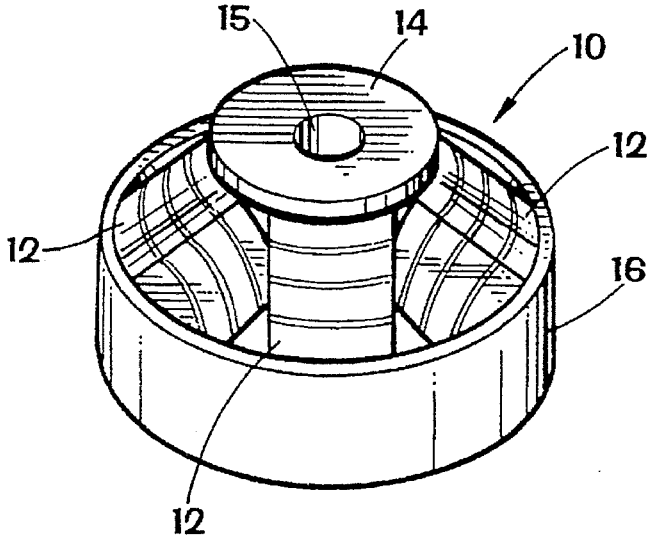
FIG. 10
FIG. 11
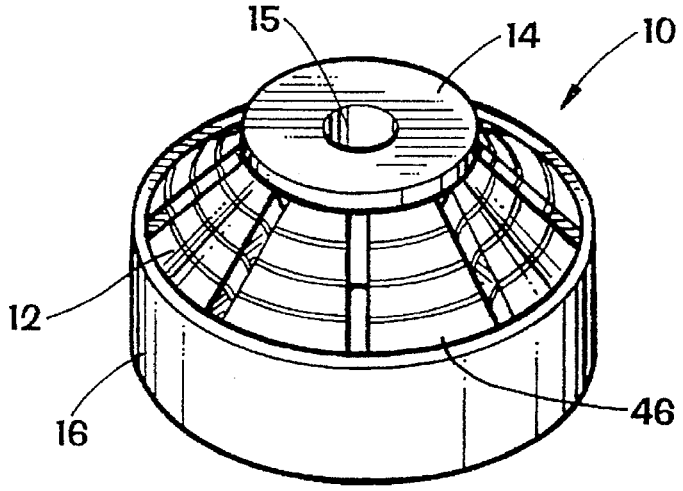

700

115
125
415
165
150
160
155
710
735
730
630
705
725
10
645
640
720
715
130
125
415
165
140
160
735
730
705
155
150
630
720
715
130

ELASTOMERIC RISER TENSIONER SYSTEM

CROSS-REFERENCE TO RELATED APPLICATIONS

The subject matter disclosed in this application is related to that disclosed in application Ser. No. 08/047,810, filed on Apr. 15, 1993, which issued as U.S. Pat. No. 5,482,406 on Jan 9, 1996.

BACKGROUND OF THE INVENTION

1. Field of the Invention

The present invention relates generally to riser tensioner systems for use on offshore platforms and, more particularly, to a riser tensioner system that provides a variable spring rate to maintain a substantially constant upward force on a supported riser.

2. Description of Related Art

Increased oil consumption and rising oil prices have lead to exploration drilling and production in geographic locations that were previously considered to be economically unfeasible. As is to be expected, drilling and production under these difficult conditions leads to problems that are not present under more ideal conditions. For example, an increasing number of facilities are located in offshore locations in order to tap more oil and gas reservoirs. These exploratory wells are generally drilled and then brought into production from floating platforms that produce a set of problems peculiar to the offshore drilling and production environment.

Offshore drilling and production operations require the use of pipe strings that extend from equipment on the sea floor to the floating platform. These vertical pipe strings, typically called risers, convey materials and fluids from the sea floor to the platform, and vise versa, as the particular application requires. The lower end of the riser is connected to the well head assembly adjacent the ocean floor, and the upper end usually extends through a centrally located opening in the hull of the floating platform.

As drilling and production operations progress into deeper waters, the length of the riser increases. Consequently, its unsupported weight also increases. Structural failure of the riser may result if compressive stresses in the elements of the riser exceed the metallurgical limitations of the riser material. Therefore, mechanisms have been devised in order to avoid this type of riser failure.

In an effort to minimize the compressive stresses and to eliminate, or at least postpone, structural failure, buoyancy or ballasting elements are attached to the submerged portion of the riser. These elements are usually comprised of syntactic foam elements, or of individual buoyancy or ballasting tanks, coupled to the outer surface of the riser sections. Unlike the foam elements, the tanks are capable of being selectively inflated with air or ballasted with water by using the floating vessel's air compression equipment. These buoyancy devices create upwardly directed forces in the riser and, thereby, partially compensate for the compressive stresses created by the weight of the riser. However, experience shows that these types of buoyancy devices do not adequately compensate for the compressive stresses or for other forces experienced by the riser.

To further compensate for the potentially destructive forces that attack the riser, the floating vessels incorporate other systems. Because the riser is fixedly secured at its lower end to the well head assembly, the floating vessel will move relative to the upper end of the riser due to wind, wave, and tide oscillations normally encountered in the offshore drilling environment. Typically, lateral excursions of the drilling vessel are prevented by a system of mooring lines and anchors or by a system of dynamic positioning thrusters that maintain the vessel in a position over the subsea well head assembly. Such positioning systems compensate for normal current and wind loading, and they prevent riser separation due to the vessel being pushed away from the well head location. However, these positioning systems do not prevent the floating vessels from oscillating upwardly and downwardly due to wave and tide oscillations. Therefore, the riser tensioning systems on the vessels are primarily adapted to maintain an upward tension on the riser throughout the range of longitudinal oscillations of the floating vessel. This type of mechanism applies an upward force to the upper end of the riser, usually by means of a cable, a sheave, or a pneumatic or hydraulic cylinder connected between the vessel and the upper end of the riser.

However, pneumatic and hydraulic tensioning systems are large, heavy, and require extensive support equipment. Such support equipment may include compressors, hydraulic fluid, reservoirs, piping, valves, pumps, accumulators, electric power, and control systems. The complexity of these systems necessitate extensive and frequent maintenance which, of course, results in high operating costs. For instance, many riser tensioners incorporate hydraulic actuators which stroke up and down in response to movements of the floating vessel. These active systems require a continuous supply of high pressure fluids for operation. Thus, a malfunction could eliminate the supply of this high pressure fluid, causing the system to fail. Of course, failure of the tensioner could cause at least a portion of the riser to collapse.

In an effort to overcome these problems, tensioner systems have been developed which rely on elastomeric springs. The elastomeric riser tensioner systems provide ease of installation, require minimal maintenance, and offer simple designs with few moving parts. These springs operate passively in that they do not require a constant input energy from an external source such as a generator. Moreover, the elastomeric systems do not burden the floating platform with an abundance of peripheral equipment that hydraulic systems need in order to function.

The elastomeric devices operate in the shear mode, whereby the rubber-like springs are deformed in the shear direction to store energy. The shear mode of operation has numerous shortcomings. For example, in the shear mode, rubber exhibits poor fatigue characteristics, which can result in sudden catastrophic failure. When numerous rubber springs are combined in series, the reliability of the system quickly deteriorates because only one flaw in the elastomeric load path can very quickly lead to catastrophic failure of the entire system.

Moreover, an ideal tensioner system provides a constant tensioning force to support the riser. While some of the complicated hydraulic systems alluded to above can be controlled to provide a substantially constant force, the simpler elastomeric devices which overcome many of the problems of the hydraulic systems do not support the riser using a constant force. Thus, changes in the force exerted on the riser in response to longitudinal excursions of the platform produce undesirable tensile stress fluctuations in the riser. These fluctuations can substantially shorten the useable life of the riser. In addition, most currently available elastomeric systems are quite complex and, thus, quite expensive.

The present invention is directed to overcoming, or at least minimizing, one or more of the problems set forth above.

SUMMARY OF THE INVENTION

In accordance with one aspect of the present invention, there is provided a riser tensioner system for applying a tensioning force to a riser and allowing a floating platform to move within a given range along a longitudinal axis of the riser. The riser tensioner system includes a plurality of tensioner assemblies, wherein each of the tensioner assemblies are coupled to the riser and also to the platform. Each of the tensioner assemblies includes an upper member, a lower member, a connecting member coupled to the upper and lower members, and an intermediate member coupled to the upper and lower members. The tensioner assemblies provide a tensioning force to the riser by having at least one of the upper member, the lower member, and the intermediate member adapted to provide a tensioning force.

In accordance with further aspects of the present invention, the tensioner assemblies provide a tensioning force to the riser by means of columnar stacks of compression elements contained within at least one of the upper member, the lower member, and the intermediate member. The compression elements including inner and outer flanges joined to a deflectable member whose spring rate varies within a given range to provide a substantially constant tensioning force throughout a given range of motion of the tensioner assemblies.

In accordance with a final aspect of the present invention, the tensioner assemblies provide a constant tensioning force to the riser by the combination of the variation of the spring rate of the compression elements and the substantially constant angle of the tensioner assemblies relative to the longitudinal axis of the riser.

BRIEF DESCRIPTION OF THE DRAWINGS

Advantages of the invention will become apparent upon reading the following detailed description and upon reference to the drawings in which:

FIG. 1 illustrates a perspective view of a compression element in accordance with the present invention;

FIG. 2 illustrates a cross-sectional view of the compression element illustrated in FIG. 1;

FIG. 3 illustrates a portion of the deflectable member of the compression element illustrated in FIG. 2 in its undeflected and deflected states;

FIG. 9 illustrates a cross-sectional view of a compression element as illustrated in FIGS. 6, 7, and 8;

FIG. 10 illustrates a perspective view of yet another embodiment of a compression element, in accordance with the present invention, having a circular segmented configuration with a continuous outer flange;

FIG. 11 illustrates a perspective view of a further embodiment of a compression element, in accordance with the present invention, having a circular slotted configuration with a continuous outer flange;

Figure 4:
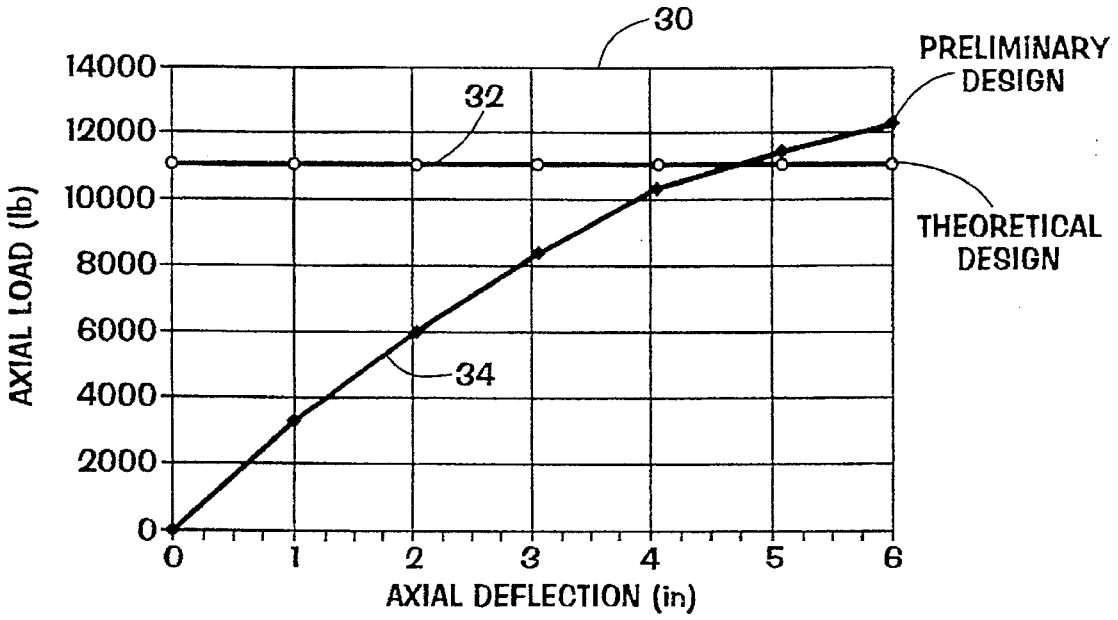
FIG. 4 is a graph of spring rate v. deflection for a compression element, such as the compression element illustrated in FIG. 1, where the compression element has no reinforcements.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives following within the spirit and scope of the invention as defined by the appended claims.

DESCRIPTION OF THE PREFERRED EMBODIMENTS

By utilizing the dynamic advantages afforded by elastomeric design concepts that continue to exploit the remarkable energy storage properties of elastomers, many new solutions to the present problems are possible. Because of the simplicity of the elastomeric elements that deform in compression rather than in shear, there exists the potential to improve greatly the reliability, functional simplicity, and manufacturing and cost efficiency of riser tensioner systems as compared with prior riser tensioner systems, whether hydraulic or elastomeric. As will become apparent from studying this disclosure, the compression element disclosed herein as a preferred embodiment of the disclosed riser tensioner systems, permits the design and manufacture of simple, low cost, and highly reliable riser tensioner systems.

Before discussing the specific structures illustrated in the drawings, it should be noted that, by following the teachings disclosed herein, a wide variety of riser tensioner systems that maintain a substantially constant tensioning force may be designed. Indeed, several alternatives are described herein. Preferably, each system uses elastomeric elements that operate primarily in the compression mode. When such elements operate in the compression mode, they offer inherent advantages such as extremely long fatigue life and fail-safe operation.

Conventional compression-loaded elements tend to get stiffer as the element deflects. The force produced by a spring system as it deflects is given by the following equation:

$$\bar{F}=x\bar{K}_c \qquad \text{(equation 1)}$$

where F equals the force applied to the spring, x equals the deflection of the spring, and $k_c$ equals the compression spring rate of the spring system. Therefore, for a tensioner system to maintain a substantially constant force on the riser as the platform moves, the collective spring rates of the tensioner devices vary inversely proportionally with respect to the deflection of the system as the system deflects. In other words, as the riser strokes and compresses the elements, the spring rate of the system becomes softer in accordance with the above equation.

U.S. Pat. No. 5,160,219, issued Nov. 3, 1992, and assigned to the same assignee, discloses various riser tensioner systems that maintain a substantially constant tensioning force on the riser. These systems use elastomeric elements that operate in the compression mode. Levers control the orientation of the elastomeric elements to vary a vertical component of the spring rate as the riser strokes. Although these systems operate quite well, they often use complex spring and lever assemblies. The devices disclosed herein offer the same benefits and advantages of the systems disclosed in U.S. Pat. No. 5,160,219, yet they are simpler to design, manufacture, and install.

Turning now to the drawings and referring initially to FIG. 1, a preferred embodiment of a compression element is illustrated and generally designated by a reference numeral 10. The compression element 10 includes a deflectable member 12, an inner flange 14, and an outer flange 16. The deflectable member 12 is preferably a truncated, hollow, cone-shaped elastomeric molding. The inner and outer flanges 14 and 16 are preferably metal, but may also be made of a composite material. The inner diametric portion of the deflectable member 12 is coupled to an outer portion of the inner flange 14, and the outer diametric portion of the deflectable member 12 is coupled to an inner portion of the outer flange 16. In fact, the most preferable compression element 10 may be most accurately described as an elastomeric Belleville washer with a constrained outer periphery. The inner flange 14 may include a centrally positioned cylindrical aperture 15 or it may be solid, depending upon the configuration of the riser tensioner system.

The flanges 14 and 16 and the deflectable member 12 are preferably molded. Those knowledgeable in mold design will realize that many design parameters should be considered, such as tolerances of the mold and metal insert interfaces, configuration and surface finish, elastomer shrinkage, and heat transfer. Finite element analysis is often useful for comparing predicted data with actual data from prototypes. From substantial experience in the development of procedures for large laminated elastomeric bearings, it should be noted that sub-scale efforts do not adequately duplicate the same process conditions as full-scale moldings. Thus, full-scale unbonded and semi-bonded prototypes are recommended before actual production begins.

The type of elastomer selected depends upon the characteristics required for a given application. Preferably, the raw elastomer, filler, and plasticizer are carefully selected, weighed, and mixed to form the desired compound, as is well known to those skilled in the art. The compound is then calendared on a roll to build up the compression elements prior to molding.

Preferably, the deflectable member 12 is permanently coupled to the metal flanges 14 and 16 using a vulcanized bonding process that is well known in the art. The steel flanges 14 and 16 are first subjected to a rigorous cleaning that begins with an application of solvent to remove any packaging coating or contaminates remaining from the metal forming process. The steel components are then subjected to baking at 230 degrees Celsius for at least 48 hours to remove any oils or other contaminates detrimental to bonding. The components are then cleaned again with solvent and blasted to a white metal finish using aluminum oxide grit. Finally, the components are vapor degreased and power rinsed with virgin solvent.

Before the bonding agent is applied to the metal components, a primer, such as Chemlock 205 available from Lord Elastomer Products Corp., 2000 West Grand View Blvd., Erie, Pa. 16512, is applied to the bonding surfaces of the flanges 14 and 16. The bonding agent is preferably continuously agitated to ensure adequate mixing and, then, it is applied to the flanges using a spray gun energized by a dried and filtered air supply. Each piece of elastomer is cut from the calendar roll and built up (preferably with reinforcements as will be described subsequently) and assembled into the mold. The assembled mold is transferred to a press for curing, as is well known to those skilled in the art.

When the deflectable member 12 is in its undeflected state, it axially separates the inner flange 14 from the outer flange 16, as illustrated in FIG. 2. In this state, the deflectable member 12 forms a given conical angle $\alpha$ between the longitudinal axis 13 of the compression element 10 and an "element" of the cone, which is one of the sloping sides of the deflectable member 12. When an axial load is applied to the compression element 10, the inner flange 14 moves closer to the outer flange 16, thus compressing the deflectable member 12 and increasing the conical angle $\alpha$ by "rotating" the deflectable member 12 into a more horizontal position. Actually, the load initially imposes some shear loading on the rubber, but it quickly reverts to a compression dominant mode as the deflectable member 12 rotates downward and compresses between the inner flange 14 and the outer flange 16. The compression and flattening of the deflectable member 12 is illustrated in FIG. 3 where the member 12A represents the deflectable member 12 in its undeflected state and the member 12B represents the deflectable member 12 in its fully deflected state.

It is easy to visualize that the deflectable member 12 compresses and becomes more horizontal as the inner flange 14 moves downwardly relative to the outer flange 16. However, what is not so easy to visualize is the affect that this movement has upon the axial spring rate of the deflectable member 12. As illustrated in FIG. 3, the vector 26A represents the spring rate of the deflectable member 12 when it is in its undeflected state, and the vector 26B represents the spring rate of the deflectable member 12 when it is in its fully deflected state. Notice that as the deflectable member 12 deflects, its spring rate vector 26 becomes more horizontal, moving from the position of the vector 26A to the position of the vector 26B. The rotation of the spring rate vector 26 causes the magnitude of the vertical component of the vector 26 to decrease, as can be seen by comparing the magnitudes of the vertical component vectors 28A and 28B. It should also be noted that the magnitude of the vector 26 increases slightly as the deflectable member 12 compresses. Thus, the magnitude of the vertical component vector 28B is slightly greater than it would be if the magnitude of the vector 26 remained constant during rotation.

Because the object of the compression element 10 is to keep the axial force substantially constant, the magnitude of the vertical component of the spring rate vector 28 must decrease as the axial deflection x of the deflectable member 12 increases. Using equation 1 and assuming linearity between the undeflected state and the fully deflected state we can see that:

$$\bar{F} = x_1\bar{k}_{c1} \quad \text{(equation 2)}$$

$$\bar{F} = x_2\bar{k}_{c2} \quad \text{(equation 3)}$$

$$x_1\bar{k}_{c1} = x_2\bar{k}_{c2} \quad \text{(equation 4)}$$

$$\frac{x_1}{x_2} = \frac{\bar{k}_{c2}}{\bar{k}_{c1}} \quad \text{(equation 5)}$$

where $x_1$ is the axial displacement of the deflectable member 12 in its undeflected state, $k_{c1}$ is the vertical component of the spring rate of the deflectable member 12 in its undeflected state, $x_2$ is the axial displacement of the deflectable member 12 in its fully deflected state, and $k_{c2}$ is the vertical component of the spring rate of the deflectable member 12 in its fully deflected state. Thus, as shown by equations 2–5, the change in the vertical component 28 of the spring rate vector 26 of the deflectable member 12 changes inversely proportionally with the change in axial displacement x of the deflectable member 12.

Figure 5:
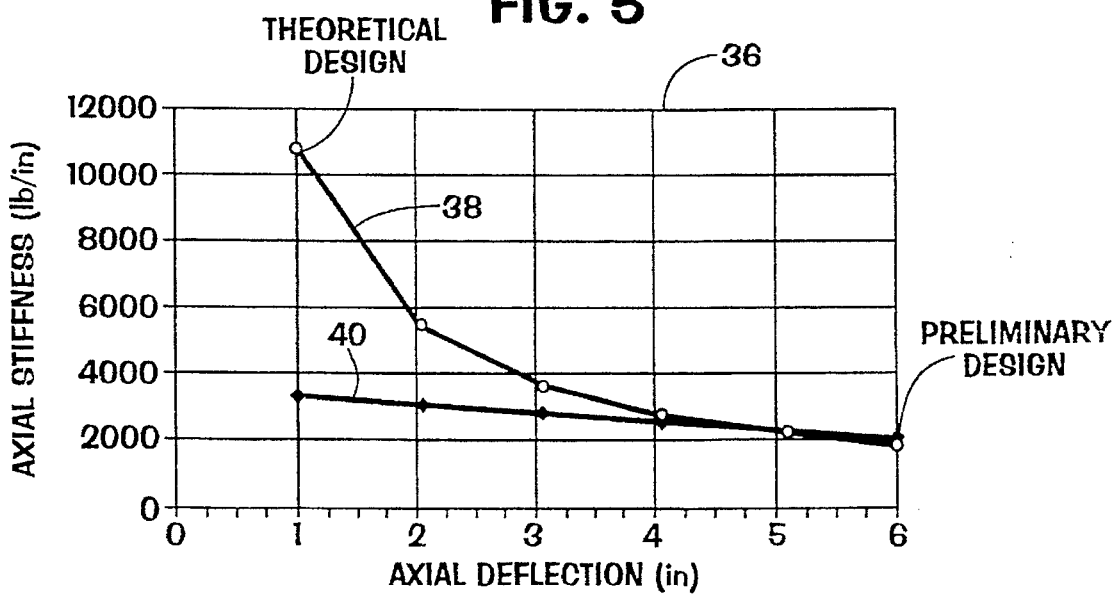
FIG. 5 is a graph of targeted and actual force v. deflection for a compression element, such as the compression element illustrated in FIG. 1, where the compression element has no reinforcements.

The application of equations 2–5 is illustrated in FIGS. 4 and 5. FIG. 4 illustrates a graph 30 of the axial load F versus the axial deflection x of a compression element 10. The curve 32 illustrates the theoretical design goal for a compression element 10, where the desired constant force is 11,000 pounds. For the particular force versus deflection illustrated by the curve 32 in FIG. 4, the curve 38 of the graph 36 illustrated in FIG. 5 describes the theoretically ideal decrease in axial stiffness, i.e., vertical spring rate, as the deflection x of the compression element 10 ranges from one inch to six inches. By plugging the data from the curves 32 and 38 into equation 1, one can readily see that the axial force remains constant if the magnitude of the vertical component of the spring rate changes in accordance with the curve 38.

However, it would be difficult to design a compression element 10 to maintain a constant axial force of 11,000 pounds over its entire deflection range, illustrated in the graphs 30 and 36 as being six inches. The curve 34 illustrates the actual force versus deflection characteristics of an early preliminary design of a compression element 10. Clearly, over the six inch range, the axial force is not substantially constant. However, over the deflection range of three to six inches, the curve 34 begins to level off and approximates the ideal curve 32. In other words, the slope of the curve 34 decreases between three inches and six inches of displacement. Similarly, the curve 40 illustrates the amount that the vertical component of the spring rate of the early preliminary design of the compression element 10 actually decreased over the deflection range of the compression element 10. It, too, closely approximates the ideal curve 38 as it reaches the operating range between three and six inches of deflection. Thus, the compression element 10 could be prestressed so that it operates in the deflection range of three to six inches, and the force within the operating range of the compression element 10 will vary between 8,000 and 12,000 pounds.

It should be emphasized that the curves 34 and 40 were produced using data from an early preliminary design. Although the early preliminary design did not mirror the theoretically ideal design, it did prove that the vertical component of the spring rate of the compression element 10 actually did decrease as its deflection increased. Thus, it proved that the concepts disclosed herein were viable. By following the teachings disclosed herein, one skilled in the art can properly select the parameters to produce a compression element 10 that provides an even more constant axial force within a given operating range.

By properly considering certain parameters, a compression element 10 can be designed to provide a substantially constant axial force for a predetermined range of deflection. Many parameters of the compression element 10 may be altered and chosen, depending on the desired application, to provide a substantially constant force to maintain substantially constant tension on a riser. For instance, the stiffness and the shape of the deflectable member 12 is chosen based upon the force that it is expected to experience during use, as well as the amount of deflection that it will experience as the riser strokes. Thus, the stiffness and compressibility of the deflectable member are largely determined by the choice of elastomeric material. The conical angle is also chosen, along with the shape and composition of the deflectable member 12, to provide the desired change in axial spring rate over the desired deflection range. The actual structure of the deflectable member 12 is also important, as will be explained in greater detail in reference to FIGS. 6–11.

In the most preferable embodiment, the deflectable member 12 is reinforced by one or more shims or reinforcements 24. The reinforcements 24 are preferably made of a composite or metal material. The reinforcements 24, and particularly the annular reinforcements used in a conically-shaped deflectable member 12, tend to stiffen the deflectable member 12. A deflectable member having reinforcements exhibits greater axial strength and is more difficult to compress than one not having shims.

The shapes of the reinforcements, of the coupling portions of the inner and outer flanges 14 and 16, and of the inner and outer diametric portions of the deflectable member 12 will also influence the characteristics of the compression element 10. For instance, each of these surfaces may be straight, and the angles of these surfaces can be selected to achieve the desired characteristics, i.e., substantially constant force during deflection in a particular range. Preferably, however, the shapes of these elements are curved or spherical. In fact, these reinforcements are the reverse of the shape normally utilized for angular deflection. It has been found that spherical surfaces reduce the stress experienced by the compression element 10 as it deflects and causes the deflectable member 12 to "rotate" in a more controlled and linear manner. Therefore, the compression element becomes more stable, more predictable, and requires less material to handle the same amount of force.

As illustrated in FIG. 2, the outer diametric portion of the inner flange 14 and the outer diametric portion of the deflectable member 12 are concave. Similarly, the inner diametric portion of the outer flange 16 and the inner diametric portion of the deflectable member 12 are convex to compliment the concave surfaces of the members to which they are coupled. The reinforcements 24 illustrated in FIG. 2 may be curved in the same manner as the surfaces of the inner flange 14, the outer flange 16, and the deflectable member 12 to facilitate compression and rotation.

The curvature of the reinforcements 24 also affects the deflection characteristics of the compression element 10. In one embodiment, the reinforcements 24 and the surfaces of the inner flange 14, the outer flange 16, and the deflectable member 12 have the same curvature, which means that the focal point of each is the same distance from the respective surface. So constructed, the deflectable member 12 generally remains more linear as it "rotates" and, thus, remains more stable and predictable as compared with a deflectable member 12 have no shims or having straight shims.

In the most preferred embodiment, however, the reinforcements 24 and the surfaces of the inner flange 14, the outer flange 16, and the deflectable member 12 have the same focal point, illustrated by the focal points 25 in FIG. 2.

In other words, a cross-section of each of these surfaces taken through the center of the compression element 10 may be thought of as a portion of a respective concentric circle 27, 29, 31, and 33 each having the same focal point 25, as illustrated in FIG. 2. Of course, since the compression element 10 shown in FIG. 2 is circular, the focal point 25 actually forms a "ring" around the compression element 10. In this configuration, the deflectable member 12 exhibits almost perfect linearity as it rotates during compression.

It should be noted that if the curved reinforcements 24 illustrated in FIG. 2 are solid rings, the curved reinforcements 24 do not pivot about the focal points 25. Rather, the curved reinforcements 24 move linearly up and down along the longitudinal axis 13 of the compression element 10, as would cylindrical reinforcements. However, the curved reinforcements 24 provide a dynamic advantage as compared to straight cylindrical reinforcements. If the deflectable member 12 contained cylindrical reinforcements, the elastomeric material in the deflectable member 12 would not rotate linearly during deflection. Rather, the elastomeric material would deform in shear such that the elastomeric material would bow in an arc as the inner flange 14 moves closer to the outer flange 16. This result is avoided by using the curved bonding surfaces of the inner flange 14 and of the outer flange 16 along with the curved reinforcements 24. The curved surfaces force the elastomeric material in the deflectable member 12 to rotate as a uniform body or column, because the curved surfaces have a greater projected area of influence on the elastomeric material along the direction of deflection. As the inner flange 14 moves toward the outer flange 16, the elastomeric material compresses within the area between the curved surfaces to produce an increase in bulk loading as the deflectable member 12 rotates linearly from its initial unloaded position.

The use of slotted or segmented configurations of the deflectable member 12, either with or without reinforcing shims, also facilitates the tailoring of the dynamic characteristics of the compression element over a wide range of applications. FIGS. 6–11 illustrate various different embodiments that the compression element may take depending upon the application in which the compression element is to be used. To avoid confusion, the reference numerals previously used to describe the compression element 10 will be used to describe similar elements of the compression elements illustrated in FIGS. 6–11.

The slotted or segmented configurations include slotted or segmented deflectable members 12 and, possibly, segmented outer flanges 16. A slotted or segmented deflectable member 12 tends to act as multiple deflectable columns or springs arranged circumferentially around the inner flange 14, as contrasted with the deflectable "cone" represented by the solid circular configuration illustrated in FIGS. 1 and 2. Typically, the size and number of the segments or slots are chosen to vary the spring rate, to increase the range of deflection, or to reduce the axial force exerted by the compression element 10.

Figure 6:
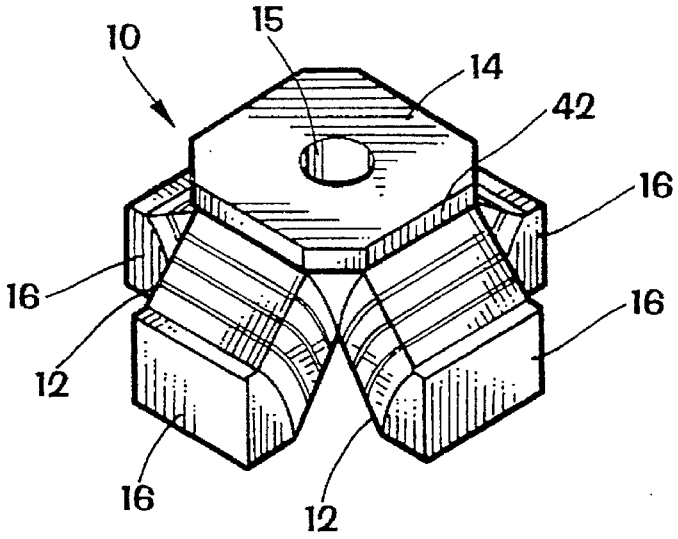
FIG. 6 illustrates a perspective view of another embodiment in accordance with the present invention having a square, segmented configuration.
Figure 7:
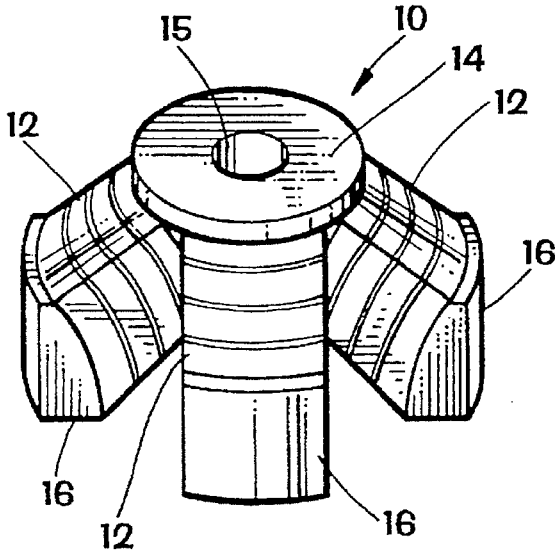
FIG. 7 illustrates a perspective view of another embodiment of a compression element, in accordance with the present invention, having a circular, segmented configuration.

The segmented configurations preferably use separate members as the deflectable member 12. FIG. 6 illustrates a compression element 10 having a square, segmented configuration. In this embodiment, the inner flange 14 is square or rectangular having four elongated sides 42. One end of a deflectable member 12 is coupled to each of the sides 42 at a given angle that corresponds to the conical angle $\alpha$ described earlier. The other end of each of the deflectable elements 12 are coupled to a segment of an outer flange 16. FIG. 7 illustrates a compression element 10 having a circular, segmented configuration. The circular segmented compression element 10 includes a circular inner flange 14 much like the inner flange 14 illustrated in FIGS. 1 and 2. One end of a plurality of deflectable members 12 is coupled to the inner flange 14 at a given angle. The other end of the plurality of deflectable members 12 is coupled to a segment of an outer flange 16.

Figure 8:
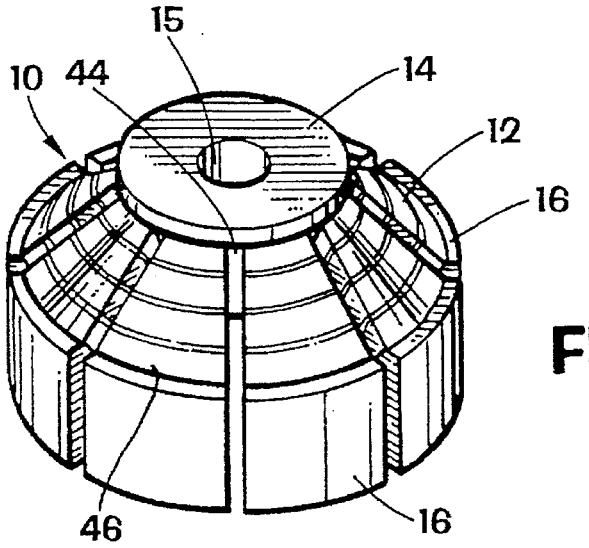
FIG. 8 illustrates a perspective view of still another embodiment of a compression element, in accordance with the present invention, having a circular, slotted configuration.

In contrast to the embodiments that utilize a segmented deflectable member, FIG. 8 illustrates a compression element 10 having a circular slotted configuration. In this embodiment, a one-piece, and generally conical, deflectable member 12 is coupled to an inner flange 14. The deflectable member 12 is slotted so that the deflectable member 12 has a center hub 44 with outwardly extending spokes 46. The radially outer end of each of the spokes 46 is coupled to a segment of an outer flange 16. However, regardless of whether a segmented or slotted configuration is used, FIG. 9 illustrates a cross-sectional view of the compression elements 10 illustrated in FIGS. 6, 7, and 8. It should be noticed that the segmented and slotted configurations also preferably use the spherical concave and convex surfaces for the deflectable members 12, inner flanges 14, and segments of the outer flanges 16. Furthermore, the reinforcements 24 may be used as mentioned previously.

In the most preferred embodiment, the curved reinforcements 24 and the curved surfaces of the inner flange, the outer flange 16, and the elastomeric material of the deflectable member 12 have the same focal point, as discussed with reference to FIG. 2. The same advantages discussed previously with regard to a solid conical deflectable member 12 apply to a slotted or segmented deflectable member 12. However, in the most preferred slotted or segmented embodiment, the slotted or segmented deflectable member 12 may exhibit even greater stability as it deflects because the curved reinforcements 24 are also segmented. Thus, unlike the solid rings discussed previously, the segmented curved reinforcements are not constrained to move linearly along the longitudinal axis 13 as the inner flange 14 moves toward the outer flange 16. Rather, the segmented curved reinforcements may rotate about their respective focal points. Thus, the segmented or slotted deflectable members 12 remain substantially linear during deflection because the elastomeric material in the deflectable member 12 and the curved reinforcements 24 essentially rotate about the same pivot point, i.e., the focal points.

A compression element may also be made using a segmented or slotted deflectable member 12 and a continuous outer flange. FIG. 10 illustrates a compression element 10 having a segmented configuration with a continuous outer flange. The segments of the deflectable member 12 are similar to those used in the embodiment illustrated in FIG. 7. However, rather than being coupled to a segment of an outer flange, they are coupled to a continuous outer flange 16, such as that used in the compression element 10 illustrated in FIG. 1. Similarly, FIG. 11 illustrates a compression element 10 having a circular slotted configuration with a continuous outer flange 16. The deflectable member 12 is similar to the deflectable member illustrated in FIG. 8. However, instead of having the spokes of the deflectable member 12 coupled to a segment of an outer flange, the ends of the spokes 46 are coupled to a continuous outer flange 16.

A compression element 10, such as the ones disclosed above, may be used alone or in combination with other deflectable elements as a counter-balancing device, a load and motion compensation device, or a riser tensioner device. FIG. 2 illustrates the compression element 10 being used alone in a riser tensioner system. The inner flange 14 is coupled to a riser 18, and the outer flange 16 is coupled to a floating platform 20. A s the platform 20 moves relative to the riser 18 in response to the motion of the water, the compression element 10 deflects axially, generally in the direction of the double-headed arrow 22. Thus, the compression element 10 allows the platform 20 to move in an axial direction relative to the riser 18. The range of movement of the platform 20 with respect to the riser 18 is commonly referred to as the "riser stroke." More specifically, the riser stroke includes an "up stroke" and a "down stroke." The up stroke occurs when the top of the riser moves up relative to the platform, and the down stroke occurs when the top of the riser moves down relative to the platform. Ideally, the compression element 10 minimizes the compressive stresses in the riser 18 as the riser 18 strokes by applying a substantially constant force to maintain tension on the riser 18. Therefore, the axial spring rate increases during upstroke and decreases during down stroke. A compression element, such as that illustrated in FIG. 2, may have an outer flange 16 having a diameter of 36 inches, an inner flange 14 having a diameter of 9 inches, and a height of 13 inches.

Although a single compression element 10 may be used alone as a riser tensioner, in most applications it is desirable to use a plurality of compression elements 10 in a riser tensioner system. It should be remembered that one goal in the design of a riser tensioner system is to design a system that maintains a substantially constant force on the riser as it strokes.

Figure 12:
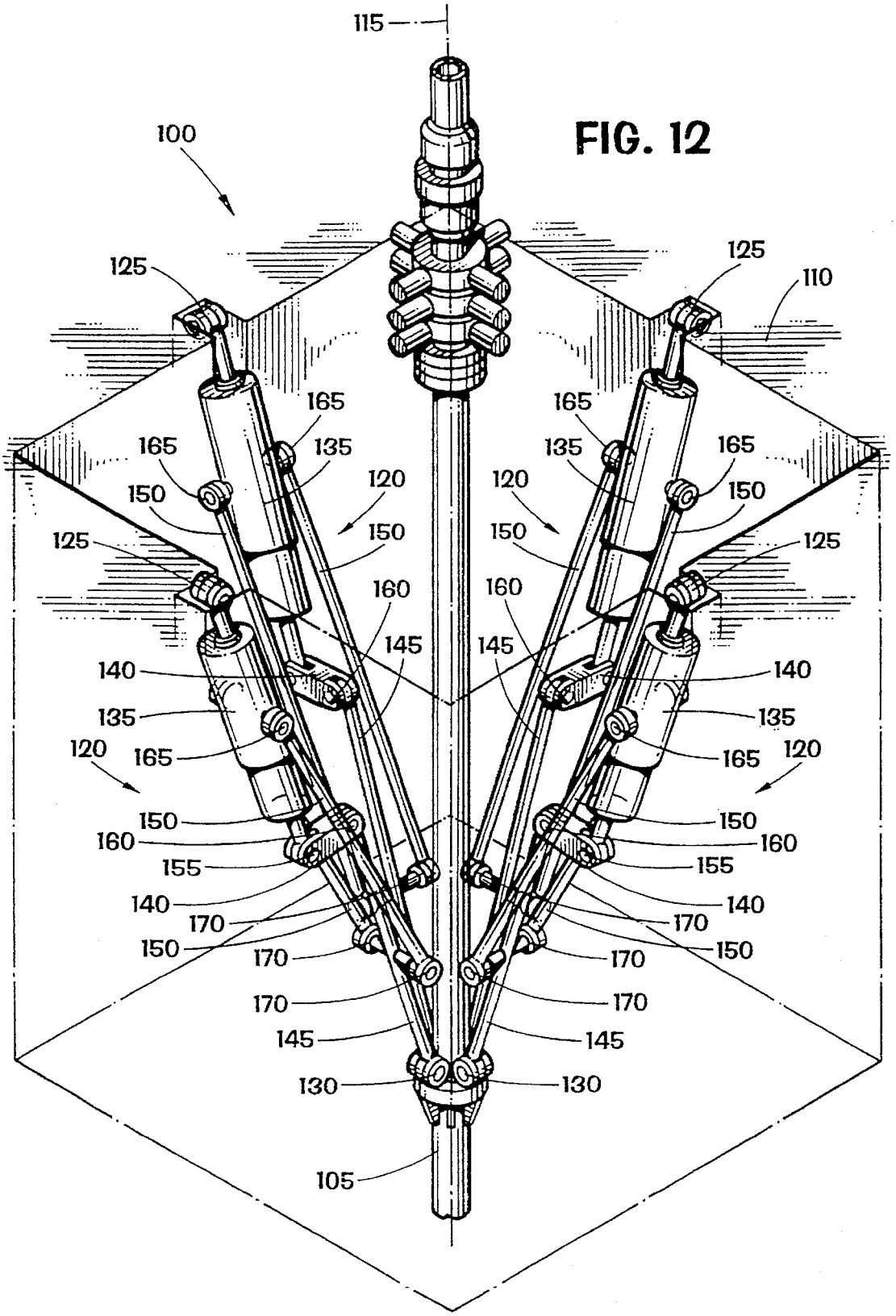
FIG. 12 illustrates a perspective view of one embodiment of a riser tensioner system including a plurality of tensioner assemblies each including an upper member providing a tensioning force and having a columnar stack of compression elements.
Figure 13:
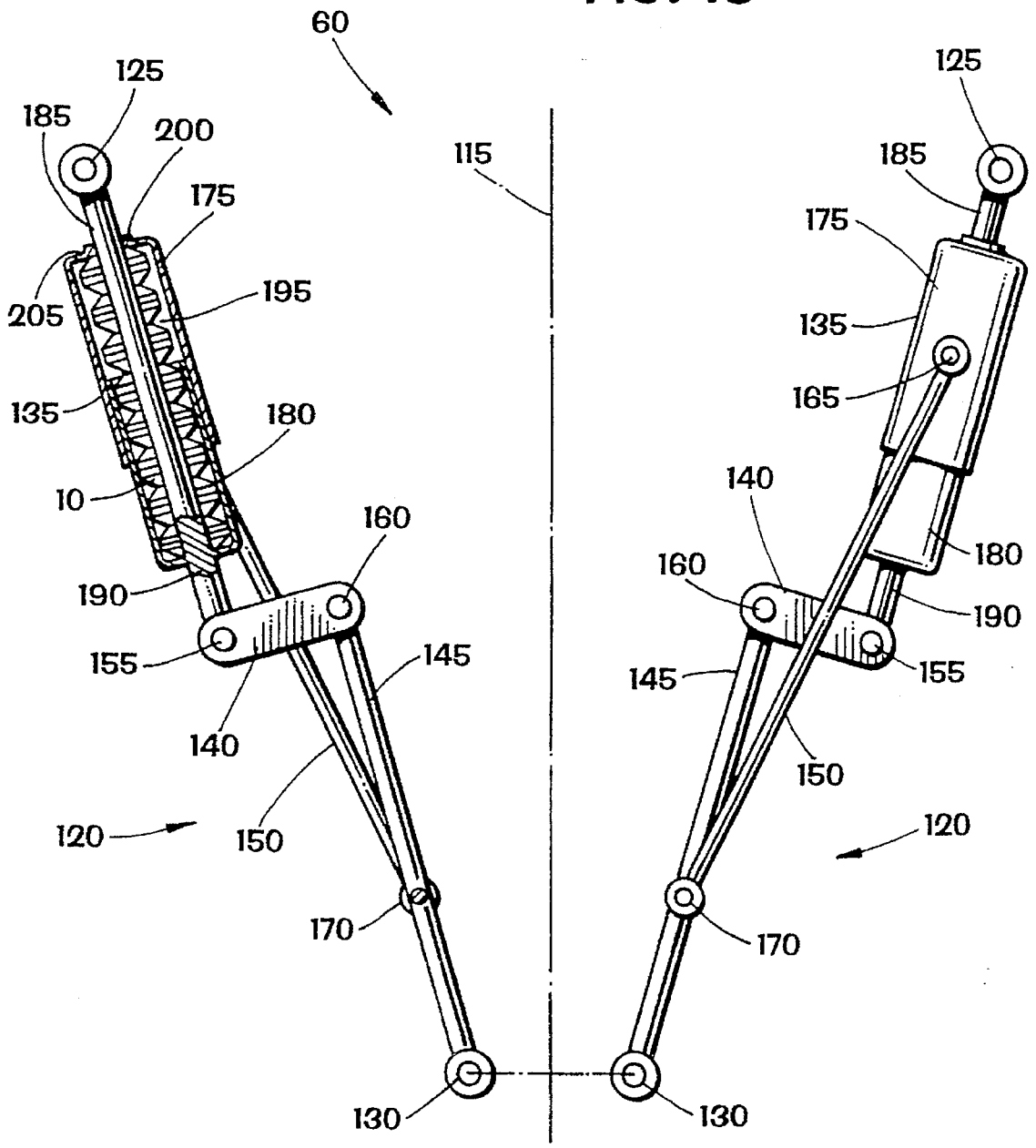
FIG. 13 illustrates a partial cross-sectional view of a pair of opposing tensioner assemblies of the embodiment illustrated in FIG. 12.

One preferred embodiment of a riser tensioner system 100 that incorporates a plurality of compression elements 10 is illustrated in FIGS. 12–13. Throughout the discussion of the preferred embodiments, similar elements are identified with like reference numerals. The riser tensioner system 100 applies a tensioning force to a riser 105 and allows a floating platform 110 to move within a given range along a longitudinal axis 115 of the riser 105. The riser tensioner system 100 includes a plurality of tensioner assemblies 120. Each tensioner assembly 120 is pivotally connected at one end to the platform 110 by a pinned connection 125. The pinned connection 125 may be made to a lower surface or to a sidewall surface (not shown) of the floating platform 110. Each tensioner assembly 120 is further pivotally connected at another end to the riser 105 by means of another pinned connection 130. The riser tensioner system 100 may include a plurality of tensioner assemblies 120 spaced about the riser 105, preferably in a symmetrical fashion. Preferably the riser tensioner system 100 includes opposing pairs of such tensioner assemblies 120 that are equally angularly spaced about the longitudinal axis 115 of the riser 105.

Each tensioner assembly 120 includes a resilient upper member 135, a rigid connecting member 140, a rigid lower member 145, and rigid intermediate members 150. The upper member 135, connecting member 140, lower member 145, and intermediate members 150 may be fabricated from metal or composite materials possessing sufficient strength for the particular loading conditions. In a preferred embodiment, due to the harsh environment generally present at an offshore platform, they are fabricated of materials resistant to corrosion, such as stainless steel. The upper member 135 and lower member 145 are pivotally connected to the connecting member 140 by pinned connections 155 and 160 respectively. The upper member 135 and lower member 145 are further pivotally connected to the intermediate members 150 by pinned connections 165 and 170 respectively.

As will be discussed with respect to the various preferred embodiments of the present invention, the riser tensioner system provides a tensioning force to the riser 105 by means of a plurality of tensioner assemblies. The tensioner assemblies in turn provide a tensioning force to the riser 105 by adapting at least one of the upper member, lower member, and intermediate members to provide a tensioning force by the incorporation of one or more columnar stacks of compression elements 10. These adaptations of the upper, lower, and intermediate members utilize various basic building blocks which throughout the discussion of the preferred embodiments will be identified with like reference numbers.

The tensioner assemblies 120 of the riser tensioner system 100 provide a tensioning force to the riser 105 by means of a columnar stack of compression elements 10 contained within each of the upper members 135 which are compressed during vertical extension of the tensioner assembly 120. In this embodiment, the connecting member 140, lower member 145, and intermediate members 150 of the tensioner assembly 120 are rigid members and thereby provide the necessary linkage to enable compression of the compression elements 10 contained within the resilient upper member 135. In particular, each upper member 135 includes an outer canister 175, an inner canister 180, a central shaft 185 integral to the inner canister 180, and a support shaft 190 integral to the inner canister 180. The central shaft 185 extends from the inner canister 180 through a chamber 195 defined by the interiors of the outer canister 175 and inner canister 180, passes through a centrally positioned aperture 200 in an end portion 205 of the outer canister 175, and is pivotally connected to the platform 110 by the pinned connection 125. The support shaft 190 extends from the inner canister 180 and is pivotally connected to the connecting member 140 by the pinned connection 155. The chamber 195 defined by the interiors of the outer canister 175 and the inner canister 180 contains a columnar stack of compression elements 10 with the central shaft 185 passing through the central apertures 15 of the compression elements 10. The inner canister 180 is positioned within and extends from the interior of the outer canister 175. The outer canister 175 is pivotally connected to the intermediate members 145 by the pinned connections 165. During vertical extension of the tensioner assembly 120, the end portion 205 of the outer canister 175 compresses the columnar stack of compression elements 10 by virtue of the linkage of the tensioner assembly 120 provided by the combination of the upper member 135, lower member 145, connecting member 140, and intermediate members 150. The compression of the compression elements 10 in turn provides a reaction force opposing vertical extension of the tensioner assembly 120 which provides the tensioning force to the riser 105.

Figure 14:
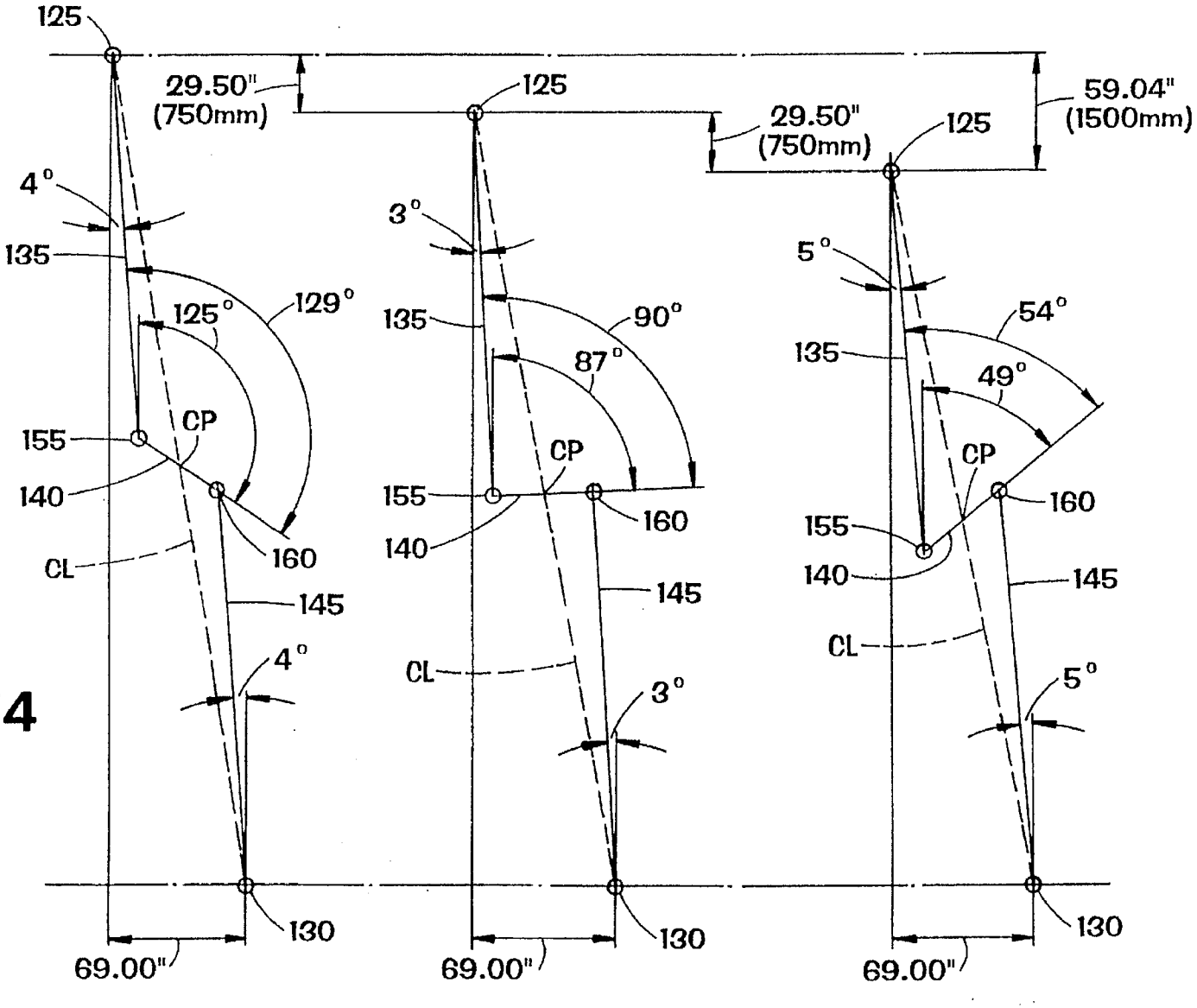
FIG. 14 illustrates the typical motion of an exemplary embodiment of a tensioner assembly during relative vertical motion of a riser with respect to a floating platform.

As illustrated in FIG. 14, the combination of the upper member 135, lower member 145, and intermediate members 150 form a linkage in which the connecting member 140 is free to rotate through an angle of approximately 180 degrees during relative vertical movement of the riser 105 with respect to the platform 110. A single intermediate member 150 may be used in the tensioner assembly 120, but preferably a pair of intermediate members 150 are pivotally connected on opposite sides of the tensioner assembly 120 to the upper member 135 and lower member 145. During relative vertical movement of the riser 105 with respect to the platform 110, the connecting member 140 rotates about a centerline CL of the assembly 120 at a center point CP of the connecting member 140. The linkage design of the tensioner assembly 120 results in a centerline CL whose angle relative to the longitudinal axis 115 of the riser 105 remains substantially constant throughout the full range of motion. The combination of the compression elements 10, whose reaction force is substantially constant as a function of displacement, and the linkage design of the assembly 120, which maintains a substantially constant angle between the centerline CL and the longitudinal axis 115, results in a riser tensioner system 100 that provides a substantially constant tensioning force to the riser 105 throughout the range of relative motion between the riser 105 and platform 110.

Figure 15:
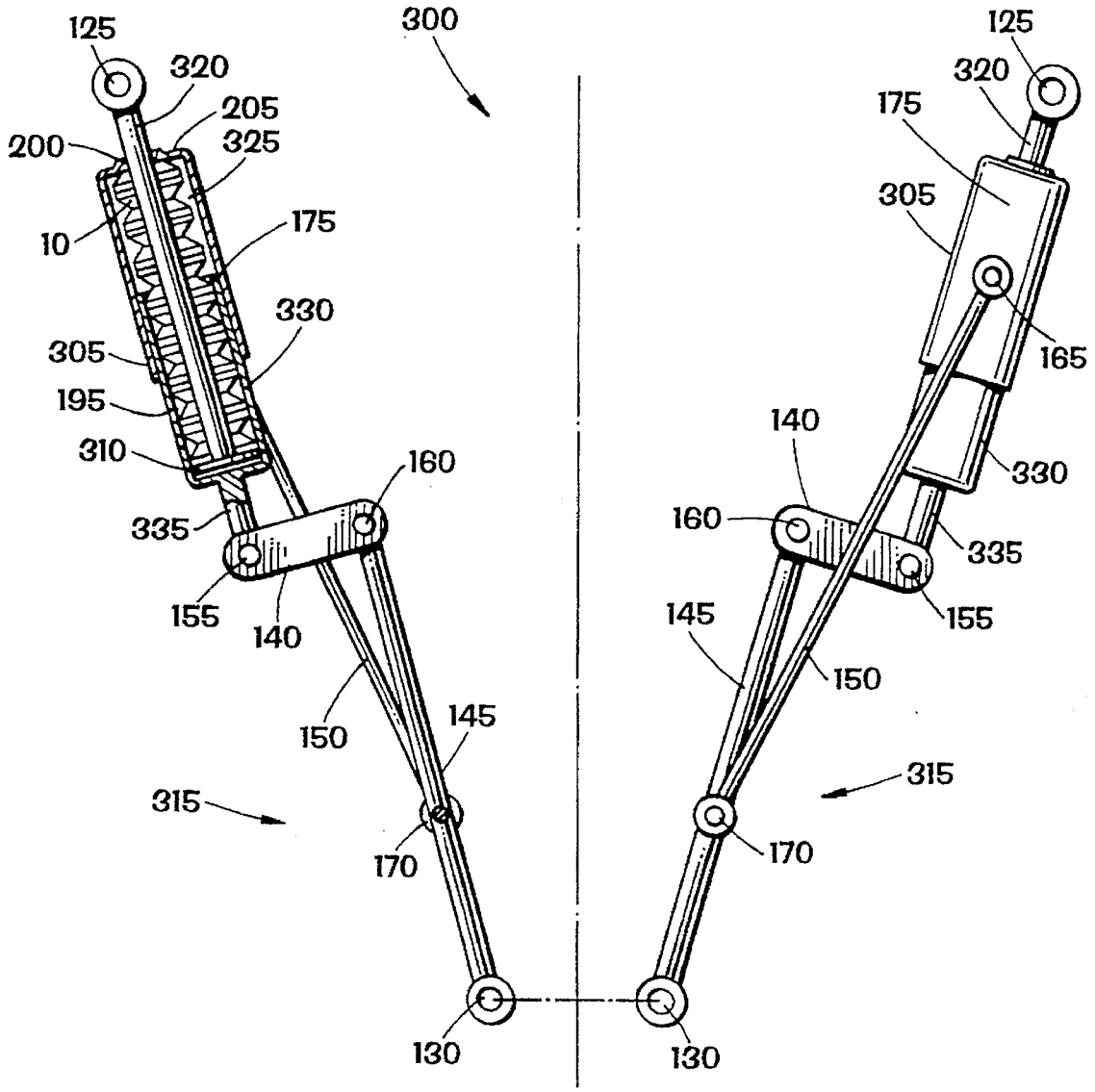
FIG. 15 illustrates a partial cross-sectional view of a pair of opposing tensioner assemblies in another embodiment of a riser tensioner system including a plurality of tensioner assemblies each including an upper member providing a tensioning force and having a columnar stack of compression elements.

Turning to FIG. 15, another embodiment of a riser tensioner system 300 will now be described. The riser tensioner system 300 is identical in form and function to the embodiment previously described with reference to FIGS. 12 to 14 except that an upper member 305 utilizes a piston 310 for further compressing the columnar stack of compression elements 10 during vertical extension of the tensioner assembly 315 and also permitting increased relative vertical displacement between the riser 105 and platform 110. In particular, the upper member 305 includes a piston 310 and a central shaft 320 integral to the piston 310. The piston 310 is positioned within a chamber 325 defined by the interiors of inner and outer canisters, 330 and 175 respectively, with the central shaft 320 extending from the piston 310 and passing through the aperture 200 in the end portion 205 of the outer canister 175. The columnar stack of compression elements 10 is seated upon the piston 310 with the central shaft 320 passing through the central apertures 15 of the compression elements 10. The central shaft 320 is further pivotally connected to the platform 110 by the pinned connection 125. The support shaft 335 of the inner canister 330 is pivotally connected to the connecting member 140 by the pinned connection 160.

During vertical extension of the tensioner assembly 215, the end portion 205 of the outer canister 175 compresses the columnar stack of compression elements 10 by virtue of the linkage of the tensioner assembly 315 provided by the combination of the upper member 305, lower member 145, connecting member 140, and intermediate members 150. Furthermore, the piston 310 also compresses the columnar stack of compression elements 10 during vertical extension of the tensioner assembly 315 by virtue of the pinned connection 125 of the central shaft 320 to the platform 110. The compression of the compression elements 10 in turn provides a reaction force opposing vertical extension of the tensioner assembly 315 which provides the tensioning force to the riser 105.

Figure 16:
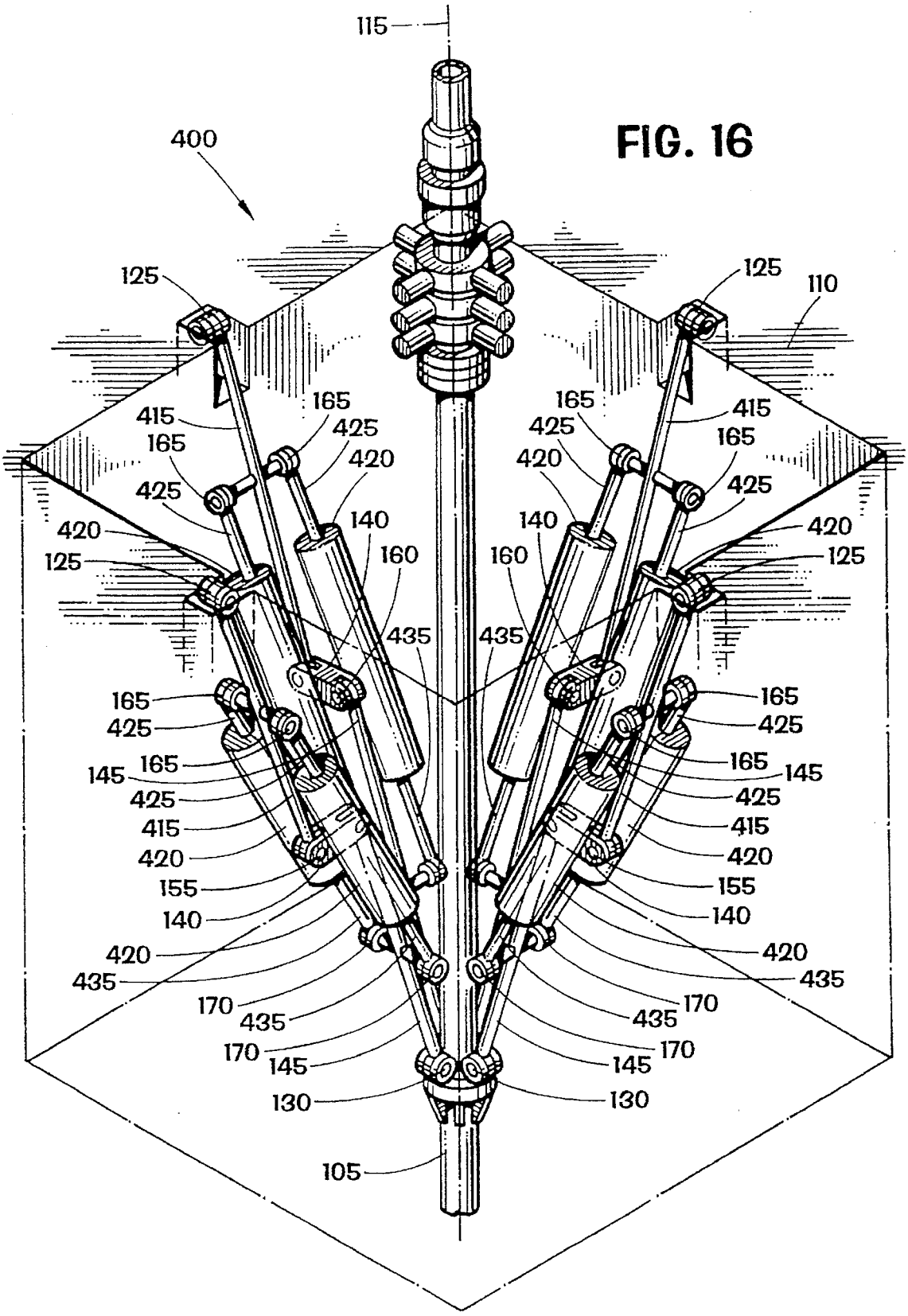
FIG. 16 illustrates a perspective view of another embodiment of a riser tensioner system including a plurality of tensioner assemblies each including intermediate members providing a tensioning force and having a columnar stack of compression elements.
Figure 17:
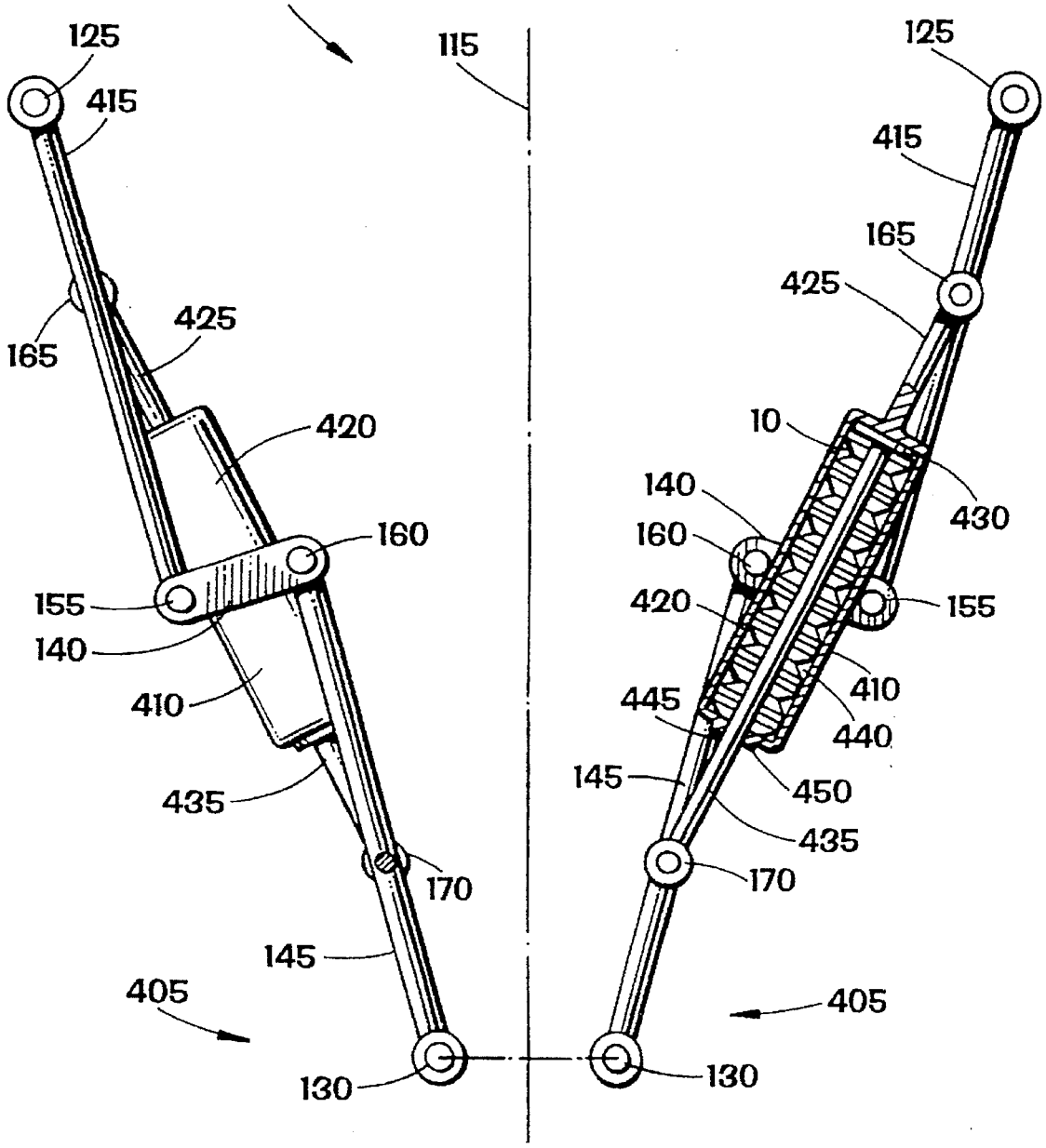
FIG. 17 illustrates a partial cross-sectional view of a pair of opposing tensioner assemblies of the embodiment illustrated in FIG. 16.

Turning to FIGS. 16 and 17, another preferred embodiment of a riser tensioner system 400 will now be described. In this embodiment, the tensioner assemblies 405 of the riser tensioner system 400 provide a tensioning force to the riser 105 by means of a columnar stack of compression elements 10 contained within each of the intermediate members 410 which are compressed during vertical extension of the tensioner assembly 405. The performance of this embodiment is very nearly equivalent to that provided by the previous embodiments that utilized a resilient upper member in combination with rigid connecting, intermediate, and lower members.

In this embodiment, a rigid upper member 415, rigid connecting member 140, and rigid lower member 145 of the tensioner assembly 305 provide the necessary linkage to enable compression of the compression elements 10 contained within the resilient intermediate members 410. In particular, each intermediate member 410 includes an outer canister 420, a support shaft 425 integral to the outer canister 420, a first piston 430, and a first central shaft 435 integral to the first piston 430. The support shaft 425 extends from the outer canister 420 and is pivotally connected to the upper member 415 by the pinned connection 165. The first central shaft 435 extends from the first piston 430, positioned within a chamber 440 defined by the interior of the outer canister 420, and passes through a centrally positioned aperture 445 in a first end portion 450 of the outer canister 420, and is pivotally connected to the lower member 145 by the pinned connection 170. The chamber 440 defined by the interior of the outer canister 420 contains a columnar stack of compression elements 10 with the first central shaft 435 passing through the central apertures 15 of the compression elements 10.

During vertical extension of the tensioner assembly 405, the first piston 430 compresses the columnar stack of compression elements 10 against the first end portion 450 of the outer canister 420 by virtue of the linkage of the assembly 405 provided by the combination of the upper member 415, lower member 145, connecting member 140, and intermediate members 410. The compression of the compression elements 10 in turn provides a reaction force opposing vertical extension of the tensioner assembly 405 which provides the tensioning force to the riser 105.

Figure 18:
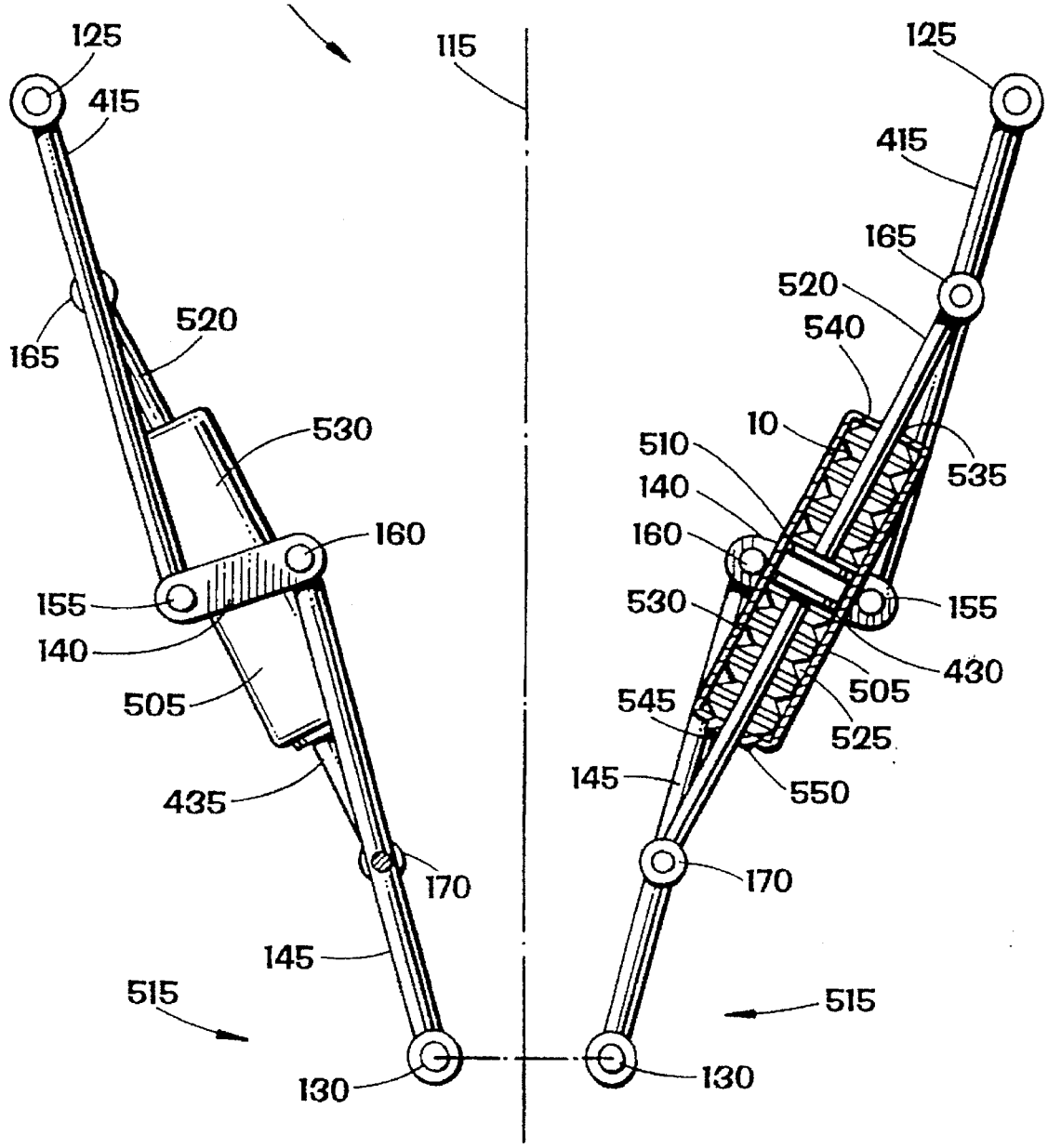
FIG. 18 illustrates a partial cross-sectional view of a pair of opposing tensioner assemblies in another embodiment of a riser tensioner system including a plurality of tensioner assemblies each including intermediate members providing a tensioning force and having a columnar stack of compression elements.

Turning to FIG. 18, another embodiment of a riser tensioner system 500 will now be described. The riser tensioner system 500 is identical in form and function to the embodiment previously described with reference to FIGS. 16 and 17 except that the intermediate member 505 utilizes a second piston 510 for compressing an upper portion of the columnar stack of compression elements 10 while the first piston 430 compresses a lower portion of the columnar stack of compression elements 10 during vertical extension of the tensioner assembly 515. In particular, the intermediate member 505 includes a second piston 510 and a second central shaft 520 integral to the second piston 510. The second central shaft 520 extends from the second piston 510, positioned within a chamber 525 defined by the interior of an outer canister 530, and passes through a centrally positioned aperture 535 in a second end portion 540 of the outer canister 530, and is pivotally connected to the upper member 415 by the pinned connection 165. The first central shaft 435, integral to the first piston 430, extends from the first piston 430 and passes through a centrally positioned aperture 545 in a first end portion 550 of the outer canister 530, and is pivotally connected to the lower member 145 by the pinned connection 170.

During vertical extension of the tensioner assembly 415, the first and second pistons 430 and 510 compress the columnar stack of compression elements 10 against the first and second end portions, 550 and 540 respectively, of the outer canister 530 by virtue of the linkage of the tensioner assembly 515 provided by the combination of the upper member 415, lower member 145, connecting member 140, and intermediate members 505. The compression of the compression elements 10 in turn provides a reaction force opposing vertical extension of the tensioner assembly 515 which provides the tensioning force to the riser 105.

Figure 19:
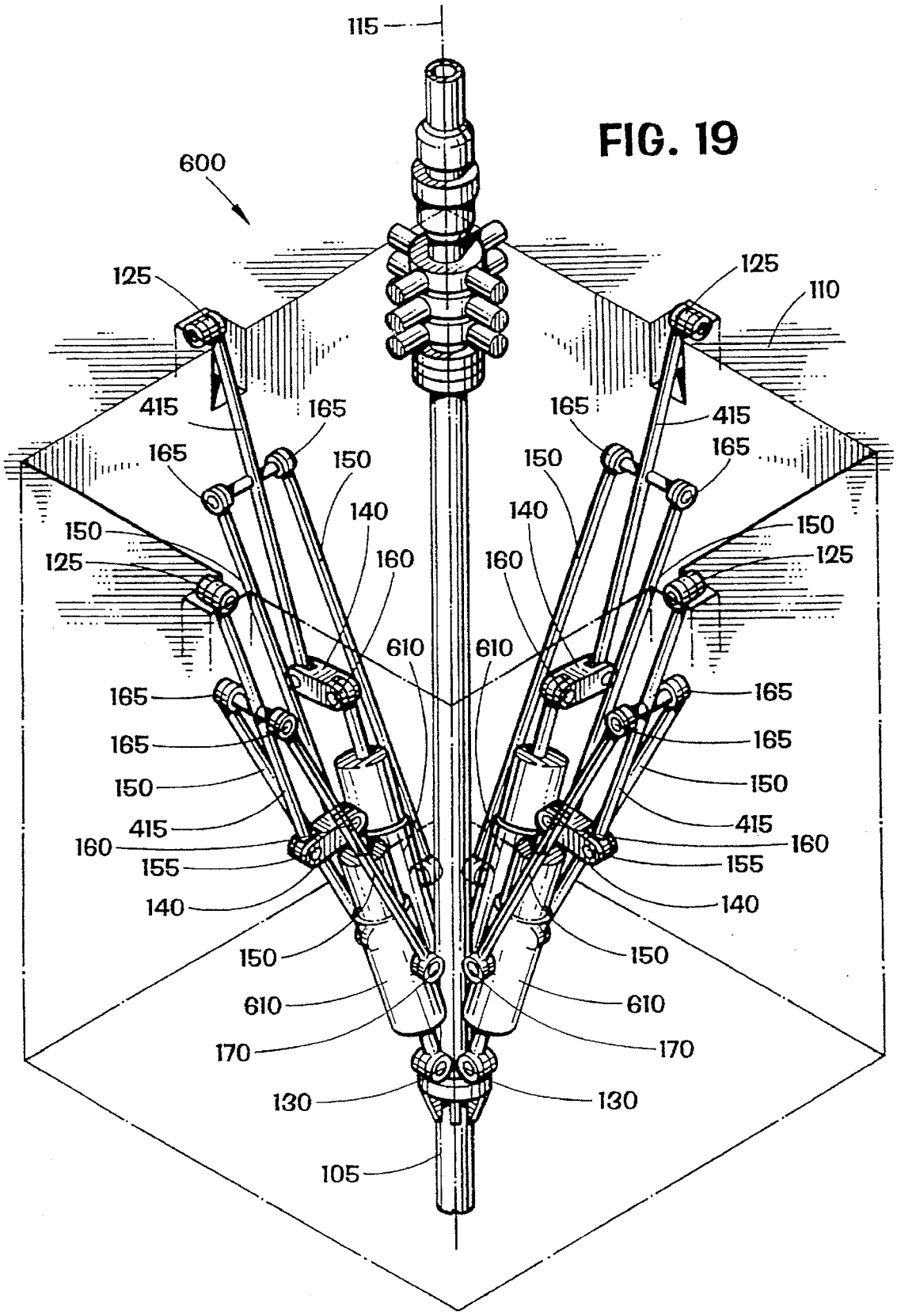
FIG. 19 illustrates a perspective view of another embodiment of a riser tensioner system including a plurality of tensioner assemblies each including a lower member providing a tensioning force and having a columnar stack of compression elements.
Figure 20:
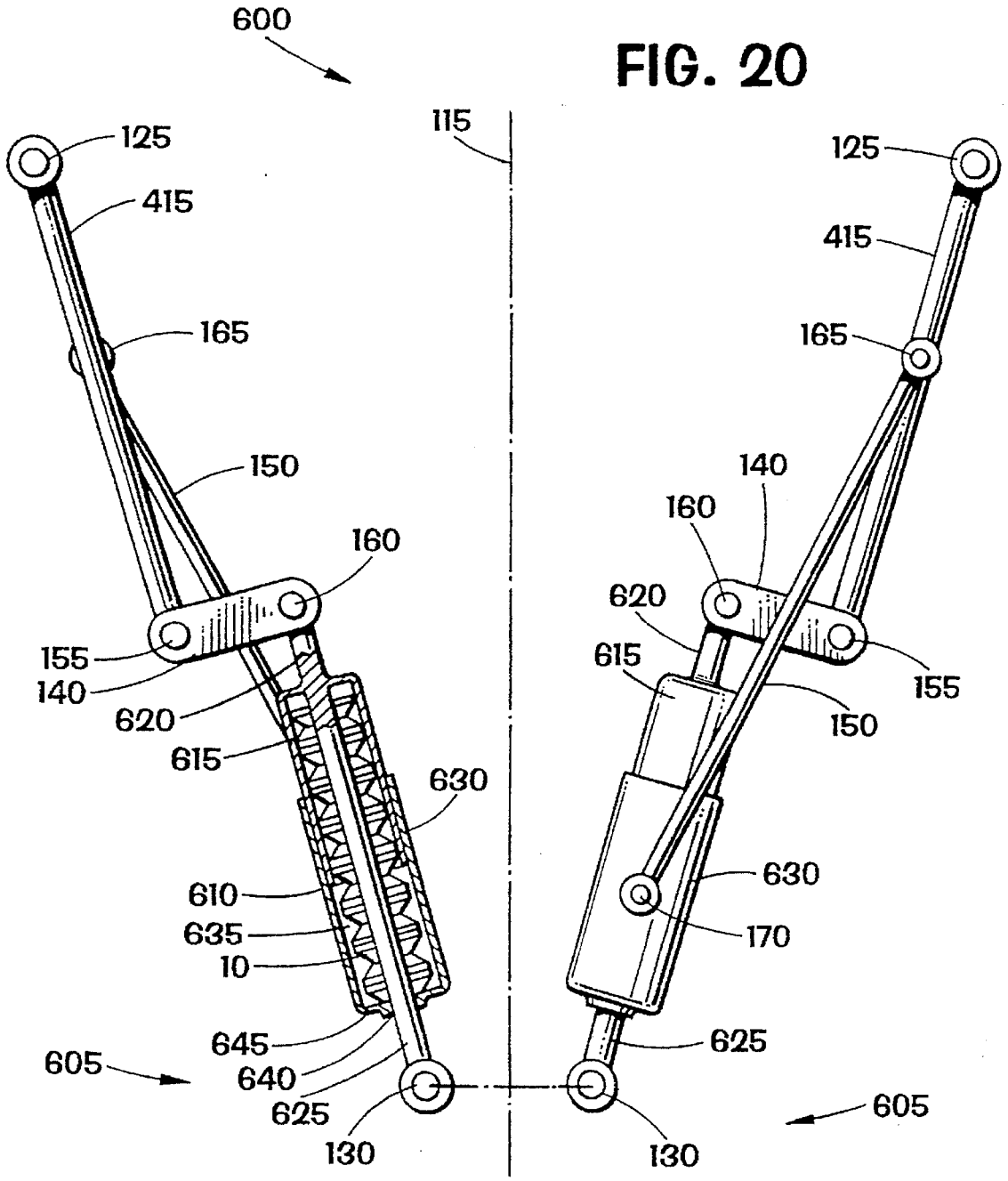
FIG. 20 illustrates a partial cross-sectional view of a pair of opposing tensioner assemblies of the embodiment illustrated in FIG. 19.

Turning to FIGS. 19 and 20, another preferred embodiment of a riser tensioner system 600 will now be described. In this embodiment, the tensioner assemblies 605 of the riser tensioner system 600 provide a tensioning force to the riser 105 by means of a columnar stack of compression elements 10 contained within a lower member 610 which are compressed during vertical extension of the tensioner assembly 605. The performance of this embodiment is very nearly equivalent to that provided by the previous embodiments that utilized either a resilient upper member or intermediate members in combination with rigid connecting, intermediate, and lower members or rigid upper, lower, and connecting members respectively.

In this embodiment, the rigid upper member 415, rigid connecting member 140, and rigid intermediate members 150 of the tensioner assembly 605 provide the necessary linkage to enable compression of the compression elements 10 contained within the resilient lower member 610. In particular, the lower member 610 includes an inner canister 615, a support shaft 620 integral to the inner canister 615, a central shaft 625 integral to the inner canister 615, and an outer canister 630. The support shaft 620 extends from the inner canister 615 and is pivotally connected to the connecting member 140 by the pinned connection 160. The central shaft 625 extends from the inner canister 615, passes through a chamber 635 defined by the interiors of the inner and outer canisters, 615 and 630 respectively, and passes through a centrally positioned aperture 640 in an end portion 645 of the outer canister 630, and is pivotally connected to the riser 105 by the pinned connection 130. The chamber 635 defined by the interiors of the inner and outer canisters, 615 and 630 respectively, contains a columnar stack of compression elements 10 with the central shaft 625 passing through the central apertures 15 of the compression elements 10.

During vertical extension of the tensioner assembly 605, the end portion 645 of the outer canister 630 compresses the columnar stack of compression elements 10 by virtue of the linkage of the assembly 605 provided by the combination of the upper member 415, lower member 610, connecting member 140, and intermediate members 150. The compression of the compression elements 10 in turn provides a reaction force opposing vertical extension of the tensioner assembly 605 which provides the tensioning force to the riser 105.

Figure 21:
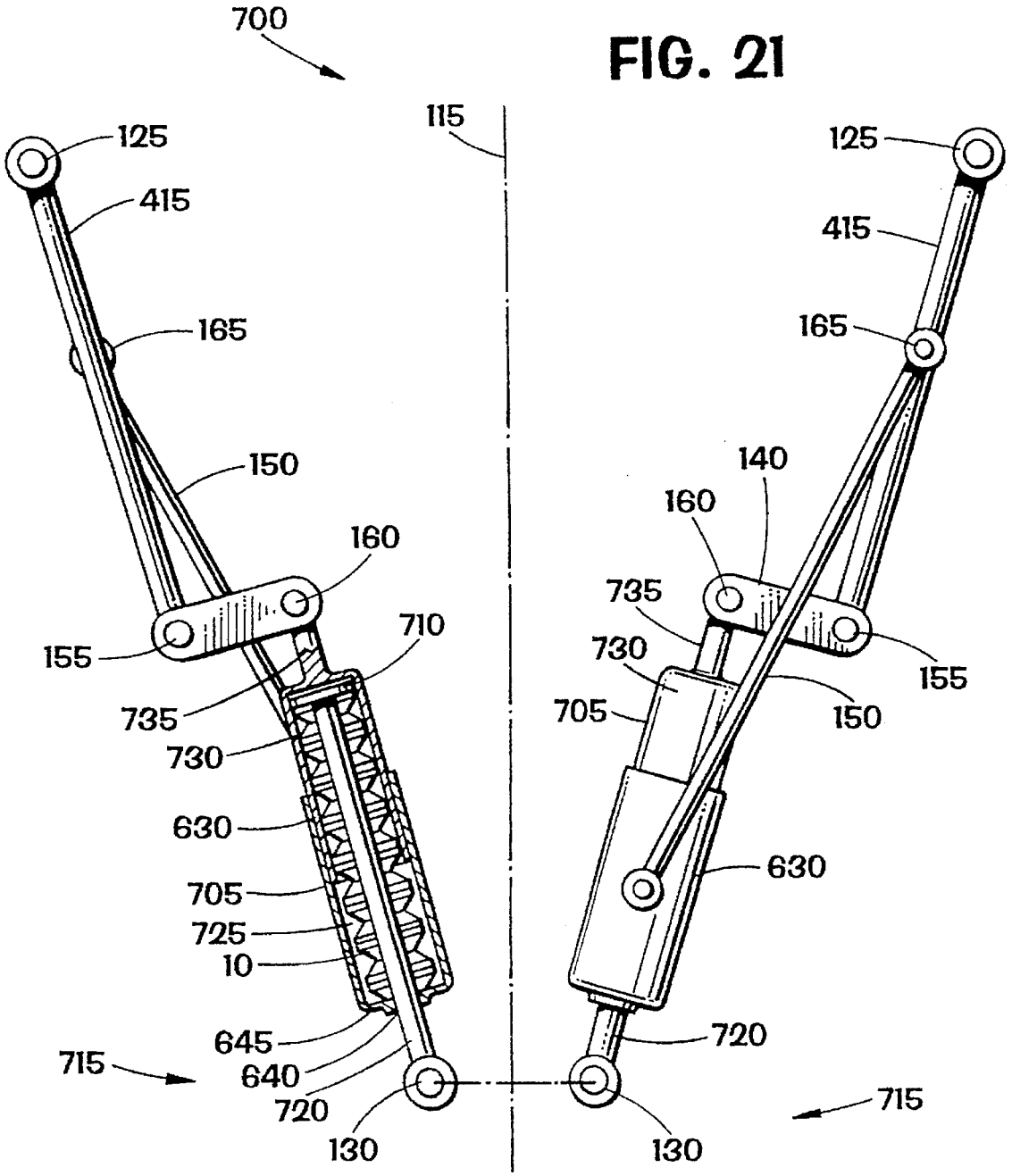
FIG. 21 illustrates a partial cross-sectional view of a pair of opposing tensioner assemblies in another embodiment of a riser tensioner system including a plurality of tensioner assemblies each including a lower member providing a tensioning force and having a columnar stack of compression elements.

Turning to FIG. 21, another embodiment of a riser tensioner system 700 will now be described. The riser tensioner system 700 is identical in form and function to the embodiment previously described with reference to FIGS. 19 and 20 except that the lower member 705 is modified to utilize a piston 710 for further compressing the columnar stack of compression elements 10 during vertical extension of the tensioner assembly 715 and also permitting increased relative vertical displacement between the riser 105 and platform 110. In particular, the lower member 705 now includes a piston 710 and a central shaft 720 integral to the piston 710. The piston 710 is positioned within a chamber 725 defined by the interiors of the inner and outer canisters, 730 and 630 respectively, with the central shaft 720 extending from the piston 710 and passing through the aperture 640 in the end portion 645 of the outer canister 630. The columnar stack of compression elements 10 is seated upon the piston 710 with the central shaft 720 passing through the central apertures 15 of the compression elements 10. The central shaft 720 is further pivotally connected to the riser 105 by the pinned connection 130. The support shaft 735 of the inner canister 730 is pivotally connected to the connecting member 140 by the pinned connection 160.

During vertical extension of the tensioner assembly 505, the end portion 645 of the outer canister 630 compresses the columnar stack of compression elements 10 by virtue of the linkage of the tensioner assembly 715 provided by the combination of the upper member 415, lower member 705, connecting member 140, and intermediate members 150. Furthermore, the piston 710 also compresses the columnar stack of compression elements 10 during vertical extension of the tensioner assembly 715 by virtue of the pinned connection 130 of the central shaft 720 to the riser 105. The compression of the compression elements 10 in turn provides a reaction force opposing vertical extension of the tensioner assembly 715 which provides the tensioning force to the riser 105.

Further preferred embodiments of riser tensioner systems employ tensioner assemblies in which a plurality of members are adapted to provide a tensioning force to the riser 105 by the incorporation of columnar stacks of compression elements 10 into the upper and intermediate members, the upper and lower members, the intermediate and lower members, and finally into the upper, intermediate, and lower members. The addition of additional members adapted to provide a tensioning force increases the tensioning force and also increases the damping effect of the compression elements upon vibrations within the overall structure of the system. The further preferred embodiments employ the basic building blocks employed in the embodiments previously discussed therefore throughout the remaining discussion of the remaining preferred embodiments those elements will be introduced with like reference numbers.

Figure 22:
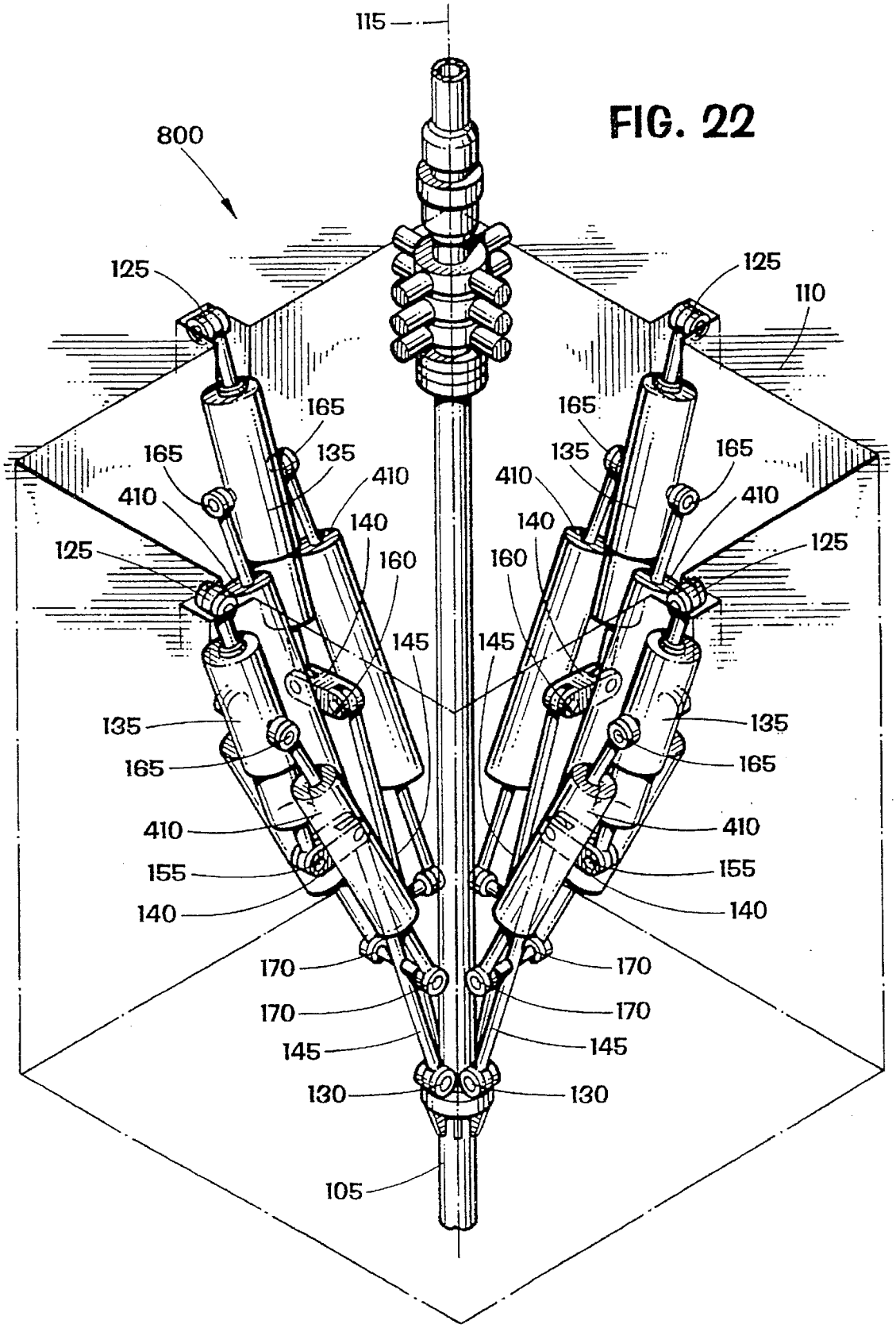
FIG. 22 illustrates a perspective view of another embodiment of a riser tensioner system including a plurality of tensioner assemblies each including an upper member and intermediate members providing a tensioning force and having columnar stacks of compression elements.
Figure 23:
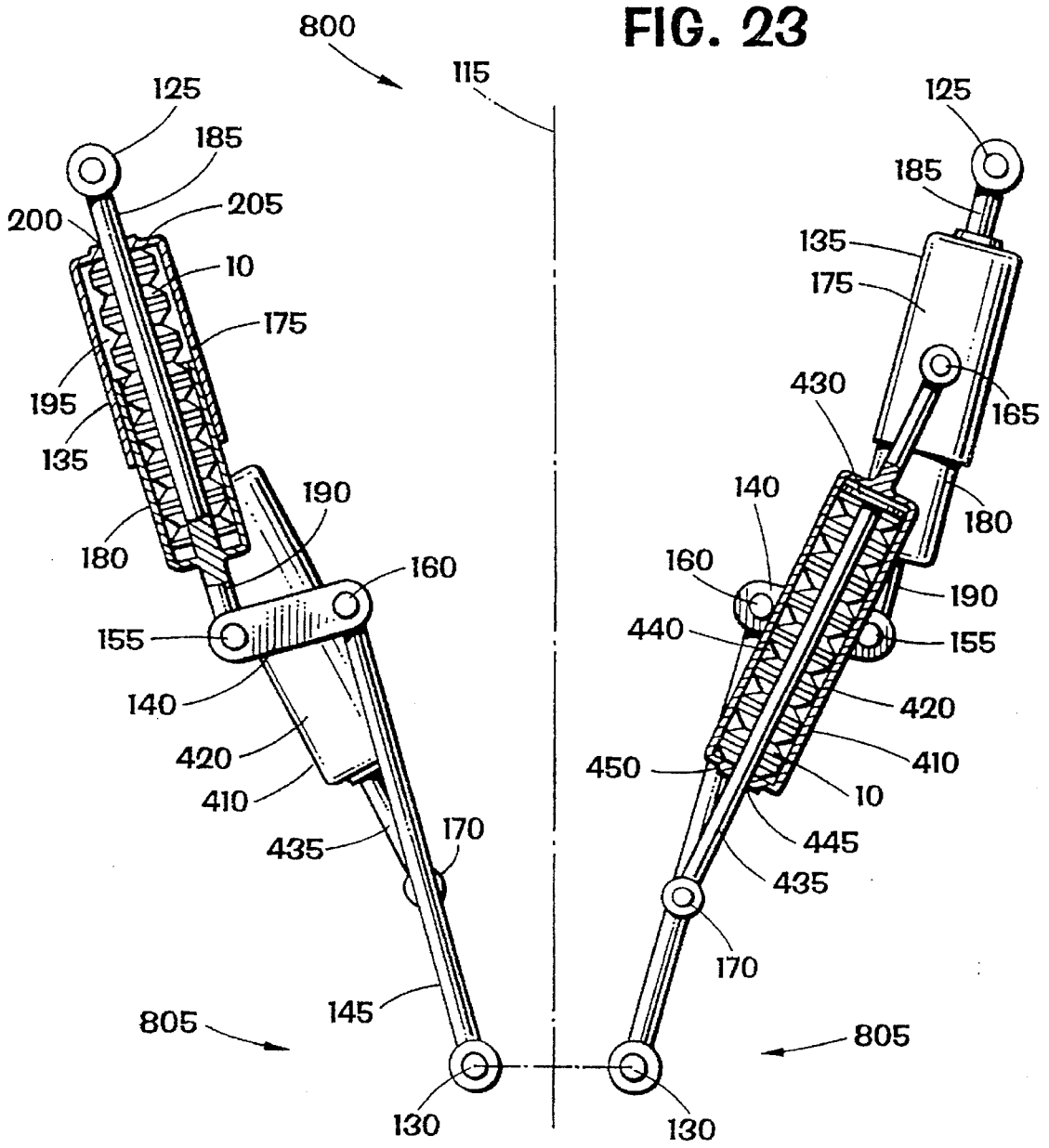
FIG. 23 illustrates a partial cross-sectional view of a pair of opposing tensioner assemblies of the embodiment illustrated in FIG. 22.

Turning to FIGS. 22 and 23, another preferred embodiment of a riser tensioner system 800 will now be described. In this embodiment, the tensioner assemblies 805 of the riser tensioner system 800 provide a tensioning force to the riser 105 by means of columnar stacks of compression elements 10 contained within the upper member and intermediate members which are compressed during vertical extension of the tensioner assembly 805. In particular, each tensioner assembly 805 includes a resilient upper member 135 and resilient intermediate members 410 in combination with a rigid connecting member 140 and a rigid lower member 145. The performance of this embodiment is superior to that provided by the previous embodiments that only utilized a single resilient member since the addition of another resilient member to the assembly provides additional tensioning force as well as additional damping of vibrations within the structure. In this embodiment, the connecting member 140 and lower member 145 of the tensioner assembly 805 are rigid members and thereby provide the necessary linkage to enable compression of the compression elements 10 contained within the resilient upper member 135 and intermediate members 410.

During vertical extension of the tensioner assembly 805, the end portion 205 of the outer canister 175 of the upper member 135 compresses the columnar stack of compression elements 10 within the upper member 135 and the first piston 430 compresses the columnar stack of compression elements 10 within the intermediate members 410 against the first end portion 450 of the outer canister 420 of the intermediate member 410 by virtue of the linkage of the assembly 805 provided by the combination of the upper member 135, lower member 145, connecting member 140, and intermediate members 410. The compression of the compression elements 10 in turn provides a reaction force opposing vertical extension of the tensioner assembly 805 which provides the tensioning force to the riser 105.

Figure 24:
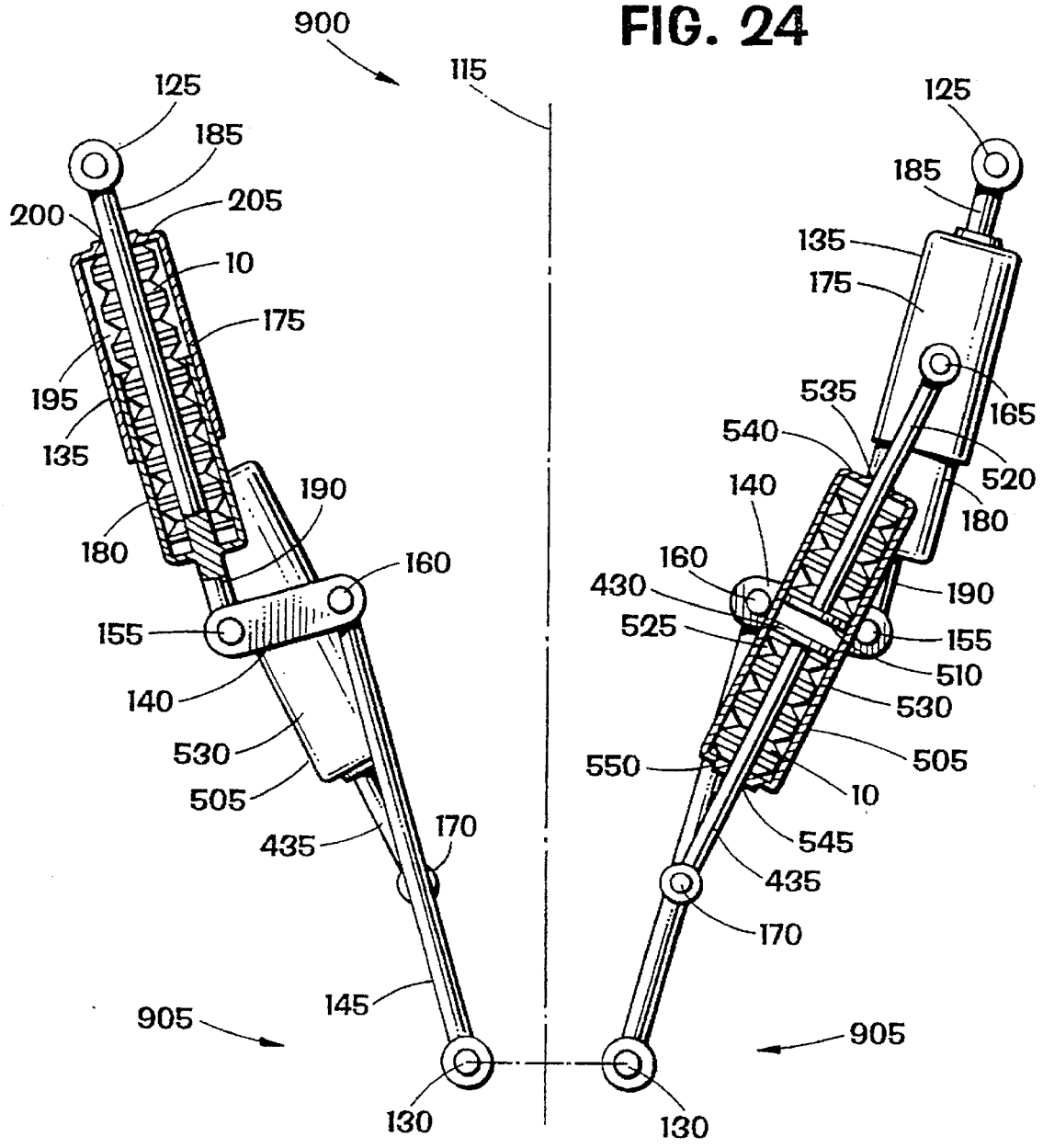
FIG. 24 illustrates a partial cross-sectional view of a pair of opposing tensioner assemblies in another embodiment of a riser tensioner system including a plurality of tensioner assemblies each including an upper member and intermediate members providing a tensioning force and having columnar stacks of compression elements.

Turning to FIG. 24, another embodiment of a riser tensioner system 900 will now be described. The riser tensioner system 900 is identical in form and function to the embodiment previously described with reference to FIGS. 22 and 23 except that the intermediate member is modified to utilize a second piston for compressing an upper portion of the columnar stack of compression elements 10 within the intermediate member while the first piston compresses a lower portion of the columnar stack of compression elements 10 within the intermediate member during vertical extension of the tensioner assembly 905. In particular, each tensioner assembly 905 includes a resilient upper member 135 and resilient intermediate members 505 in combination with a rigid connecting member 140 and a rigid lower member 145.

During vertical extension of the tensioner assembly 905, the first and second pistons, 430 and 510 respectively, compress the columnar stack of compression elements 10 within the intermediate member 505 against the first and second end portions, 550 and 540 respectively, of the outer canister 530 of the intermediate member 505 and the end portion 205 of the outer canister 175 of the upper member 135 compresses the columnar stack of compression elements 10 within the upper member 135 by virtue of the linkage of the tensioner assembly 905 provided by the combination of the upper member 135, lower member 145, connecting member 140, and intermediate members 505. The compression of the compression elements 10 in turn provides a reaction force opposing vertical extension of the tensioner assembly 905 which provides the tensioning force to the riser 105.

Figure 25:
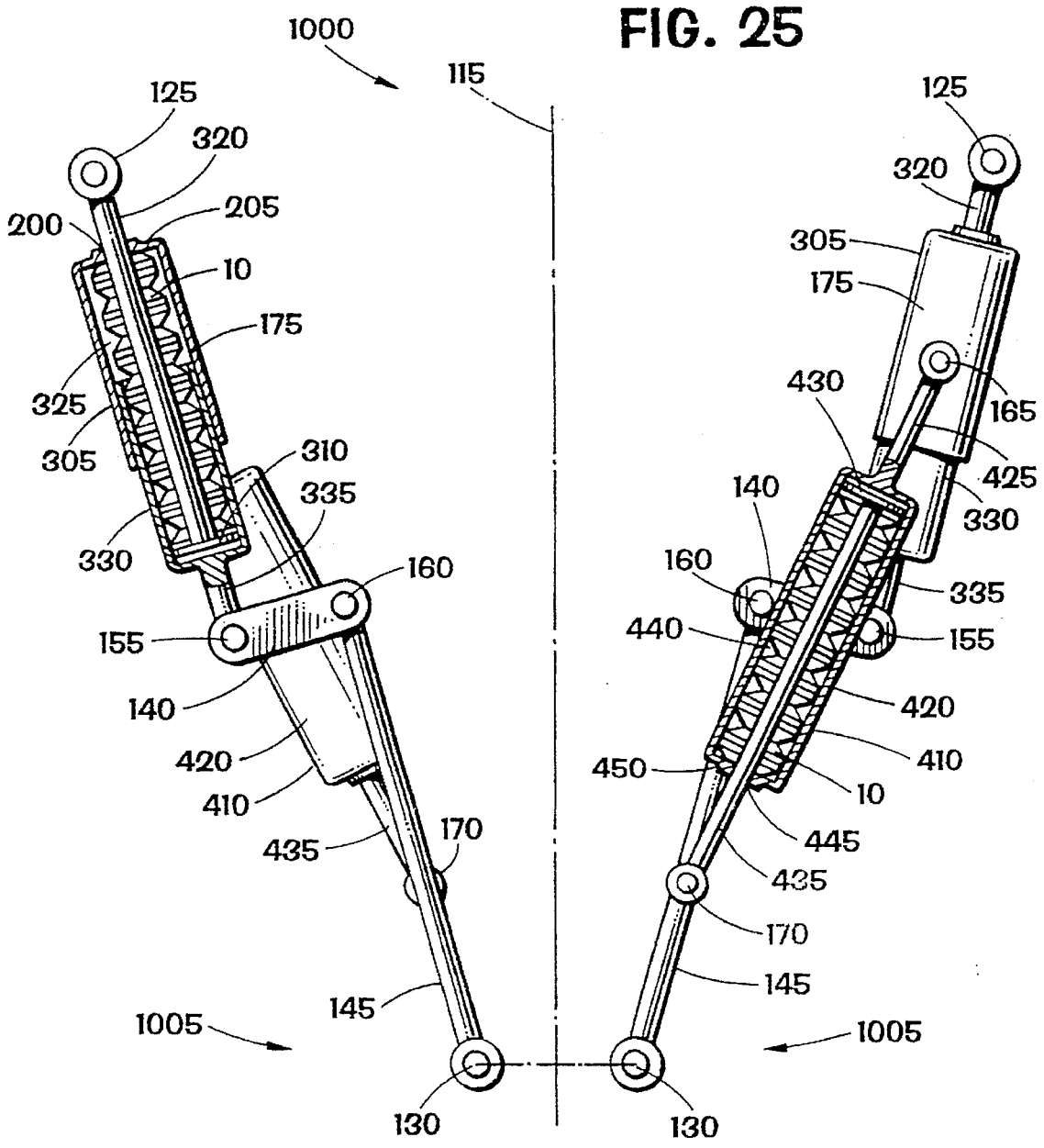
FIG. 25 illustrates a partial cross-sectional view of a pair of opposing tensioner assemblies in yet another embodiment of a riser tensioner system including a plurality of tensioner assemblies each including an upper member and intermediate members providing a tensioning force and having columnar stacks of compression elements.

Turning to FIG. 25, another embodiment of a riser tensioner system 1000 will now be described. The riser tensioner system 1000 is identical in form and function to the embodiment previously described with reference to FIGS. 22 and 23 except that the upper member is modified to utilize a piston for further compressing the columnar stack of compression elements 10 during vertical extension of the tensioner assembly 1005 and also permitting increased relative vertical displacement between the riser 105 and platform 110. In particular, each tensioner assembly 1005 includes a resilient upper member 305 and resilient intermediate members 410 in combination with a rigid connecting member 140 and a rigid lower member 145.

During vertical extension of the tensioner assembly 1005, the end portion 205 of the outer canister 175 of the upper member 305 compresses the columnar stack of compression elements 10 within the upper member 305 and the first piston 430 compresses the columnar stack of compression elements 10 within the intermediate member 410 against the first end portion 450 of the outer canister 420 of the intermediate member 410 by virtue of the linkage of the tensioner assembly 1005 provided by the combination of the upper member 135, lower member 145, connecting member 140, and intermediate members 410. Furthermore, the piston 310 within the upper member 305 also compresses the columnar stack of compression elements 10 during vertical extension of the tensioner assembly 1005 by virtue of the pinned connection 125 of the central shaft 320 to the platform 110. The compression of the compression elements 10 in turn provides a reaction force opposing vertical extension of the tensioner assembly 1005 which provides the tensioning force to the riser 105.

Figure 26:
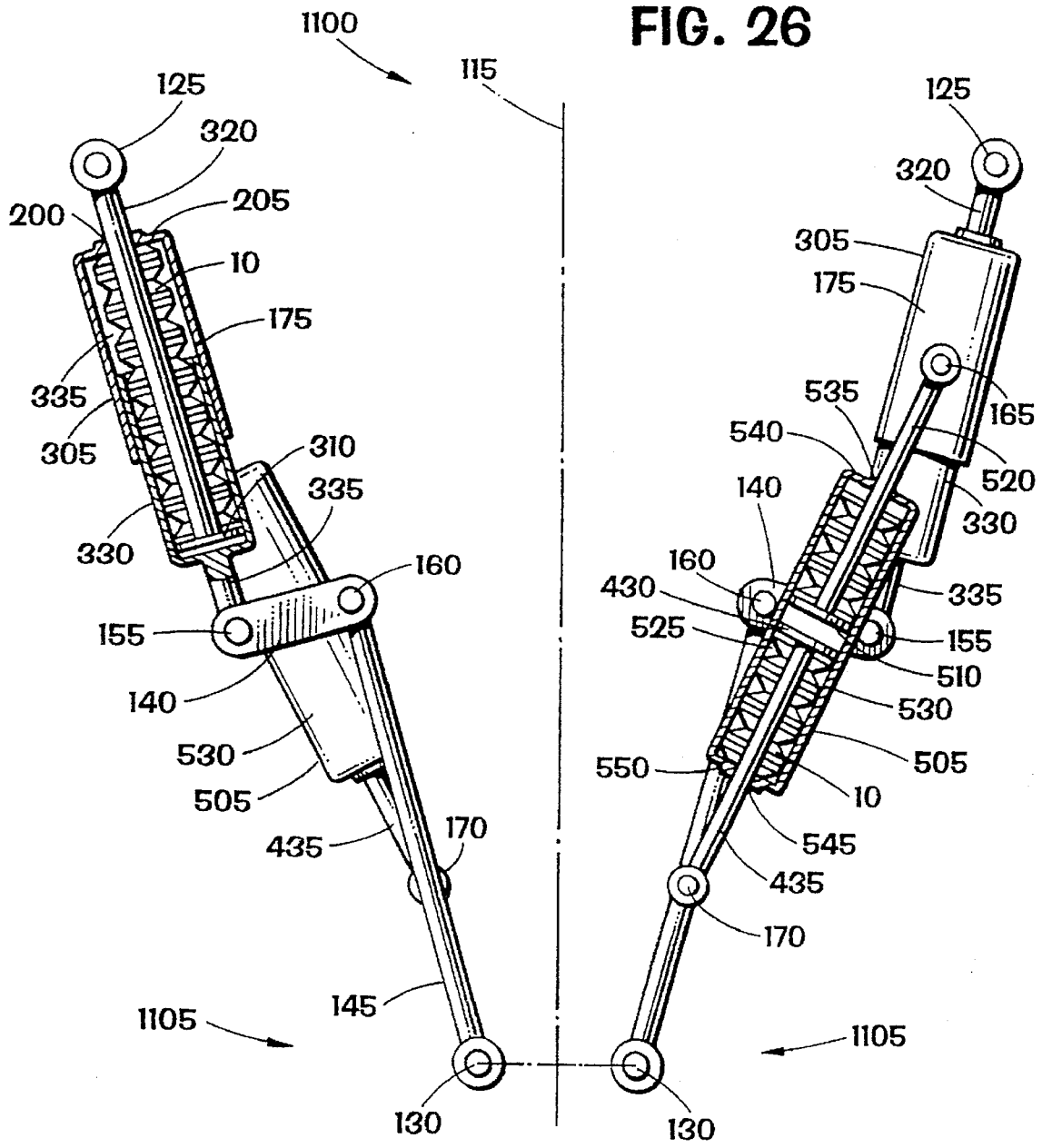
FIG. 26 illustrates a partial cross-sectional view of a pair of opposing tensioner assemblies in another embodiment of a riser tensioner system including a plurality of tensioner assemblies each including an upper member and intermediate members providing a tensioning force and having columnar stacks of compression elements.

Turning to FIG. 26, another embodiment of a riser tensioner system 1100 will now be described. The riser tensioner system 1100 is identical in form and function to the embodiment previously described with reference to FIG. 24 except that the upper member is modified to utilize a piston for further compressing the columnar stack of compression elements 10 during vertical extension of the tensioner assembly 1105 and also permitting increased relative vertical displacement between the riser 105 and platform 110. In particular, each tensioner assembly 1105 includes a resilient upper member 305 and resilient intermediate members 505 in combination with a rigid connecting member 140 and a rigid lower member 145.

During vertical extension of the tensioner assembly 1105, the first and second pistons, 430 and 510 respectively, compress the columnar stack of compression elements 10 within the intermediate member 505 against the first and second end portions, 550 and 540 respectively, of the outer canister 530 of the intermediate member 505 and the end portion 205 of the outer canister 175 of the upper member 305 compresses the columnar stack of compression elements 10 within the upper member 305 by virtue of the linkage of the tensioner assembly 1105 provided by the combination of the upper member 305, lower member 145, connecting member 140, and intermediate members 505. Furthermore, the piston 310 also compresses the columnar stack of compression elements 10 within the upper member 305 during vertical extension of the tensioner assembly 1105 by virtue of the pinned connection 125 of the central shaft 320 to the platform 110. The compression of the compression elements 10 in turn provides a reaction force opposing vertical extension of the tensioner assembly 1105 which provides the tensioning force to the riser 105.

Figure 27:
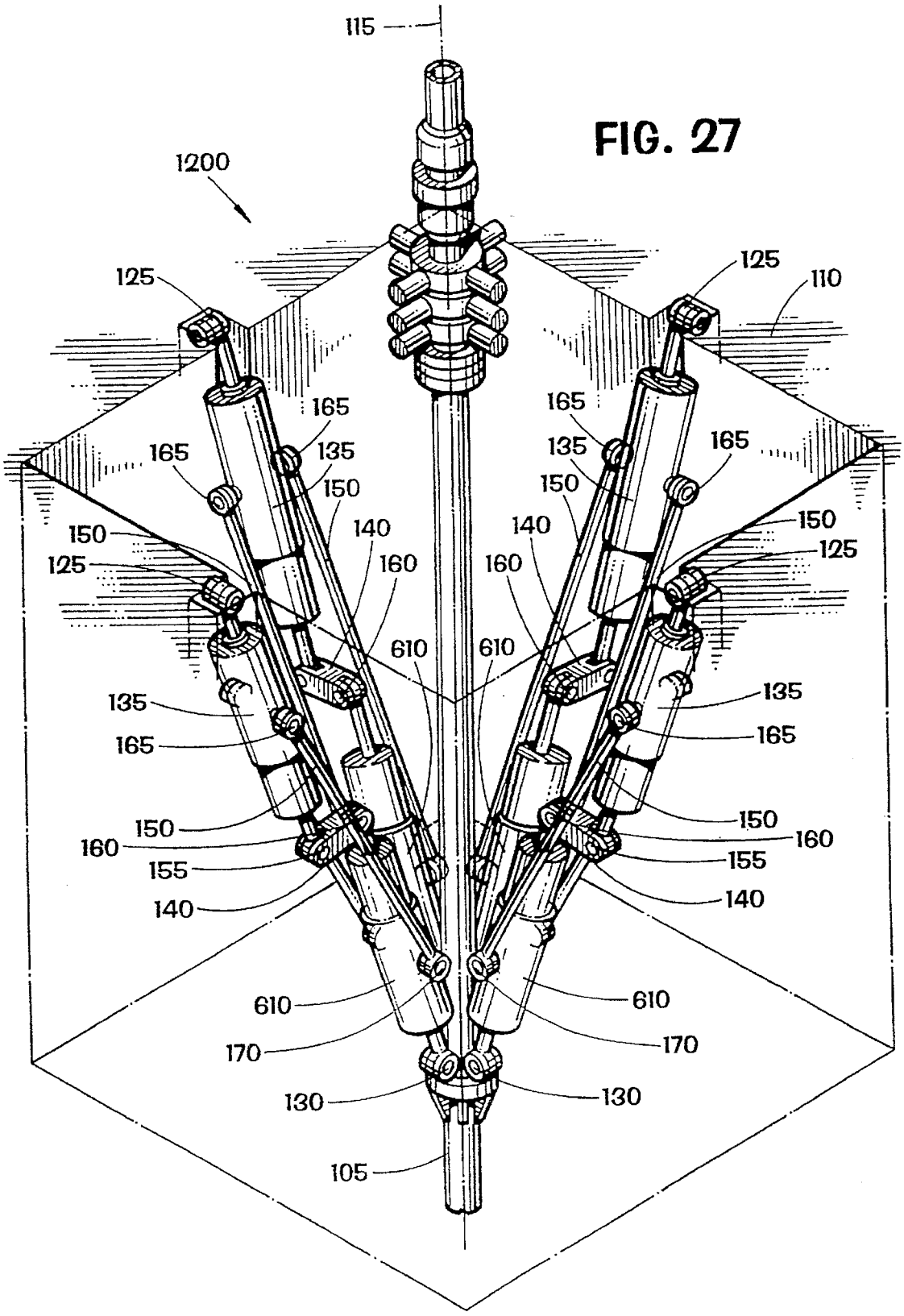
FIG. 27 illustrates a perspective view of another embodiment of a riser tensioner system including a plurality of tensioner assemblies each including an upper member and a lower member providing a tensioning force and having columnar stacks of compression elements.
Figure 28:
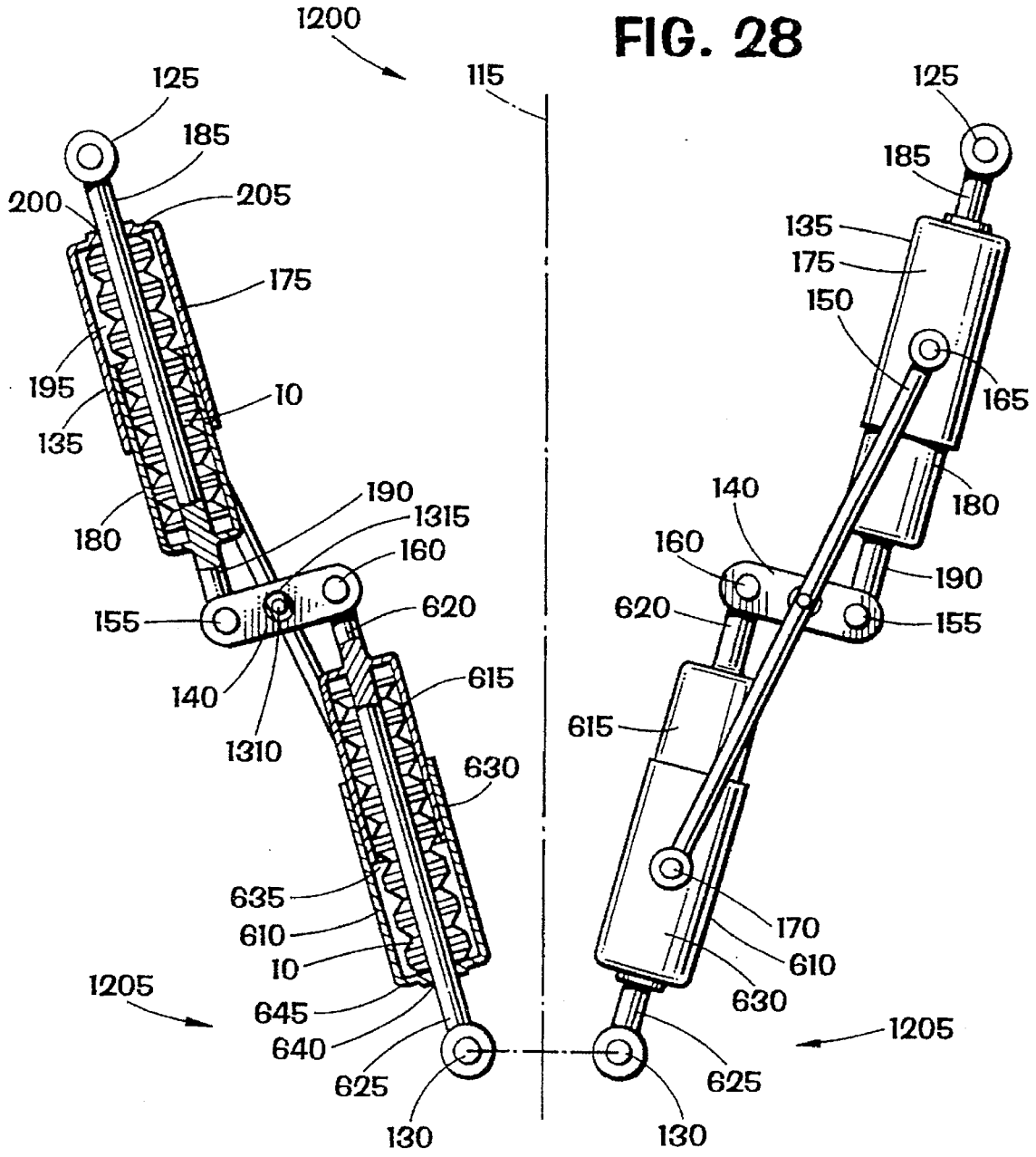
FIG. 28 illustrates a partial cross-sectional view of a pair of opposing tensioner assemblies of the embodiment illustrated in FIG. 27.

Turning to FIGS. 27 and 28, another preferred embodiment of a riser tensioner system 1200 will now be described. In this embodiment, the tensioner assemblies 1205 of the riser tensioner system 1200 provide a tensioning force to the riser 105 by means of columnar stacks of compression elements 10 contained within both the upper member and the lower member which are compressed during vertical extension of the tensioner assembly 1205. The performance of this embodiment is very nearly equivalent to that provided by the previous embodiments that utilized a pair of resilient members. In particular, each tensioner assembly 1205 includes a resilient upper member 135 and a resilient lower member 610 in combination with a rigid connecting member 140 and a rigid intermediate member 150. In this embodiment, the connecting member 140 and the intermediate members 150 of the tensioner assembly 1205 are rigid members and thereby provide the necessary linkage to enable compression of the compression elements 10 contained within the resilient upper and lower members, 135 and 610 respectively.

During vertical extension of the tensioner assembly 1205, the end portion 205 of the outer canister 175 of the upper member 135 compresses the columnar stack of compression elements 10 within the upper member 135 and the end portion 645 of the outer canister 630 of the lower member 610 compresses the columnar stack of compression elements 10 within the lower member 610 by virtue of the linkage of the assembly 1205 provided by the combination of the upper member 135, lower member 145, connecting member 140, and intermediate members 610. The compression of the compression elements 10 in turn provides a reaction force opposing vertical extension of the tensioner assembly 1205 which provides the tensioning force to the riser 105.

Figure 29:
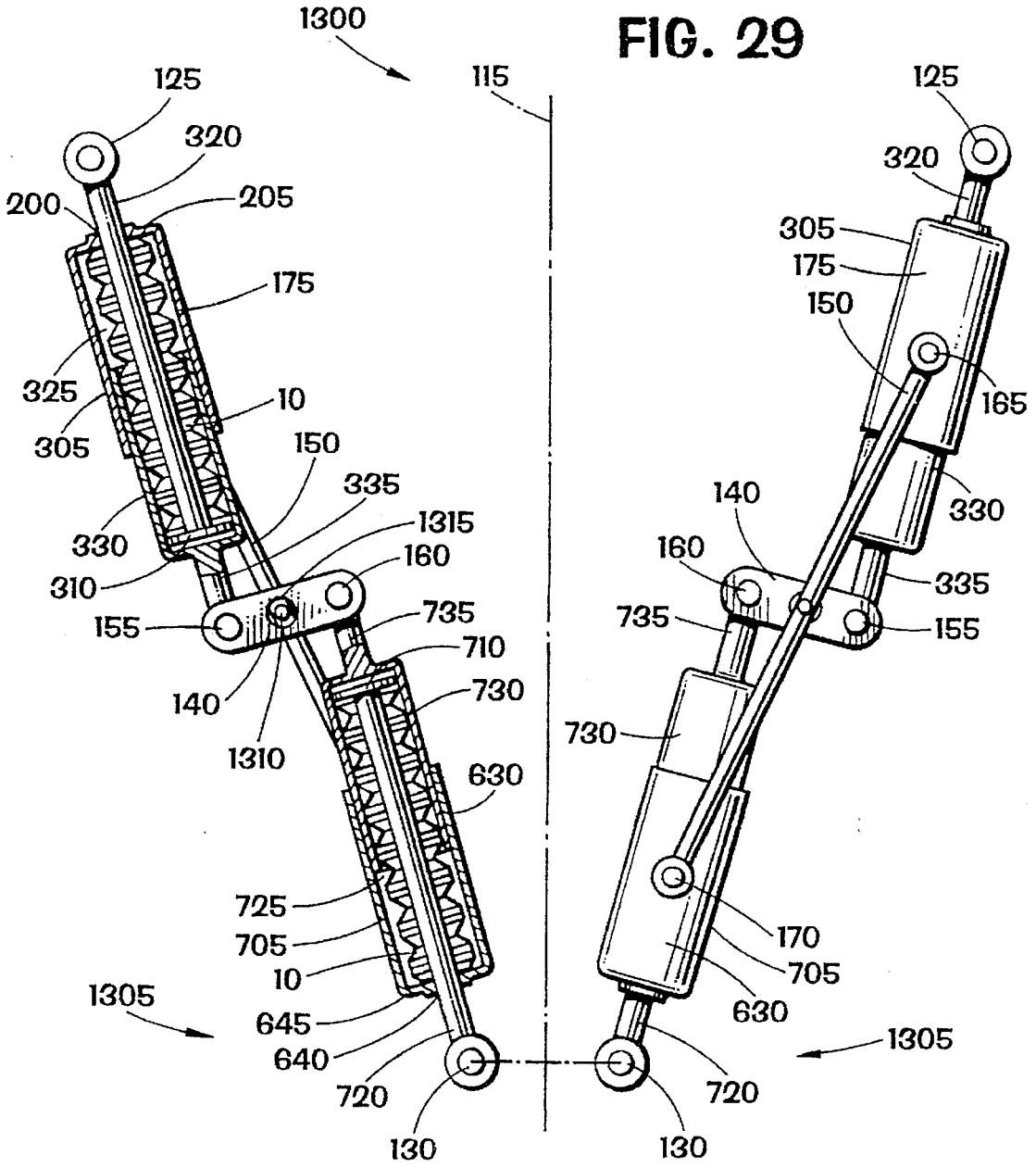
FIG. 29 illustrates a partial cross-sectional view of a pair of opposing tensioner assemblies in another embodiment of a riser tensioner system including a plurality of tensioner assemblies each including an upper member and a lower member providing a tensioning force and having columnar stacks of compression elements.

Turning to FIG. 29, another embodiment of a riser tensioner system 1300 will now be described. The riser tensioner system 1300 is identical in form and function to the embodiment previously described with reference to FIGS. 27 and 28 except that the upper member and lower member are modified to utilize pistons for further compressing the columnar stacks of compression elements 10 during vertical extension of the tensioner assembly 1305 and also permitting increased relative vertical displacement between the riser 105 and platform 110. In particular, each tensioner assembly 1305 includes a resilient upper member 305 and a resilient lower member 705 in combination with a rigid connecting member 140 and a rigid intermediate members 150. In this embodiment, the connecting member 140 and the intermediate members 150 of the tensioner assembly 1305 are rigid members and thereby provide the necessary linkage to enable compression of the compression elements 10 contained within the resilient upper and lower members, 305 and 705 respectively.

During vertical extension of the tensioner assembly 1305, the end portion 205 of the outer canister 175 of the upper member 305 compresses the columnar stack of compression elements 10 within the upper member 305 and the end portion 645 of the outer canister 630 of the lower member 705 compresses the columnar stack of compression elements 10 within the lower member 705 by virtue of the linkage of the tensioner assembly 1305 provided by the combination of the upper member 305, lower member 705, connecting member 140, and intermediate members 150. Furthermore, the pistons 310 and 710 also compress the columnar stacks of compression elements 10 within the upper and lower members, 305 and 705 respectively, during vertical extension of the tensioner assembly 1305 by virtue of the pinned connection 125 of the central shaft 320 to the platform 110 and the pinned connection 130 of the central shaft 720 to the riser 105. The compression of the compression elements 10 in turn provides a reaction force opposing vertical extension of the tensioner assembly 1305 which provides the tensioning force to the riser 105.

In order to provide added stability to the riser tensioners illustrated in FIGS. 27–29, a transverse support rod 1310 is preferably added to provide support to the connecting member 140. The transverse support rod 1310 is rigidly attached to the intermediate members 150 and passes through an aperture 1315 provided at a center point of the connecting member 140. During rotation of the connecting member 140 about the centerline of the tensioner assemblies at the center point, the transverse support rod 1310 provides additional support to the connecting member 140.

Figure 30:
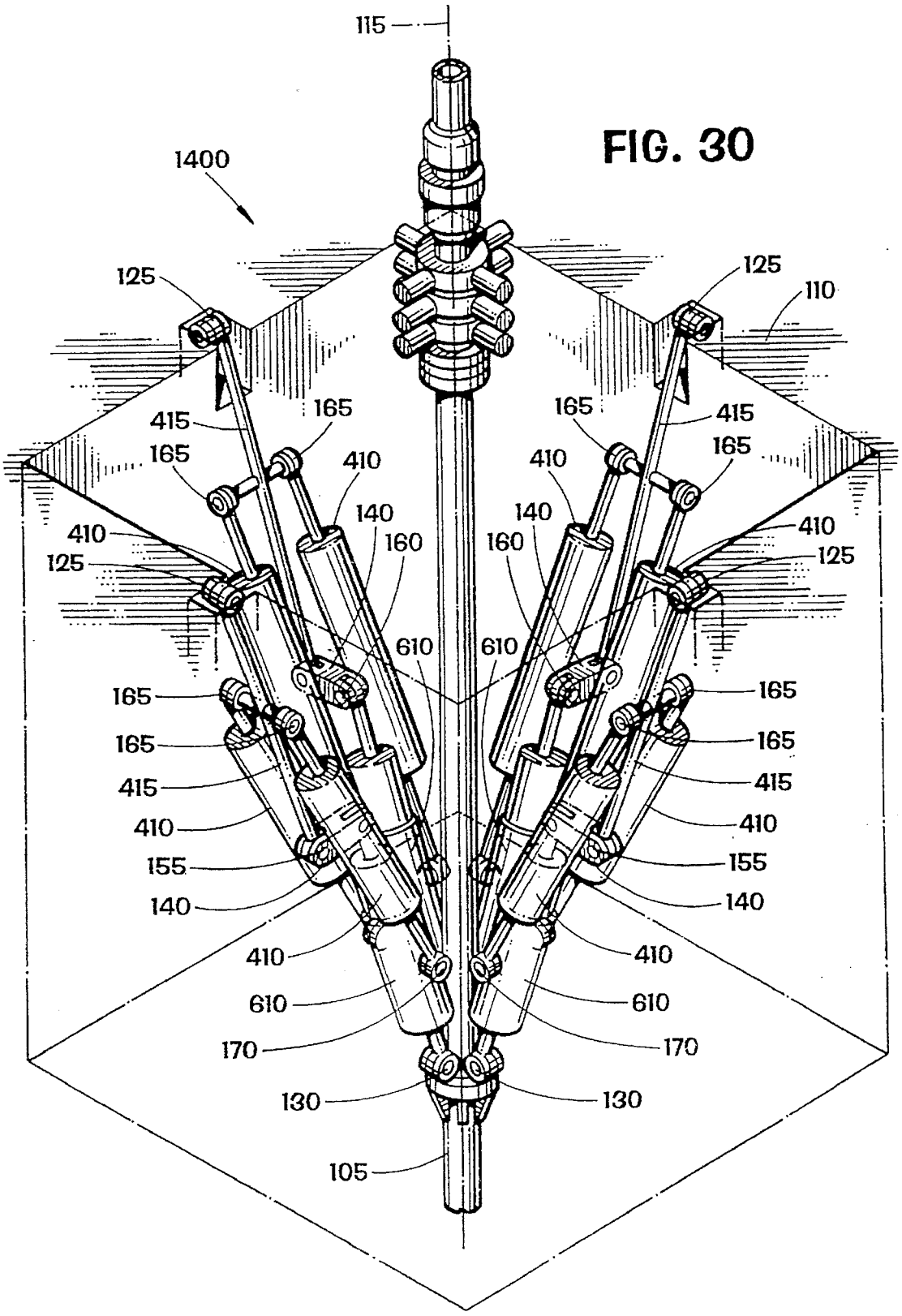
FIG. 30 illustrates a perspective view of another embodiment of a riser tensioner system including a plurality of tensioner assemblies each including intermediate members and a lower member providing a tensioning force and having columnar stacks of compression elements.
Figure 31:
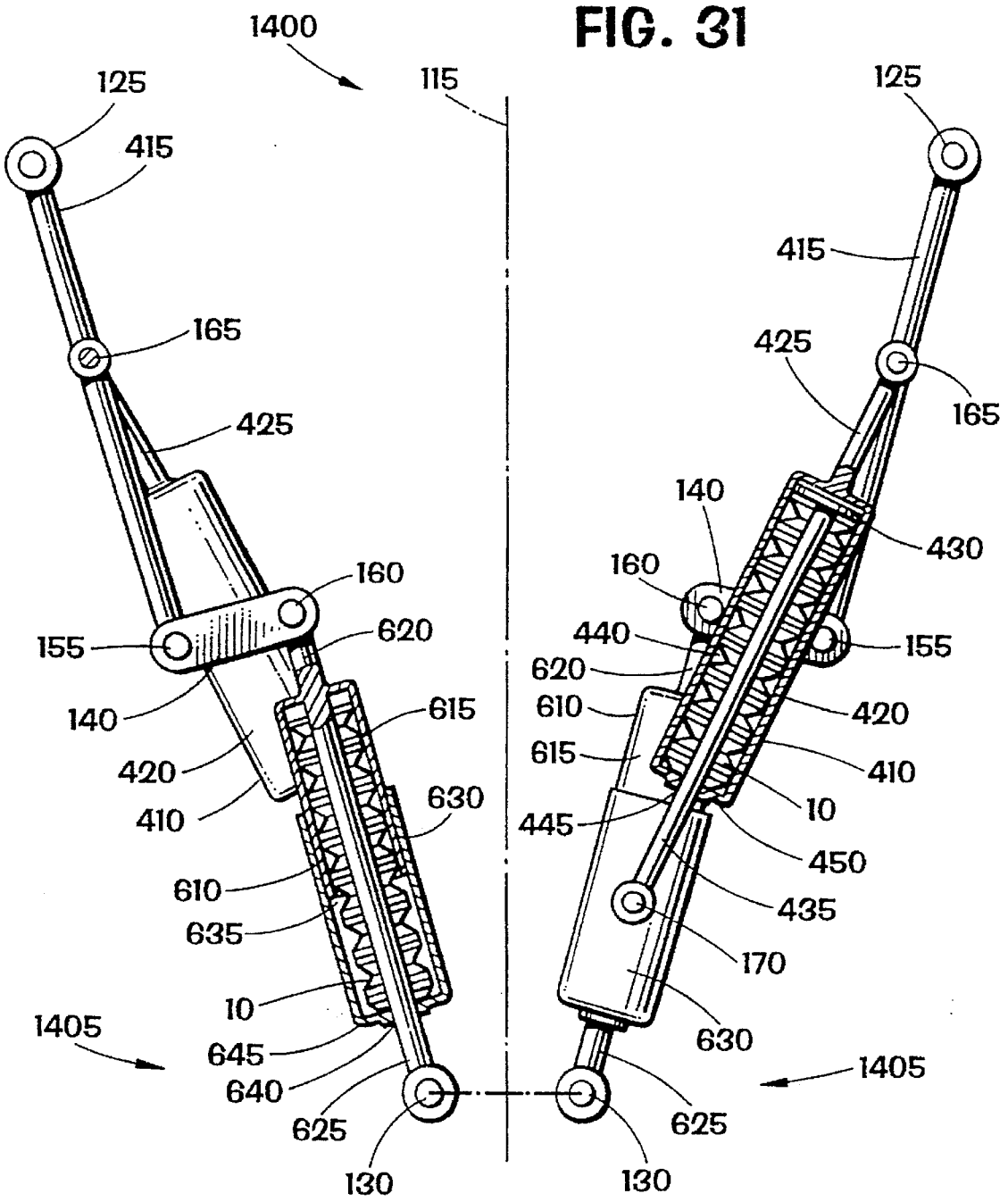
FIG. 31 illustrates a partial cross-sectional view of a pair of opposing tensioner assemblies of the embodiment illustrated in FIG. 30.

Turning to FIGS. 30 and 31, another preferred embodiment of a riser tensioner system 1400 will now be described. In this embodiment, the tensioner assemblies 1405 of the riser tensioner system 1400 provide a tensioning force to the riser 105 by means of columnar stacks of compression elements 10 contained within both the lower member and the intermediate members which are compressed during vertical extension of the tensioner assembly 1405. The performance of this embodiment is very nearly equivalent to that provided by the previous embodiments that utilized a pair of resilient members. In particular, each tensioner assembly 1405 includes a resilient intermediate members 410 and a resilient lower member 610 in combination with a rigid connecting member 140 and a rigid upper member 415. In this embodiment, the connecting member 140 and the upper member 415 of the tensioner assembly 1405 are rigid members and thereby provide the necessary linkage to enable compression of the compression elements 10 contained within the resilient intermediate and lower members, 410 and 610 respectively.

During vertical extension of the tensioner assembly 1405, the end portion 645 of the outer canister 630 of the lower member 610 compresses the columnar stack of compression elements 10 within the lower member 610 and the first piston 630 compresses the columnar stack of compression elements 10 within the intermediate member 410 against the first end portion 450 of the outer canister 420 of the intermediate member 410 by virtue of the linkage of the assembly 1405 provided by the combination of the upper member 415, lower member 610, connecting member 140, and intermediate members 410. The compression of the compression elements 10 in turn provides a reaction force opposing vertical extension of the tensioner assembly 1405 which provides the tensioning force to the riser 105.

Figure 32:
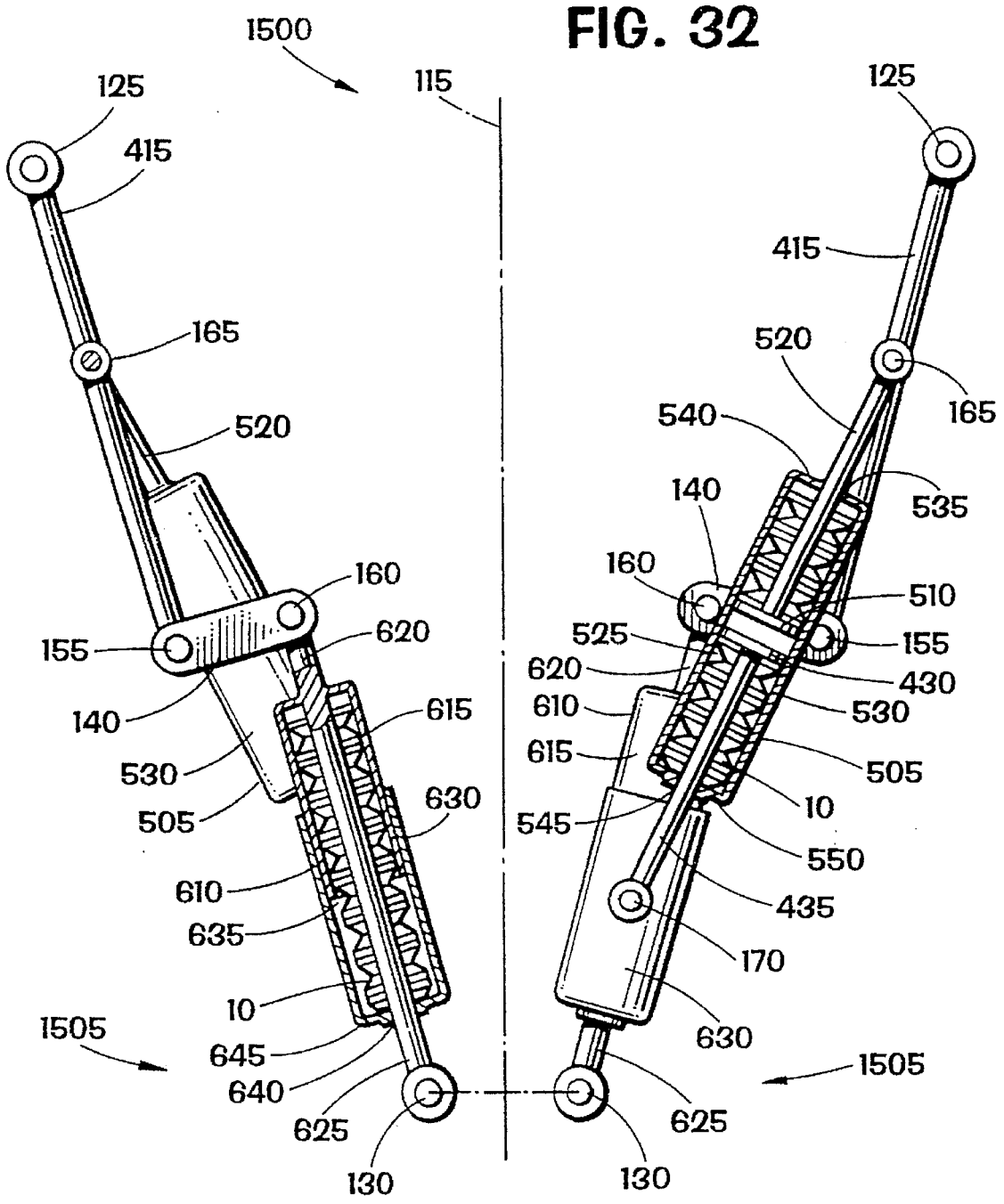
FIG. 32 illustrates a partial cross-sectional view of a pair of opposing tensioner assemblies in another embodiment of a riser tensioner system including a plurality of tensioner assemblies each including intermediate members and a lower member providing a tensioning force and having columnar stacks of compression elements.

Turning to FIG. 32, another embodiment of a riser tensioner system 1500 will now be described. The riser tensioner system 1500 is identical in form and function to the embodiment previously described with reference to FIGS. 30 and 31 except that the intermediate member is modified to utilize a second piston for compressing an upper portion of the columnar stack of compression elements 10 within the intermediate member while the first piston compresses a lower portion of the columnar stack of compression elements 10 within the intermediate member during vertical extension of the tensioner assembly 1505. In particular, each tensioner assembly 1505 includes resilient intermediate members 505 and a resilient lower member 610 in combination with a rigid connecting member 140 and a rigid upper member 415. In this embodiment, the connecting member 140 and the upper member 415 of the tensioner assembly 1505 are rigid members and thereby provide the necessary linkage to enable compression of the compression elements 10 contained within the resilient intermediate and lower members, 505 and 610 respectively.

During vertical extension of the tensioner assembly 1505, the first and second pistons, 430 and 510 respectively, compress the columnar stack of compression elements 10 within the intermediate member 505 against the first and second end portions, 550 and 540 respectively, of the outer canister 530 of the intermediate member 505 and the end portion 645 of the outer canister 630 of the lower member 610 compresses the columnar stack of compression elements 10 within the lower member 610 by virtue of the linkage of the tensioner assembly 1505 provided by the combination of the upper member 415, lower member 610, connecting member 140, and intermediate members 505. The compression of the compression elements 10 in turn provides a reaction force opposing vertical extension of the tensioner assembly 1505 which provides the tensioning force to the riser 105.

Figure 33:
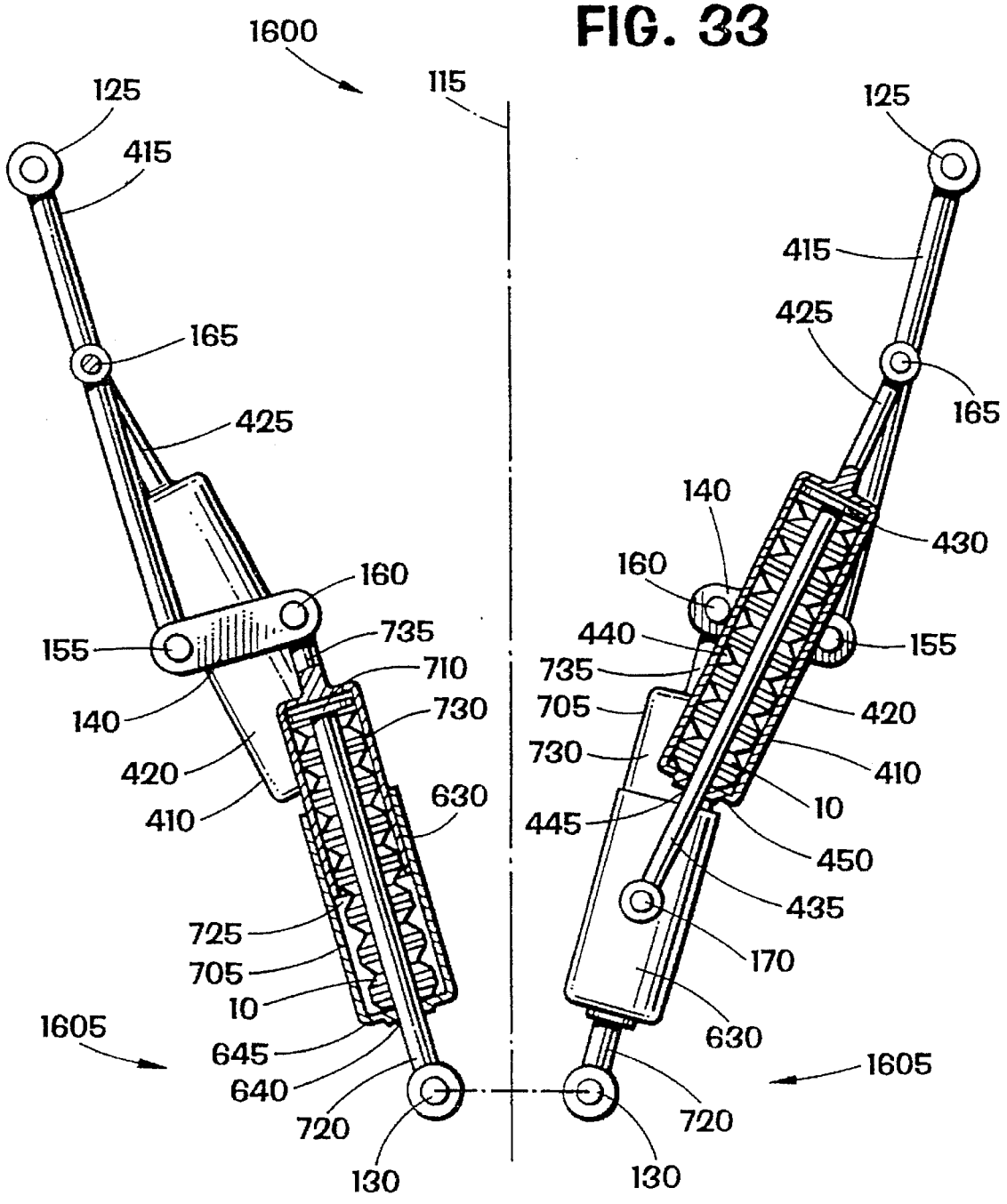
FIG. 33 illustrates a partial cross-sectional view of a pair of opposing tensioner assemblies in yet another embodiment of a riser tensioner system including a plurality of tensioner assemblies each including intermediate members and a lower member providing a tensioning force and having columnar stacks of compression elements.

Turning to FIG. 33, another embodiment of a riser tensioner system 1600 will now be described. The riser tensioner system 1600 is identical in form and function to the embodiment previously described with reference to FIGS. 30 and 31 except that the lower member is modified to utilize a piston for further compressing the columnar stack of compression elements 10 during vertical extension of the tensioner assembly 1605 and also permitting increased relative vertical displacement between the riser 105 and platform 110. In particular, each tensioner assembly 1605 includes resilient intermediate members 505 and a resilient lower member 705 in combination with a rigid connecting member 140 and a rigid upper member 415. In this embodiment, the connecting member 140 and the upper member 415 of the tensioner assembly 1505 are rigid members and thereby provide the necessary linkage to enable compression of the compression elements 10 contained within the resilient intermediate and lower members, 505 and 705 respectively.

During vertical extension of the tensioner assembly 1605, the end portion 645 of the outer canister 630 of the lower member 705 compresses the columnar stack of compression elements 10 within the lower member 705 and the first piston 430 within the intermediate member 410 compresses the columnar stack of compression elements 10 within the intermediate member 410 against the first end portion 450 of the outer canister 420 of the intermediate member 410 by virtue of the linkage of the tensioner assembly 1605 provided by the combination of the upper member 415, lower member 705, connecting member 140, and intermediate members 150. Furthermore, the piston 710 with the lower member 705 also compresses the columnar stack of compression elements 10 within the lower member 705 during vertical extension of the tensioner assembly 1605 by virtue of the pinned connection 130 of the central shaft 720 to the riser 105. The compression of the compression elements 10 in turn provides a reaction force opposing vertical extension of the tensioner assembly 1605 which provides the tensioning force to the riser 105.

Figure 34:
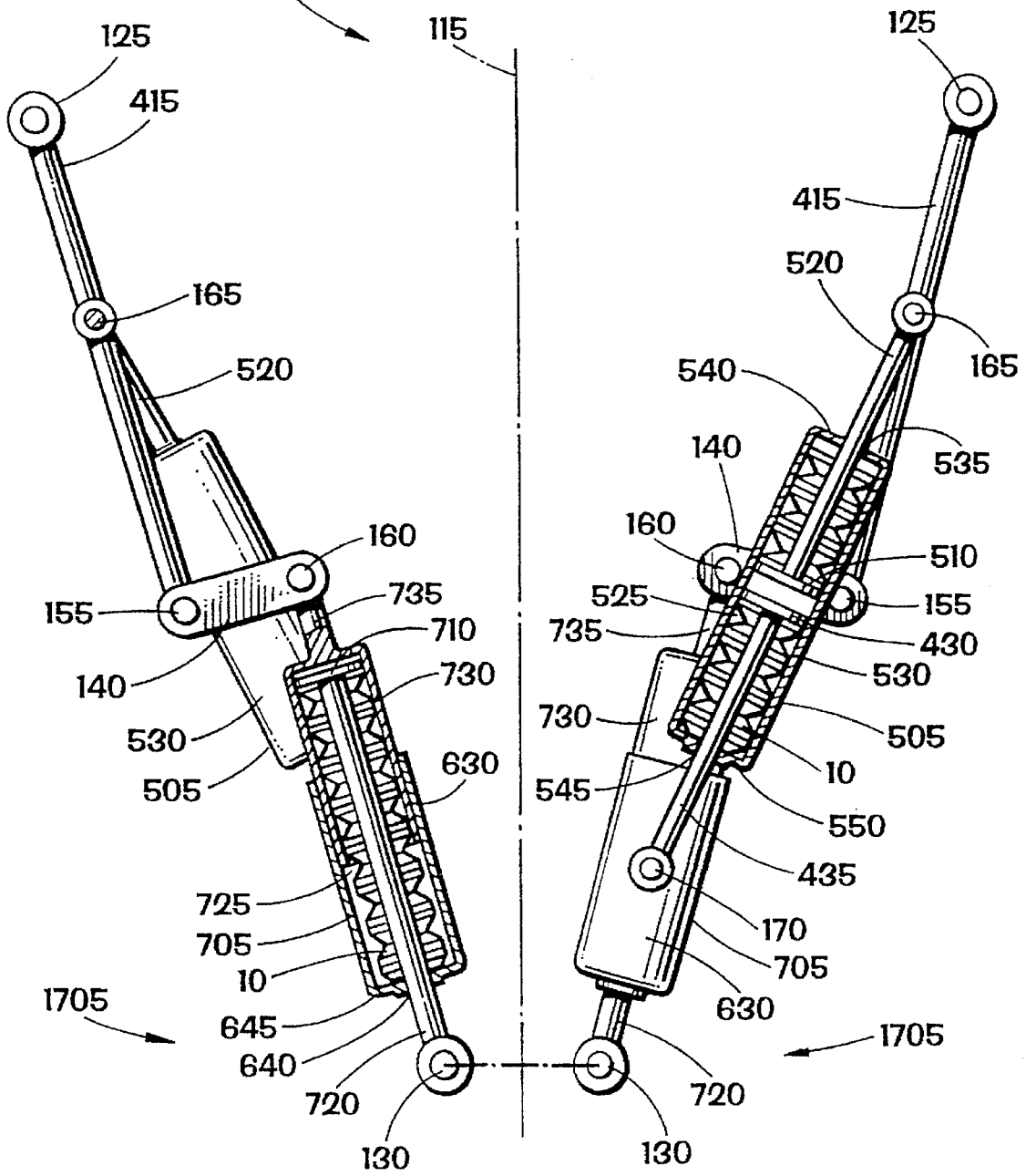
FIG. 34 illustrates a partial cross-sectional view of a pair of opposing tensioner assemblies in still another embodiment of a riser tensioner system including a plurality of tensioner assemblies each including intermediate members and a lower member providing a tensioning force and having columnar stacks of compression elements.

Turning to FIG. 34, another embodiment of a riser tensioner system 1700 will now be described. The riser tensioner system 1700 is identical in form and function to the embodiment previously described with reference to FIG. 32 except that the lower member is modified to utilize a piston for further compressing the columnar stack of compression elements 10 during vertical extension of the tensioner assembly 1705 and also permitting increased relative vertical displacement between the riser 105 and platform 110. In particular, each tensioner assembly 1705 includes resilient intermediate members 505 and a resilient lower member 705 in combination with a rigid connecting member 140 and a rigid upper member 415. In this embodiment, the connecting member 140 and the upper member 415 of the tensioner assembly 1705 are rigid members and thereby provide the necessary linkage to enable compression of the compression elements 10 contained within the resilient intermediate and lower members, 505 and 705 respectively.

During vertical extension of the tensioner assembly 1705, the first and second pistons, 430 and 510 respectively, compress the columnar stack of compression elements 10 within the intermediate member 505 against the first and second end portions, 550 and 540 respectively, of the outer canister 530 of the intermediate member 505 and the end portion 645 of the outer canister 630 of the lower member 705 compresses the columnar stack of compression elements 10 within the lower member 705 by virtue of the linkage of the tensioner assembly 1705 provided by the combination of the upper member 415, lower member 705, connecting member 140, and intermediate members 150. Furthermore, the piston 710 within the lower member 705 also compresses the columnar stack of compression elements 10 within the lower member 705 during vertical extension of the tensioner assembly 1705 by virtue of the pinned connection 130 of the central shaft 720 to the riser 105. The compression of the compression elements 10 in turn provides a reaction force opposing vertical extension of the tensioner assembly 1705 which provides the tensioning force to the riser 105.

Figure 35:
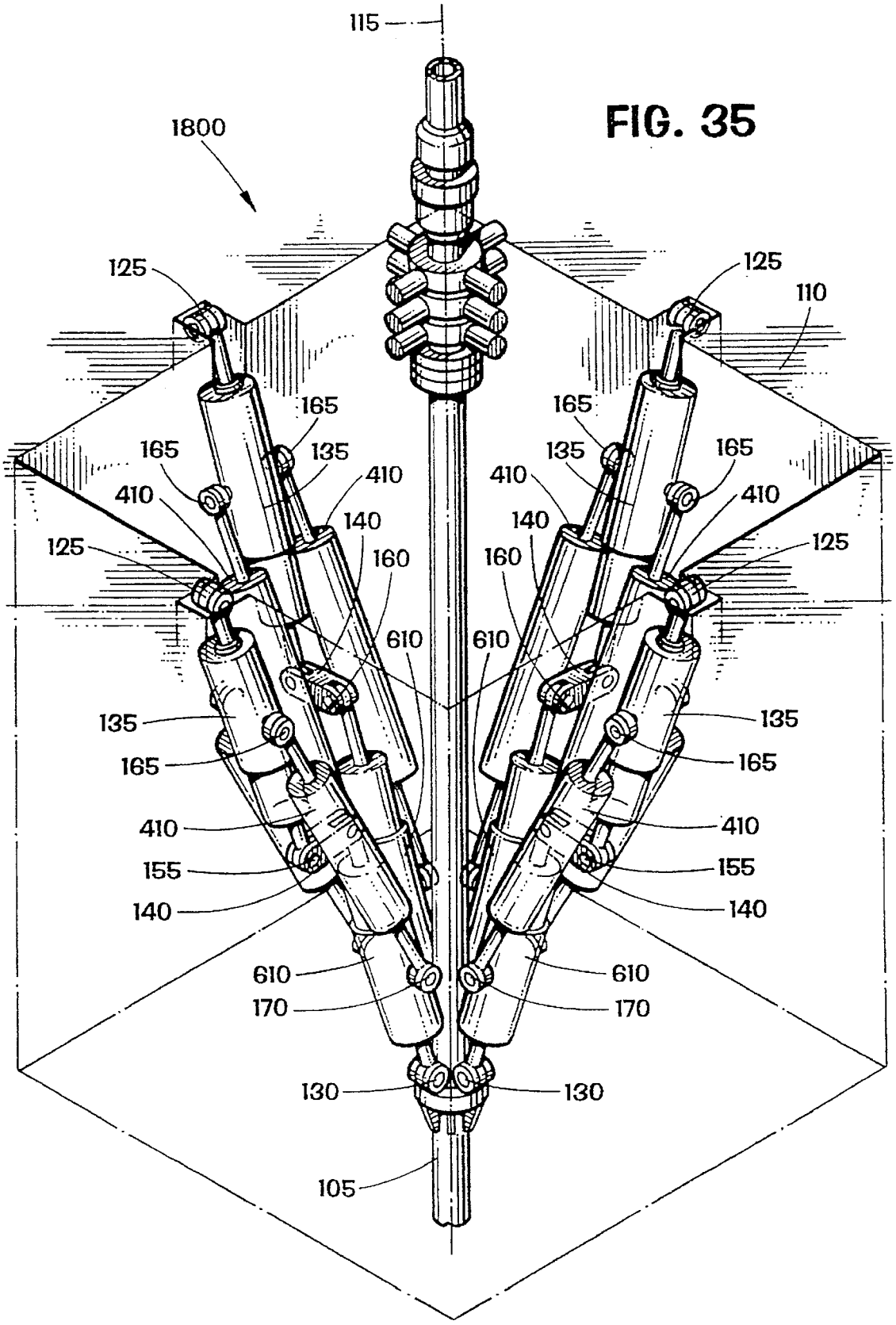
FIG. 35 illustrates a perspective view of another embodiment of a riser tensioner system including a plurality of tensioner assemblies each including an upper member, intermediate members, and a lower member providing a tensioning force and having columnar stacks of compression elements.
Figure 36:
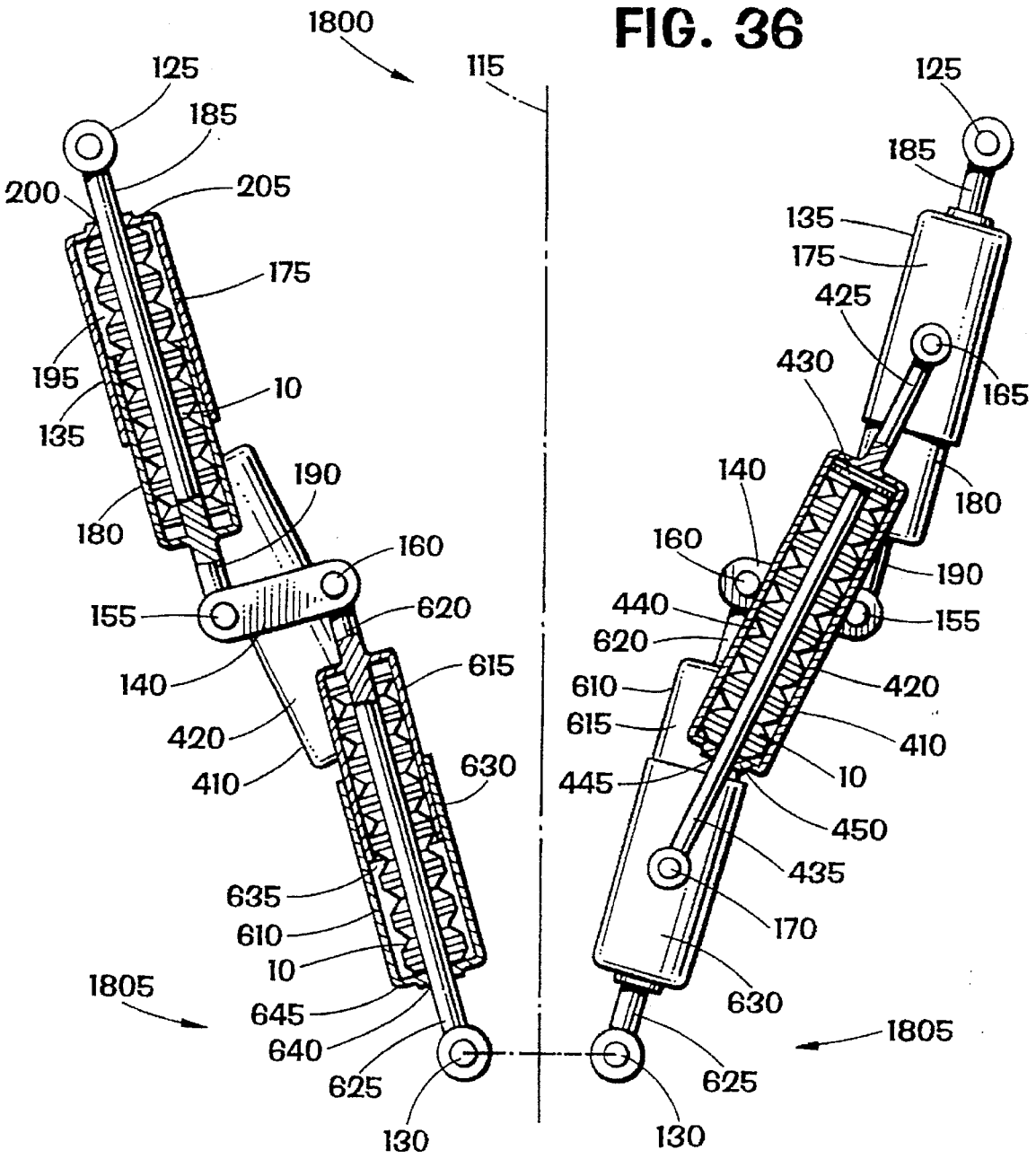
FIG. 36 illustrates a partial cross-sectional view of a pair of opposing tensioner assemblies of the embodiment illustrated in FIG. 35.

Turning to FIGS. 35 and 36, another preferred embodiment of a riser tensioner system 1800 will now be described. In this embodiment, the tensioner assemblies 1805 of the riser tensioner system 1800 provide a tensioning force to the riser 105 by means of columnar stacks of compression elements 10 contained within the upper member, the lower member, and the intermediate members which are compressed during vertical extension of the tensioner assembly 1805. The performance of this embodiment is superior to that provided by the previous embodiments that only utilized a pair of resilient members. The use of a resilient upper member, resilient lower member, and resilient intermediate members results in a linkage that provides the maximum tensioning force in combination with the most complete damping of vibrations. In particular, each tensioner assembly 1805 includes a resilient upper member 135, resilient intermediate members 410, and a resilient lower member 610 in combination with a rigid connecting member. In this embodiment, the connecting member 140 of the tensioner assembly 1805 is a rigid member and thereby provides the necessary linkage to enable compression of the compression elements 10 contained within the resilient upper member 135, the resilient intermediate members 410, and the resilient lower member 610.

During vertical extension of the tensioner assembly 1805, the end portion 205 of the outer canister 175 of the upper member 135 compresses the columnar stack of compression elements 10 within the upper member 135, the end portion 645 of the outer canister 630 of the lower member 610 compresses the columnar stack of compression elements 10 within the lower member 610, and the first piston 430 within the intermediate members 410 compresses the columnar stack of compression elements 10 within the intermediate members 410 against the first end portion 450 of the outer canister 420 of the intermediate member 410 by virtue of the linkage of the assembly 1805 provided by the combination of the upper member 135, lower member 610, connecting member 140, and intermediate members 410. The compression of the compression elements 10 in turn provides a reaction force opposing vertical extension of the tensioner assembly 1805 which provides the tensioning force to the riser 105.

Figure 37:
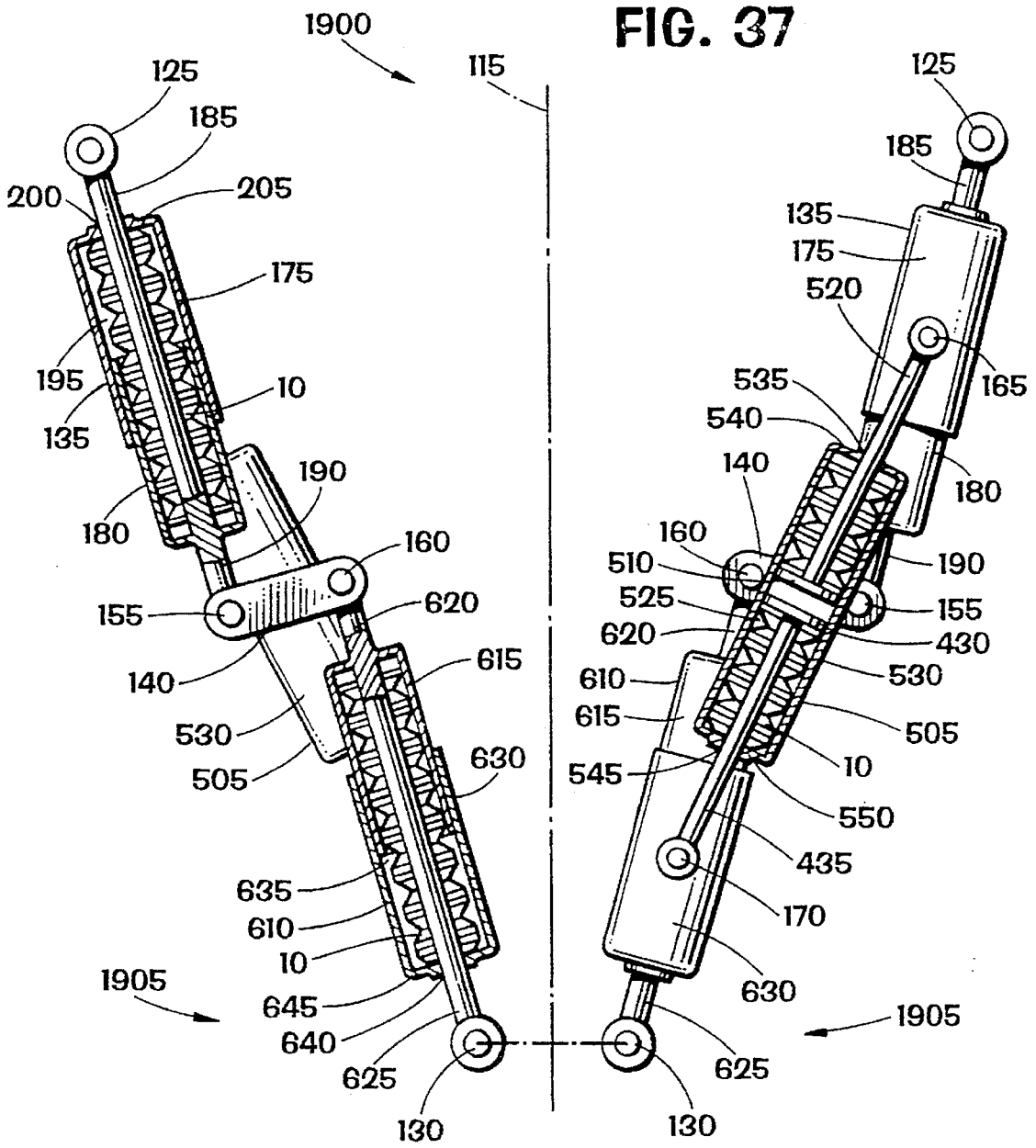
FIG. 37 illustrates a partial cross-sectional view of a pair of opposing tensioner assemblies in another embodiment of a riser tensioner system including a plurality of tensioner assemblies each including an upper member, intermediate members, and a lower member providing a tensioning force and having columnar stacks of compression elements.

Turning to FIG. 37, another embodiment of a riser tensioner system 1900 will now be described. The riser tensioner system 1900 is identical in form and function to the embodiment previously described with reference to FIGS. 35 and 36 except that the intermediate member is modified to utilize a second piston for compressing an upper portion of the columnar stack of compression elements 10 within the intermediate member while the first piston compresses a lower portion of the columnar stack of compression elements 10 within the intermediate member 150 during vertical extension of the tensioner assembly 120. In particular, each tensioner assembly 1905 includes a resilient upper member 135, resilient intermediate members 505, and a resilient lower member 610 in combination with a rigid connecting member 140. In this embodiment, the connecting member 140 of the tensioner assembly 1905 is a rigid member and thereby provides the necessary linkage to enable compression of the compression elements 10 contained within the resilient upper member 135, the resilient intermediate members 505, and the resilient lower member 610.

During vertical extension of the tensioner assembly 1905, the first and second pistons, 430 and 510 respectively, compress the columnar stack of compression elements 10 within the intermediate member 505 against the first and second end portions, 550 and 540 respectively, of the outer canister 530 of the intermediate member 505, the end portion 205 of the outer canister 175 of the upper member 135 compresses the columnar stack of compression elements 10 within the upper member 135, and the end portion 645 of the outer canister 630 of the lower member 610 compresses the columnar stack of compression elements 10 within the lower member 610 by virtue of the linkage of the tensioner assembly 1905 provided by the combination of the upper member 135, lower member 610, connecting member 140, and intermediate members 505. The compression of the compression elements 10 in turn provides a reaction force opposing vertical extension of the tensioner assembly 1905 which provides the tensioning force to the riser 105.

Figure 38:
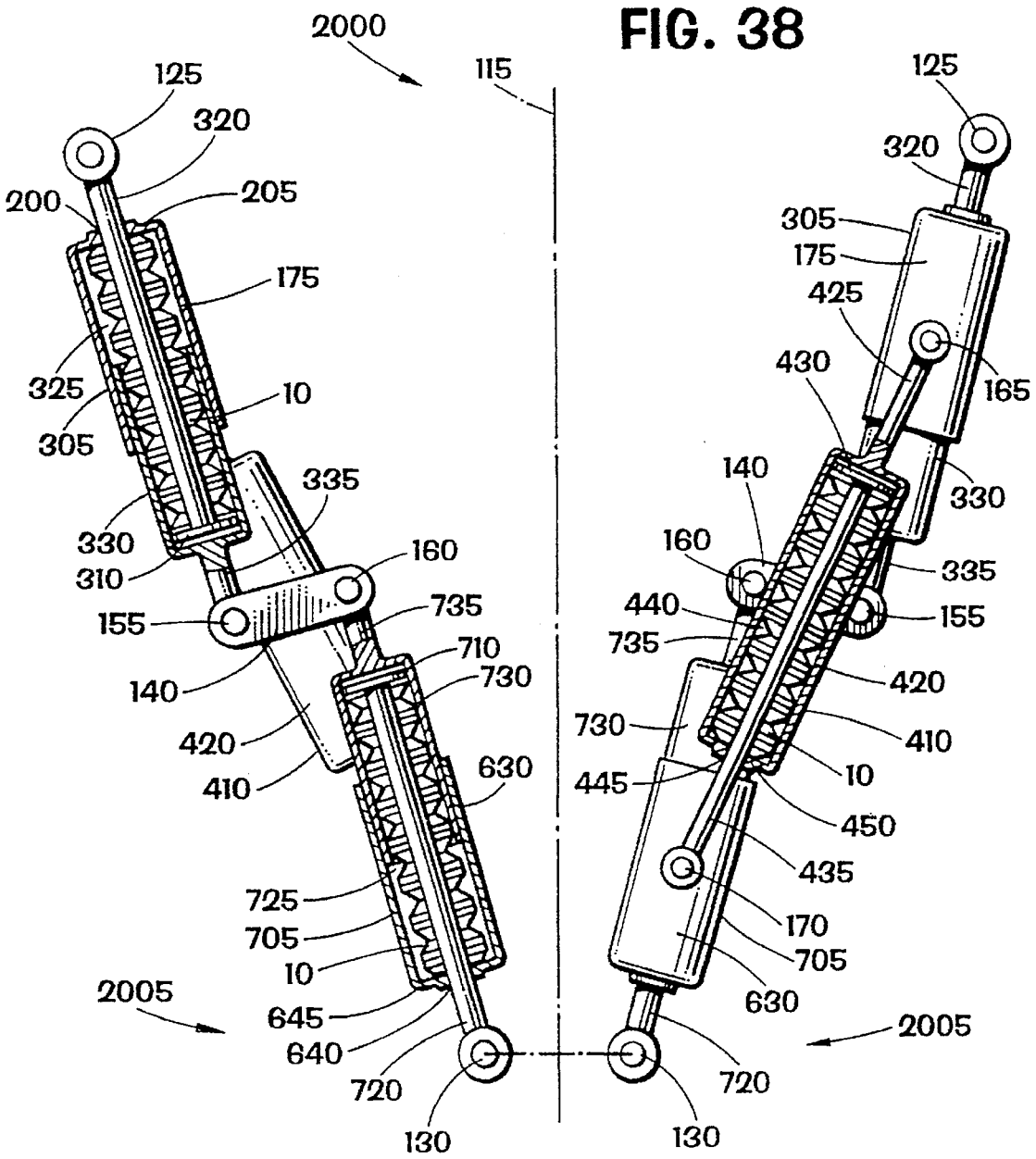
FIG. 38 illustrates a partial cross-sectional view of a pair of opposing tensioner assemblies in yet another embodiment of a riser tensioner system including a plurality of tensioner assemblies each including an upper member, intermediate members, and a lower member providing a tensioning force and having columnar stacks of compression elements.

Turning to FIG. 38, another embodiment of a riser tensioner system 2000 will now be described. The riser tensioner system 2000 is identical in form and function to the embodiment previously described with reference to FIGS. 35 and 36 except that the upper member and the lower member are modified to utilize pistons for further compressing the columnar stack of compression elements 10 within the upper and lower members during vertical extension of the tensioner assembly 2005 and also permitting increased relative vertical displacement between the riser 105 and platform 110. In particular, each tensioner assembly 2005 includes a resilient upper member 305, resilient intermediate members 410, and a resilient lower member 705 in combination with a rigid connecting member 140. In this embodiment, the connecting member 140 of the tensioner assembly 2005 is a rigid member and thereby provides the necessary linkage to enable compression of the compression elements 10 contained within the resilient upper member 305, the resilient intermediate members 410, and the resilient lower member 705.

During vertical extension of the tensioner assembly 2005, the end portion 205 of the outer canister 175 of the upper member 305 compresses the columnar stack of compression elements 10 within the upper member 305, the end portion 645 of the outer canister 630 of the lower member 705 compresses the columnar stack of compression elements 10 within the lower member 705, and the first piston 430 within the intermediate member 410 compresses the columnar stack of compression elements 10 within the intermediate member 410 against the first end portion 450 of the outer canister 420 of the intermediate member 410 by virtue of the linkage of the tensioner assembly 2005 provided by the combination of the upper member 305, lower member 705, connecting member 140, and intermediate members 410. Furthermore, the pistons 310 and 710 also compresses the columnar stack of compression elements 10 within the upper and lower member, 305 and 705 respectively, during vertical extension of the tensioner assembly 2005 by virtue of the pinned connections 125 and 130 of the central shafts 320 and 720 to the platform 110 and riser 105. The compression of the compression elements 10 in turn provides a reaction force opposing vertical extension of the tensioner assembly 2005 which provides the tensioning force to the riser 105.

Figure 39:
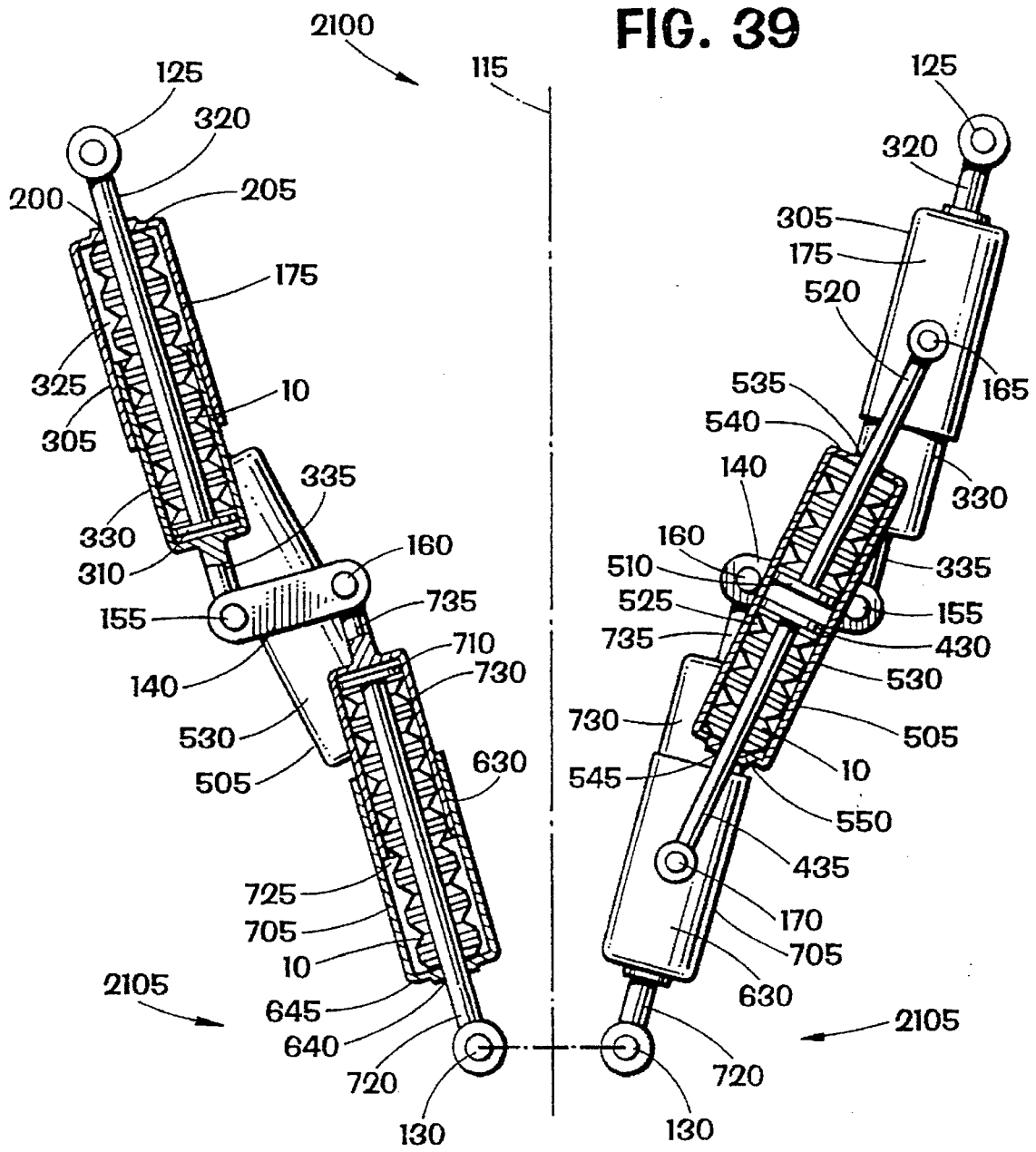
FIG. 39 illustrates a partial cross-sectional view of a pair of opposing tensioner assemblies in still another embodiment of a riser tensioner system including a plurality of tensioner assemblies each including an upper member, intermediate members, and a lower member providing a tensioning force and having columnar stacks of compression elements.

Turning to FIG. 39, another embodiment of a riser tensioner system 2100 will now be described. The riser tensioner system 2100 is identical in form and function to the embodiment previously described with reference to FIG. 37 except that the upper member and the lower member are modified to utilize pistons for further compressing the columnar stack of compression elements 10 within the upper and lower members during vertical extension of the tensioner assembly 2105 and also permitting increased relative vertical displacement between the riser 105 and platform 110. In particular, each tensioner assembly 2105 includes a resilient upper member 305, resilient intermediate members 505, and a resilient lower member 705 in combination with a rigid connecting member 140. In this embodiment, the connecting member 140 of the tensioner assembly 2105 is a rigid member and thereby provides the necessary linkage to enable compression of the compression elements 10 contained within the resilient upper member 305, the resilient intermediate members 505, and the resilient lower member 705.

During vertical extension of the tensioner assembly 2105, the end portion 205 of the outer canister 175 of the upper member 305 compresses the columnar stack of compression elements 10 within the upper member 305, the end portion 645 of the outer canister 630 of the lower member 705 compresses the columnar stack of compression elements 10 within the lower member 705, the first piston 430 compresses the columnar stack of compression elements 10 within the intermediate member 505 against the first end portion 550 of the outer canister 530 of the intermediate member 505, and the second piston 510 compresses the columnar stack of compression elements 10 within the intermediate member 505 against the second end portion 540 of the outer canister 530 of the intermediate member 505 by virtue of the linkage of the tensioner assembly 2105 provided by the combination of the upper member 305, lower member 710, connecting member 140, and intermediate members 505. Furthermore, the pistons 310 and 710 also compress the columnar stacks of compression elements 10 within the upper and lower member, 305 and 710 respectively, during vertical extension of the tensioner assembly 2105 by virtue of the pinned connections 125 and 130 of the central shafts 320 and 720 to the platform 110 and riser 105. The compression of the compression elements 10 in turn provides a reaction force opposing vertical extension of the tensioner assembly 2105 which provides the tensioning force to the riser 105.

Figure 40:
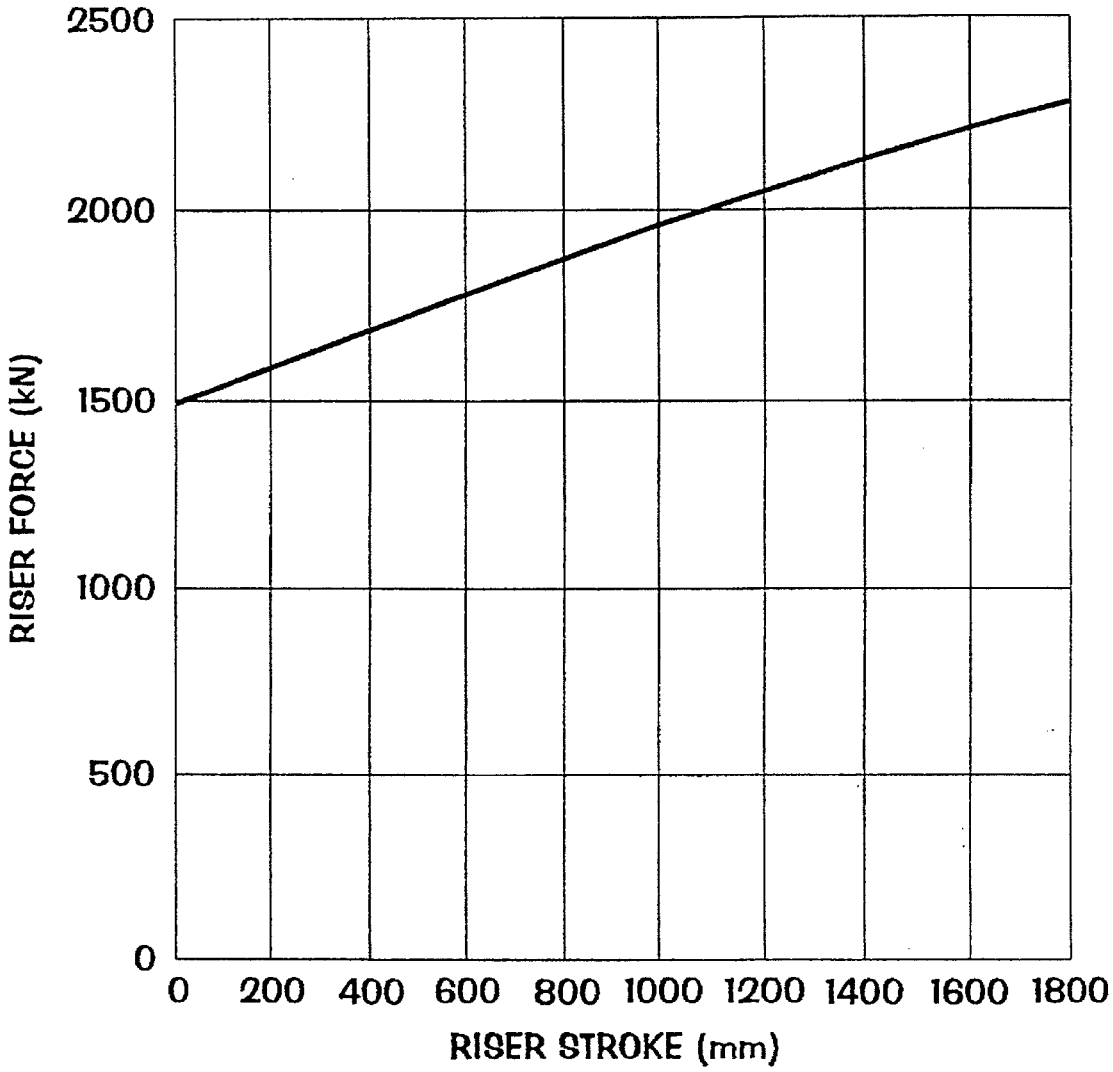
FIG. 40 graphically illustrates the response characteristics for an exemplary embodiment of a riser tensioner system 100 incorporating the design illustrated in FIGS. 27–28, with three tensioner assemblies equally positioned about a riser, with a 48 inch lever arm.

In an exemplary embodiment of a riser tensioner system incorporating the design illustrated and previously discussed with reference to FIGS. 27 and 28, with three tensioner assemblies 120 equally positioned about a riser 105 by a radial distance of approximately 5 feet, with a 48 inch connecting member 140, the riser tensioner system provided, as illustrated in FIG. 40, a substantially constant riser tensioning force ranging from about 1500 kN to about 2250 kN, for an operating stroke ranging of about 1800 mm. As will be recognized by those skilled in the art, given the tensioning force levels typically required in the riser tensioner system 100, the pinned connections 125, 130, 165, and 170 will preferably include bearings to accommodate the loading conditions.

The combined dynamic characteristics of the compression elements 10 and the linkage design of the tensioner assemblies 120 thus provide a means of achieving a long operating stroke with a substantially constant tensioning force in a restricted envelope with significantly reduced oscillatory stresses in the riser thereby significantly prolonging the fatigue life of the riser. Furthermore, the use of the connecting member provides a significant advantage in that the total operating stroke length of the tensioner assemblies will always be slightly less than twice the length of the connecting member. The mechanical advantage provided by the connecting member further has a tendency to flatten out the load versus deflection curve for the riser tensioner system (i.e., the longer the connecting member employed, the greater the flattening effect). Finally, the mechanical advantage provided by the connecting member is greatest when it is positioned substantially perpendicular to the upper and lower members.

As can be seen from the above discussion of the preferred embodiments, the compression elements 10 offer significant advances over previous systems. Those skilled in the art will no doubt be able to apply these teachings and further improve upon the state of the art.

What is claimed is:

1. A riser tensioner system for applying a tensioning force to a riser and allowing a floating platform to move within a given range along a longitudinal axis of said riser, said system comprising:

a plurality of tensioner assemblies, wherein each of said tensioner assemblies are coupled to said riser and to said platform, and wherein each of said tensioner assemblies comprises:

an upper member including a first end and a second end, said first end of said upper member coupled to said floating platform;

a lower member including a first end and a second end, said second end of said lower member coupled to said riser;

a connecting member coupled to said second end of said upper member and said first end of said lower member; and an intermediate member coupled to said upper member at a point intermediate said first and second ends of said upper member and to said lower member at a point intermediate said first and second ends of said lower member;

wherein at least one of said upper member, said lower member, and said intermediate member are adapted to provide a tensioning force.

2. The riser tensioner system of claim 1, wherein said upper member is adapted to provide a tensioning force.

3. The riser tensioner system of claim 2, wherein said upper member comprises:

an outer canister coupled to said intermediate member;

an inner canister coupled to said connecting member, said inner canister positioned within and extending from said outer canister; and a columnar stack of compression elements contained within a chamber defined by said inner and outer canisters.

4. The riser tensioner system of claim 3, wherein said columnar stack of compression elements comprises:

a columnar stack of compression elements having a top compression element and a bottom compression element, said stack of compression elements being deflectable in response to certain relative movement between said riser and said platform along said longitudinal axis, each of said compression elements having:

an inner flange having a curved outer coupling portion;

an outer flange having a curved inner coupling portion;

a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

5. The riser tensioner system of claim 4, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

6. The riser tensioner system of claim 5, wherein said cone of said deflectable member has a plurality of slots that extend radially outwardly from a central hub.

7. The riser tensioner system of claim 3, wherein said outer canister of said upper member is pivotally connected to said intermediate member, and wherein said inner canister of said upper member is pivotally connected to said connecting member.

8. The riser tensioner system of claim 3, wherein said upper member further comprises:

a piston positioned within said chamber defined by said inner and outer canisters of said upper member and coupled to said floating platform, said piston adapted for compressing said columnar stack of compression elements.

9. The riser tensioner system of claim 8, wherein said piston of said upper member is pivotally connected to said floating platform, and wherein said lower member is pivotally connected to said riser.

10. The riser tensioner system of claim 1, wherein said intermediate member is adapted to provide a tensioning force.

11. The riser tensioner system of claim 10, wherein said intermediate member comprises:

an outer canister coupled to said upper member and defining a chamber;

a columnar stack of compression elements contained within said chamber defined by said outer canister; and a piston positioned within said chamber and coupled to said lower member, said piston adapted for compressing said columnar stack of compression elements.

12. The riser tensioner system of claim 11, wherein said columnar stack of compression elements comprises:

a columnar stack of compression elements having a top compression element and a bottom compression element, said stack of compression elements being deflectable in response to certain relative movement between said riser and said platform along said longitudinal axis, each of said compression elements having:

an inner flange having a curved outer coupling portion;

an outer flange having a curved inner coupling portion;

a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

13. The riser tensioner system of claim 12, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

14. The riser tensioner system of claim 13, wherein said cone of said deflectable member has a plurality of slots that extend radially outwardly from a central hub.

15. The riser tensioner system of claim 11, wherein said piston of said intermediate member is pivotally connected to said lower member, and wherein said outer canister of said intermediate member is pivotally connected to said upper member.

16. The riser tensioner system of claim 10, wherein said intermediate member comprises:

an outer canister defining a chamber;

a columnar stack of compression elements contained within said chamber defined by said outer canister; and an upper piston positioned within said chamber and coupled to said upper member, said upper piston adapted for compressing a portion of said columnar stack of compression elements; and a lower piston positioned within said chamber and coupled to said lower member, said lower piston adapted for compressing another portion of said columnar stack of compression elements.

17. The riser tensioner system of claim 16, wherein said columnar stack of compression elements comprises:

a columnar stack of compression elements having a top compression element and a bottom compression element, said stack of compression elements being deflectable in response to certain relative movement between said riser and said platform along said longitudinal axis, each of said compression elements having:
an inner flange having a curved outer coupling portion;
an outer flange having a curved inner coupling portion;
a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and
at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

18. The riser tensioner system of claim 17, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

19. The system, as set forth in claim 18, wherein said cone of said deflectable member has a plurality of slots that extend radially outwardly from a central hub.

20. The riser tensioner of claim 16, wherein said upper piston of said intermediate member is pivotally connected to said upper member, and wherein said lower piston of said intermediate member is pivotally connected to said lower member.

21. The riser tensioner system of claim 1, wherein said lower member is adapted to provide a tensioning force.

22. The riser tensioner system of claim 21, wherein said lower member comprises:

an outer canister coupled to said intermediate member;

an inner canister coupled to said connecting member, said inner canister positioned within and extending from said outer canister; and a columnar stack of compression elements contained within a chamber defined by said inner and outer canisters.

23. The riser tensioner system of claim 22, wherein said columnar stack of compression elements comprises:

a columnar stack of compression elements having a top compression element and a bottom compression element, said stack of compression elements being deflectable in response to certain relative movement between said riser and said platform along said longitudinal axis, each of said compression elements having:
an inner flange having a curved outer coupling portion;
an outer flange having a curved inner coupling portion;
a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and
at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

24. The riser tensioner system of claim 23, wherein at least one of said deflectable members is shaped like a hollow, truncated cone having a given conical angle, a truncated end, and a base end, said truncated end being curved and 4 complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

25. The riser tensioner system of claim 24, wherein said cone of said deflectable member has a plurality of slots that extend radially outwardly from a central hub.

26. The riser tensioner system of claim 22, wherein said outer canister of said lower member is pivotally connected to said intermediate member, and wherein said inner canister of said lower member is pivotally connected to said connecting member.

27. The riser tensioner system of claim 22, wherein said lower member further comprises:

a piston positioned within said chamber defined by said inner and outer canisters of said lower member and coupled to said floating platform, said piston adapted for compressing said columnar stack of compression elements.

28. The riser tensioner system of claim 27, wherein said piston of said lower member is pivotally connected to said riser.

29. The riser tensioner system of claim 1, wherein said upper member and said lower member are adapted to provide a tensioning force.

30. The riser tensioner system of claim 29, wherein said upper member comprises:

an outer canister coupled to said intermediate member;

an inner canister coupled to said connecting member, said inner canister positioned within and extending from said outer canister; and a columnar stack of compression elements contained within a chamber defined by said inner and outer canisters; and wherein said lower member comprises:

an outer canister coupled to said intermediate member;

an inner canister coupled to said connecting member, said inner canister positioned within and extending from said outer canister; and a columnar stack of compression elements contained within a chamber defined by said inner and outer canisters.

31. The riser tensioner system of claim 30, wherein each said columnar stack of compression elements comprise:

a columnar stack of compression elements having a top compression element and a bottom compression element, said stack of compression elements being deflectable in response to certain relative movement between said riser and said platform along said longitudinal axis, each of said compression elements having:

an inner flange having a curved outer coupling portion;

an outer flange having a curved inner coupling portion;

a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

32. The riser tensioner system of claim 31, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

33. The riser tensioner system of claim 32, wherein said cone of said deflectable member has a plurality of slots that extend radially outwardly from a central hub.

34. The riser tensioner system of claim 30, wherein said outer canisters of said upper and lower members are pivotally connected to said intermediate member, and wherein said inner canisters of said upper and lower members are pivotally connected to said connecting member.

35. The riser tensioner system of claim 30, wherein said upper member further comprises:

a piston positioned within said chamber defined by said inner and outer canisters of said upper member and coupled to said floating platform, said piston adapted for compressing said columnar stack of compression elements; and wherein said lower member further comprises:

a piston positioned within said chamber defined by said inner and outer canisters of said lower member and coupled to said riser, said piston adapted for compressing said columnar stack of compression elements.

36. The riser tensioner system of claim 35, wherein said piston of said upper member is pivotally connected to said floating platform, and wherein said piston of said lower member is pivotally connected to said riser.

37. The riser tensioner system of claim 1, wherein said intermediate member and said lower member are adapted to provide a tensioning force.

38. The riser tensioner system of claim 37, wherein said intermediate member comprises:

an outer canister coupled to said upper member, said outer canister further defining a chamber;

a columnar stack of compression elements contained within said chamber defined by said outer canister; and a piston positioned within said chamber adapted for compressing said columnar stack of compression elements; and wherein said lower member comprises:

an outer canister coupled to said piston of said intermediate member;

an inner canister coupled to said connecting member, said inner canister positioned within and extending from said outer canister; and a columnar stack of compression elements contained within a chamber defined by said inner and outer canisters.

39. The riser tensioner system of claim 38, wherein each said columnar stack of compression elements comprise:

a columnar stack of compression elements having a top compression element and a bottom compression element, said stack of compression elements being deflectable in response to certain relative movement between said riser and said platform along said longitudinal axis, each of said compression elements having:

an inner flange having a curved outer coupling portion;

an outer flange having a curved inner coupling portion;

a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

40. The riser tensioner system of claim 39, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

41. The riser tensioner system of claim 40, wherein said cone of said deflectable member has a plurality of slots that extend radially outwardly from a central hub.

42. The riser tensioner system of claim 38, wherein said piston of said intermediate member is pivotally connected to said outer canister of said lower member, and wherein said outer canister of said intermediate member is pivotally connected to said upper member.

43. The riser tensioner system of claim 38, wherein said lower member further comprises:

a piston positioned within said chamber defined by said inner and outer canisters and coupled to said riser, said piston adapted for compressing said columnar stack of compression elements.

44. The riser tensioner system of claim 43, wherein said piston of said lower member is pivotally connected to said riser.

45. The riser tensioner system of claim 37, wherein said intermediate member comprises:

an outer canister defining a chamber;

a columnar stack of compression elements contained within said chamber defined by said outer canister; and an upper piston positioned within said chamber and coupled to said upper member, said upper piston adapted for compressing a portion of said columnar stack of compression elements; and a lower piston positioned within said chamber adapted for compressing another portion of said columnar stack of compression elements; and wherein said lower member comprises:

an outer canister coupled to said lower piston of said intermediate member;

an inner canister coupled to said connecting member, said inner canister positioned within and extending from said outer canister; and a columnar stack of compression elements contained within a chamber defined by said inner and outer canisters.

46. The riser tensioner system of claim 45, wherein each said columnar stack of compression elements comprise:

a columnar stack of compression elements having a top compression element and a bottom compression element, said stack of compression elements being deflectable in response to certain relative movement between said riser and said platform along said longitudinal axis, each of said compression elements having:

an inner flange having a curved outer coupling portion;

an outer flange having a curved inner coupling portion;

a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

47. The system, as set forth in claim 46, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

48. The system, as set forth in claim 47, wherein said cone of said deflectable member has a plurality of slots that extend radially outwardly from a central hub.

49. The riser tensioner of claim 45, wherein said lower piston of said intermediate member is pivotally connected to said outer canister of said lower member, and wherein said upper piston of said intermediate member is pivotally connected to said upper member.

50. The riser tensioner system of claim 45, wherein said lower member further comprises:

a piston positioned within said chamber defined by said inner and outer canisters and coupled to said riser, said piston adapted for compressing said columnar stack of compression elements.

51. The riser tensioner system of claim 50, wherein said piston of said lower member is pivotally connected to said riser.

52. The riser tensioner system of claim 1, wherein said intermediate member and said upper member are adapted to provide a tensioning force.

53. The riser tensioner system of claim 52, wherein said intermediate member comprises:

an outer canister defining a chamber;

a columnar stack of compression elements contained within said chamber defined by said outer canister; and a piston positioned within said chamber and coupled to said lower member, said piston adapted for compressing said columnar stack of compression elements; and wherein said upper member comprises:

an outer canister coupled to said outer canister of said intermediate member;

an inner canister coupled to said connecting member, said inner canister positioned within and extending from said outer canister; and a columnar stack of compression elements contained within a chamber defined by said inner and outer canisters.

54. The riser tensioner system of claim 53, wherein each said columnar stack of compression elements comprise:

a columnar stack of compression elements having a top compression element and a bottom compression element, said stack of compression elements being deflectable in response to certain relative movement between said riser and said platform along said longitudinal axis, each of said compression elements having:

an inner flange having a curved outer coupling portion;

an outer flange having a curved inner coupling portion;

a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

55. The riser tensioner system of claim 54, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

56. The system, as set forth in claim 55, wherein said cone of said deflectable member has a plurality of slots that extend radially outwardly from a central hub.

57. The riser tensioner system of claim 53, wherein said outer canister of said intermediate member is pivotally connected to said outer canister of said upper member, and wherein said piston of said intermediate member is pivotally connected to said lower member.

58. The riser tensioner system of claim 53, wherein said upper member further comprises:

a piston positioned within said chamber defined by said inner and outer canisters and coupled to said floating platform, said piston adapted for compressing said columnar stack of compression elements.

59. The riser tensioner system of claim 58, wherein said piston of said upper member is pivotally connected to said floating platform.

60. The riser tensioner of claim 52, wherein said intermediate member comprises:

an outer canister defining a chamber;

a columnar stack of compression elements contained within said chamber defined by said outer canister; and an upper piston positioned within said chamber adapted for compressing a portion of said columnar stack of compression elements; and a lower piston positioned within said chamber and coupled to said lower member, said lower piston adapted for compressing another portion of said columnar stack of compression elements; and wherein said upper member comprises:

an outer canister coupled to said upper piston of said intermediate member;

an inner canister coupled to said connecting member, said inner canister positioned within and extending from said outer canister; and a columnar stack of compression elements contained within a chamber defined by said inner and outer canisters.

61. The riser tensioner system of claim 60, wherein each said columnar stack of compression elements comprise:

a columnar stack of compression elements having a top compression element and a bottom compression element, said stack of compression elements being deflectable in response to certain relative movement between said riser and said platform along said longitudinal axis, each of said compression elements having:

an inner flange having a curved outer coupling portion;

an outer flange having a curved inner coupling portion;

a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

62. The riser tensioner system of claim 61, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

63. The riser tensioner system of claim 62, wherein said cone of said deflectable member has a plurality of slots that extend radially outwardly from a central hub.

64. The riser tensioner system of claim 60, wherein said upper piston of said intermediate member is pivotally connected to said outer canister of said upper member, and wherein said lower piston of said intermediate member is pivotally connected to said lower member.

65. The riser tensioner system of claim 60, wherein said upper member further comprises:

a piston positioned within said chamber defined by said inner and outer canisters and coupled to said floating platform, said piston adapted for compressing said columnar stack of compression elements.

66. The riser tensioner system of claim 65, wherein said piston of said upper member is pivotally connected to said floating platform.

67. The riser tensioner system of claim 1, wherein said upper member, said intermediate member, and said lower member are adapted to provide a tensioning force.

68. The riser tensioner system of claim 67, wherein said upper member comprises:

an outer canister;

an inner canister coupled to said connecting member, said inner canister positioned within and extending from said outer canister; and a columnar stack of compression elements contained within a chamber defined by said inner and outer canisters;

wherein said intermediate member comprises:

an outer canister defining a chamber and coupled to said outer canister of said upper member;

a columnar stack of compression elements contained within said chamber defined by said outer canister of said intermediate member; and a piston positioned within said chamber defined by said outer canister of said intermediate member adapted for compressing said columnar stack of compression elements; and wherein said lower member comprises:

an outer canister coupled to said piston of said intermediate member;

an inner canister coupled to said connecting member, said inner canister positioned within and extending from said outer canister; and a columnar stack of compression elements, contained within a chamber defined by said inner and outer canisters.

69. The riser tensioner system of claim 68, wherein each said columnar stack of compression elements comprise:

a columnar stack of compression elements having a top compression element and a bottom compression element, said stack of compression elements being deflectable in response to certain relative movement between said riser and said platform along said longitudinal axis, each of said compression elements having:

an inner flange having a curved outer coupling portion;

an outer flange having a curved inner coupling portion;

a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

70. The riser tensioner system of claim 69, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

71. The riser tensioner system of claim 70, wherein said cone of said deflectable member has a plurality of slots that extend radially outwardly from a central hub.

72. The riser tensioner system of claim 68, wherein said outer canister of said intermediate member is pivotally connected to said outer canister of said upper member, and wherein said outer canister of said lower member is pivotally connected to said piston of said intermediate member.

73. The riser tensioner system of claim 68, wherein said upper member further comprises:

a piston positioned within said chamber defined by said inner and outer canisters of said upper member and coupled to said floating platform, said piston adapted for compressing said columnar stack of compression elements; and wherein said lower member further comprises:

a piston positioned within said chamber defined by said inner and outer canisters of said lower member and coupled to said riser, said piston adapted for compressing said columnar stack of compression elements.

74. The riser tensioner system of claim 73, wherein said piston of said upper member is pivotally connected to said floating platform, and wherein said piston of said lower member is pivotally connected to said riser.

75. The riser tensioner system of claim 67, wherein said upper member comprises:

an outer canister;

an inner canister coupled to said connecting member, said inner canister positioned within and extending from said outer canister; and a columnar stack of compression elements contained within a chamber defined by said inner and outer canisters;

wherein said intermediate member comprises:

an outer canister defining a chamber;

a columnar stack of compression elements contained within said chamber defined by said outer canister; and an upper piston positioned within said chamber and coupled to said outer canister of said upper member, said upper piston adapted for compressing a portion of said columnar stack of compression elements; and a lower piston positioned within said chamber adapted for compressing another portion of said columnar stack of compression elements; and wherein said lower member comprises:

an outer canister coupled to said lower piston of said intermediate member;

an inner canister coupled to said connecting member, said inner canister positioned within and extending from said outer canister; and a columnar stack of compression elements contained within a chamber defined by said inner and outer canisters.

76. The riser tensioner system of claim 75, wherein each said columnar stack of compression elements comprise:

a columnar stack of compression elements having a top compression element and a bottom compression element, said stack of compression elements being deflectable in response to certain relative movement between said riser and said platform along said longitudinal axis, each of said compression elements having:

an inner flange having a curved outer coupling portion;

an outer flange having a curved inner coupling portion;

a deflectable member having an axial spring rate that varies within a given range, said deflectable member coupling said inner flange to said outer flange in an axially spaced apart relationship, said deflectable member having a first curved end coupled to said outer coupling portion of said inner flange and having a second curved end coupled to said inner coupling portion of said outer flange; and at least one curved reinforcement disposed in said deflectable member, wherein said curved outer coupling portion, said curved inner coupling portion, and said at least on curved reinforcement share a common focal point along a central cross-section;

wherein said top compression element is coupled to said outer cylindrical member and said bottom compression element is coupled to said center rod, wherein relative axial movement of said inner flanges of said compression elements in said stack toward said respective outer flanges of said compression elements in said stack compresses said deflectable members of said compression elements in said stack and decreases said axial spring rate of each of said deflectable members such that said tensioning force on said riser remains substantially constant throughout said range.

77. The system, as set forth in claim 76, wherein at least one of said deflectable members is shaped like a hollow, truncated cone having a given conical angle, a truncated end, and a base end, said truncated end being curved and complementarily coupled to said curved outer portion of said inner flange and said base end being curved and complementarily coupled to said curved inner coupling portion of said outer flange, wherein relative axial movement of said inner flange toward said outer flange compresses said at least one deflectable member and increases said conical angle, thus decreasing said given axial spring rate of said at least one deflectable member.

78. The system, as set forth in claim 77, wherein said cone of said deflectable member has a plurality of slots that extend radially outwardly from a central hub.

79. The riser tensioner system of claim 75, wherein said upper piston of said intermediate member is pivotally connected to said outer canister of said upper member, and wherein said outer canister of said lower member is pivotally connected to said lower piston of said intermediate member.

80. The riser tensioner system of claim 75, wherein said upper member further comprises:

a piston positioned within said chamber defined by said inner and outer canisters of said upper member and coupled to said floating platform, said piston adapted for compressing said columnar stack of compression elements; and wherein said lower member further comprises:

a piston positioned within said chamber defined by said inner and outer canisters of said lower member and coupled to said riser, said piston adapted for compressing said columnar stack of compression elements.

81. The riser tensioner system of claim 80, wherein said piston of said upper member is pivotally connected to said floating platform, and wherein said piston of said lower member is pivotally connected to said riser.

82. The riser tensioner system of claim 1, wherein said connecting member is pivotally connected to said upper and lower members.

83. The riser tensioner system of claim 1, wherein said intermediate member is pivotally connected to said upper and lower members.

84. The riser tensioner system of claim 1, wherein said connecting member is pivotally connected to said upper and lower members, and wherein said intermediate member is pivotally connected to said upper and lower members.

85. A riser tensioner system for applying a tensioning force to a riser and allowing a floating platform to move within a given range along a longitudinal axis of said riser, said system comprising:

a plurality of tensioner assemblies, wherein each of said tensioner assemblies is coupled to said riser and to said floating platform, and wherein each of said tensioner assemblies comprises:

a first member including a first end and a second end, said first end of said first member being coupled to said floating platform;

a second member including a first end and a second end, said second end of said second member being coupled to said riser;

a connecting member coupled to said second end of said first member and said first end of said second member; and an intermediate member coupled to said first member at a point intermediate said first and second ends of said first member and to said second member at a point intermediate said first and second ends of said second member;

wherein at least one of said first member, said second member, and said intermediate member is adapted to provide a tensioning force.

86. The riser tensioner system as claimed in claim 85, wherein said second end of said first member is pivotally connected to said connecting member, said first end of said second member is pivotally connected to said connecting member, and said connecting member is bisected by a centerline of said each of said tensioner assemblies.

87. The riser tensioner system as claimed in claim 85, wherein said second end of said first member is pivotally connected to said connecting member, said first end of said second member is pivotally connected to said connecting member, and said connecting member rotates about a centerpoint of said connecting member when said floating platform moves within a given range along a longitudinal axis of said riser.

88. The riser tensioner system as claimed in claim 85, wherein said connecting member is substantially perpendicular to said first member and to said second member.

89. A tensioner assembly for applying a tensioning force to a riser and allowing a floating platform to move within a given range along a longitudinal axis of said riser when said tensioner assembly is coupled to said riser and to said floating platform, said tensioner assembly comprising:

a first member including a first end and a second end, said first end of said first member being adapted for coupling to said floating platform;

a second member including a first end and a second end, said second end of said second member being adapted for coupling to said riser;

a connecting member coupled to said second end of said first member and said first end of said second member; and an intermediate member coupled to said first member at a point intermediate said first and second ends of said first member and to said second member at a point intermediate said first and second ends of said second member;

wherein at least one of said first member, said second member, and said intermediate member is adapted to provide a tensioning force.

90. The tensioner assembly as claimed in claim 89, wherein said second end of said first member is pivotally connected to said connecting member, said first end of said second member is pivotally connected to said connecting member, and said connecting member is bisected by a centerline of said tensioner assembly.

91. The tensioner assembly as claimed in claim 89, wherein said second end of said first member is pivotally connected to said connecting member, said first end of said second member is pivotally connected to said connecting member, and said connecting member rotates about a centerpoint of said connecting member when said tensioner assembly is coupled to said riser and to said floating platform and said floating platform moves within a given range along a longitudinal axis of said riser.

92. The tensioner assembly as claimed in claim 85, wherein said connecting member is substantially perpendicular to said first member and to said second member.

* * * * *